US011457706B2

(12) United States Patent
Lin

(10) Patent No.: US 11,457,706 B2
(45) Date of Patent: Oct. 4, 2022

(54) BODY-WORN STRUCTURE

(71) Applicant: Che-Wen Lin, New Taipei (TW)

(72) Inventor: Che-Wen Lin, New Taipei (TW)

( * ) Notice: Subject to any disclaimer, the term of this patent is extended or adjusted under 35 U.S.C. 154(b) by 0 days.

(21) Appl. No.: 16/847,421

(22) Filed: Apr. 13, 2020

(65) Prior Publication Data

US 2020/0237066 A1 Jul. 30, 2020

Related U.S. Application Data

(60) Continuation-in-part of application No. 15/884,928, filed on Jan. 31, 2018, now abandoned, which is a (Continued)

(30) Foreign Application Priority Data

May 30, 2008 (CN) ..... 200810028408.4
Feb. 11, 2020 (TW) ..... 109104316

(51) Int. Cl.
*A45C 9/00* (2006.01)
*A45C 13/10* (2006.01)
(Continued)

(52) U.S. Cl.
CPC ..... *A45C 9/00* (2013.01); *A45C 3/04* (2013.01); *A45C 7/0077* (2013.01);
(Continued)

(58) Field of Classification Search
CPC .... A01K 27/00; A01K 27/001; A01K 27/002; A01K 27/005; A01K 27/008; A45C 9/00;
(Continued)

(56) References Cited

U.S. PATENT DOCUMENTS 798,320 A * 8/1905 Carli ..... A01K 13/008 54/79.2
1,595,834 A * 8/1926 Griffiths ..... A01K 13/006 54/79.1
(Continued)

FOREIGN PATENT DOCUMENTS

CN 2101393 U 4/1992
CN 2756055 Y 2/2006
(Continued)

*Primary Examiner* — Monica L Barlow
*Assistant Examiner* — Aaron M Rodziwicz
(74) *Attorney, Agent, or Firm* — Muncy, Geissler, Olds & Lowe, P.C.

(57) ABSTRACT

The present invention provides a body-worn structure, and more particularly a body-worn structure that applies a containing structure to the body of an animal, including a person or pet, and uses a multifunctional structure for use by a user in various different circumstances. For example, the structure can be applied as a body protective device in an emergency situation in outdoor activities, such as riding a motorcycle, mountain-climbing, skiing, hand gliding, paragliding, and boating, when the body-worn structure is applied as a protective clothing, an airbag, airbag clothing, etc. Moreover, the body-worn structure is an all-in-one functional device, including use when taking a pet outdoors, when the structure can be applied as a pet knapsack, pet weatherproof clothing, pet carrier bag, and a fixing device for a pet droppings collection bag.

8 Claims, 44 Drawing Sheets

Related U.S. Application Data continuation-in-part of application No. 14/723,149, filed on May 27, 2015, now Pat. No. 9,913,515, which is a division of application No. 13/652,330, filed on Oct. 15, 2012, now abandoned, which is a continuation-in-part of application No. 12/955,678, filed as application No. PCT/CN2009/000596 on May 27, 2009, now abandoned.

(51) Int. Cl.

| | |
|---|---|
| ***A45F 3/00*** | (2006.01) |
| ***A45F 3/04*** | (2006.01) |
| ***A45C 7/00*** | (2006.01) |
| ***A45C 3/04*** | (2006.01) |
| ***A45F 4/12*** | (2006.01) |
| ***A45F 3/02*** | (2006.01) |

(52) U.S. Cl.

CPC ..... *A45C 7/0086* (2013.01); *A45C 13/1069* (2013.01); *A45C 13/1076* (2013.01); *A45F 3/005* (2013.01); *A45F 3/02* (2013.01); *A45F 3/04* (2013.01); *A45F 4/12* (2013.01); *A45C 2009/007* (2013.01); *A45C 2013/1015* (2013.01)

(58) Field of Classification Search

CPC ..... A45C 3/04; A45C 7/0077; A45C 7/0086; A45C 13/1069; A45C 13/1076; A45C 2009/007; A45C 2013/1015; A45F 3/005; A45F 3/02; A45F 3/04; A45F 3/12

See application file for complete search history.

(56) References Cited

U.S. PATENT DOCUMENTS

| | | | | | |
|---|---|---|---|---|---|
| 3,061,057 | A | | 10/1962 | Miller | |
| 4,081,061 | A | | 3/1978 | Tucker | |
| 4,117,874 | A | | 10/1978 | Berenguer | |
| 5,184,762 | A | * | 2/1993 | Nevitt | A01K 27/002 224/148.6 |
| 5,544,792 | A | | 8/1996 | Arnwine | |
| 5,632,235 | A | * | 5/1997 | Larsen | A01K 27/002 119/856 |
| 5,644,902 | A | * | 7/1997 | Kemp | A01K 27/008 54/37.1 |
| D383,255 | S | * | 9/1997 | Caditz | D30/145 |
| D384,780 | S | * | 10/1997 | McLaughlin | D30/152 |
| 5,738,043 | A | * | 4/1998 | Manuel | A01K 27/002 119/497 |
| 5,743,448 | A | | 4/1998 | Tsai | |
| 5,774,912 | A | * | 7/1998 | Dominique | A47K 10/02 5/419 |
| 5,819,999 | A | | 10/1998 | Tennant | |
| 5,887,772 | A | * | 3/1999 | Dooley | A01K 1/0263 119/858 |
| 5,964,384 | A | | 10/1999 | Young | |
| D429,390 | S | * | 8/2000 | Grady | D30/152 |
| D429,391 | S | * | 8/2000 | Grady | D30/152 |
| 6,279,706 | B1 | | 8/2001 | Mao | |
| 6,305,587 | B1 | | 10/2001 | Miller | |
| 6,530,507 | B2 | | 3/2003 | Oh | |
| 6,571,745 | B2 | * | 6/2003 | Kerrigan | A01K 13/006 119/792 |
| D480,843 | S | * | 10/2003 | Sullivan | A01K 27/002 D30/152 |
| 6,637,367 | B1 | * | 10/2003 | Dost | A01K 1/0353 119/28.5 |
| 6,640,751 | B1 | * | 11/2003 | Cool | A01K 15/00 119/727 |
| D483,940 | S | | 12/2003 | Dolan | |
| 6,802,282 | B2 | * | 10/2004 | Muckleroy | A01K 1/029 119/497 |
| 6,923,352 | B2 | | 8/2005 | Oh | |
| 7,225,483 | B1 | * | 6/2007 | Remblad | A45F 4/06 383/4 |
| 7,395,930 | B2 | | 7/2008 | Tauchen | |
| 7,617,956 | B1 | | 11/2009 | Sabbah | |
| 7,918,192 | B1 | * | 4/2011 | Digh | A01K 13/006 119/850 |
| 8,256,045 | B2 | * | 9/2012 | Cruz | A47G 9/06 5/485 |
| 8,292,136 | B2 | | 10/2012 | Tonelli | |
| 8,490,230 | B2 | * | 7/2013 | Rovin | A47D 5/006 5/655 |
| 8,820,596 | B1 | | 9/2014 | Bergquist | |
| 9,913,515 | B2 | * | 3/2018 | Lin | A45C 7/0086 |
| 2003/0066494 | A1 | * | 4/2003 | Hippensteel | A01K 27/003 119/792 |
| 2003/0079695 | A1 | * | 5/2003 | Kerrigan | A01K 13/006 119/858 |
| 2005/0028755 | A1 | * | 2/2005 | Le Fevre | A01K 23/00 119/868 |
| 2005/0072376 | A1 | * | 4/2005 | Kerrigan | A01K 13/008 119/850 |
| 2005/0076853 | A1 | * | 4/2005 | Leo | A01K 1/0254 119/497 |
| 2005/0263102 | A1 | * | 12/2005 | Sherman | A01K 1/0263 119/792 |
| 2006/0090711 | A1 | * | 5/2006 | Richards | A01K 13/006 119/850 |
| 2007/0012732 | A1 | * | 1/2007 | Adams | A01K 7/00 224/148.2 |
| 2007/0102460 | A1 | | 5/2007 | Lottman | |

FOREIGN PATENT DOCUMENTS

| | | | |
|---|---|---|---|
| CN | 101336768 | A | 1/2009 |
| CN | 201274838 | Y | 7/2009 |
| DE | 4436845 | A1 | 4/1996 |
| DE | 29614835 | U1 | 3/1997 |
| GB | 2393112 | A | 3/2004 |
| JP | 9206117 | A | 8/1997 |
| TW | I577309 | | 4/2017 |

* cited by examiner

BODY-WORN STRUCTURE

RELATED APPLICATION

This application is a Continuation-in-Part of currently pending U.S. patent application Ser. No. 15/884,928 filed on 2018 Jan. 31.

BACKGROUND OF THE INVENTION

(a) Field of the Invention

The present invention relates to a body-worn structure, and more particularly to a structure that uses a support enclosure or a jacket body with combined multiple functions to facilitate the user in meeting the various different needs for outdoor activities.

(b) Description of the Prior Art

In reference to Taiwan Patent Application No. 101118884 (Certification No. 1577309), that applies embodiments of a flexible enclosure 3 for pets, wherein its primary concept is similar to that of the embodiments of the present invention applied to pets, both applying a body-worn structure for pets, see FIGS. 1 to 4, wherein the flexible enclosure 3 is applied for use as a covering on a pet, hence, during the rainy season or unsettled weather when it unexpectedly rains, the flexible enclosure 3 can be conveniently used to protect the pet against rain whenever necessary, thus preventing the pet from catching a cold due to getting soaked by the rain.

The primary structure uses a male snap 161 and a female snap 162 to respectively join to the left and right sides of a front cover sheet 1. When in use, the male snap 161 and the female snap 162 are used to mutually secure fixing of the front cover sheet 1 and a rear cover sheet 2, thereby securely fixing the clothing onto the pet's body. The upper portion of the rear cover sheet 2 is provided with a holding portion 4, which facilitates the user to use to place pet paraphernalia therein, such as: plastic bags and related supplies for cleaning up pet droppings. The flexible enclosure 3 (covering) is joined between the front cover sheet 1 and the rear cover sheet 2, thus, when its raining, the user can use the flexible enclosure 3 (covering) to cover the pet's body (see FIG. 3). Furthermore, the front portions of the front cover sheet 1 and the rear cover sheet 2 are provided with an annular belt 165, an adjustment piece 166, and a pair of male/female buckles 167 (168). The adjustment piece 166 is used to adjust the length of the annular belt 165, accordingly, facilitating slipping the annular belt 165 onto a pet. The pair of male/female buckles 167 (168) are also used to securely fix the annular belt 165. The joining area where the upper portion of the annular belt 165 is joined to the edges of the front and rear cover sheets 1 (2) is provided with a fixing ring 169, which is used to enable the user to hook and fasten a pull rope 171 provided with a hook ring 170 thereto, with the pull rope 171 being used to control the pet when walking.

The primary shortcomings of the flexible enclosure 3 as described above applied for use as a covering structure on the pet are as follows:

《1》. The annular belt 165 does not disclose the component force structure related to dispersing the pulling force of the pull rope 171. When the pet suddenly dashes forward forcing the user to pull on the pull rope 171 to oppose and stop such action, if there is only the simple structure comprising the annular belt 165 slipped around the pet, when the hook ring 170 is hooked and fastened to the fixing ring 169, and the pulling force of the pull rope 171 is directly applied to the annular belt 165, then it easily results in uncomfortable constriction of the pet's neck, and could even cause injury to the pet.

《2》. When the user covers the flexible enclosure 3 (covering) onto the pet's body as protection against wind and rain, the flexible enclosure 3 (covering) does not disclose a design related to rainproofing a though hole, which would facilitate the fixing ring 169 to pass therethrough to enable the hook ring 170 of the pull rope 171 to hook and fasten thereto.

《3》. When the user covers the flexible enclosure 3 (covering) onto the pet's body as protection against wind and rain, the flexible enclosure 3 (covering) does not disclose a design related to a fixing device that would facilitate securely fixing the unfolded flexible enclosure 3 (covering) onto the pet's body, accordingly, preventing the flexible enclosure 3 (covering) from being blown open during strong winds and heavy rain.

《4》. Because a containing port 301 is confined to a position on the underside of the pet's body (as shown by the dotted line in FIG. 1), hence, when the user opens the rear cover sheet 2 to use the flexible enclosure 3 (covering) and covers the pet's body therewith, because the rear cover sheet 2 is positioned on a lower portion of the flexible enclosure 3 (covering), a cover assembly 21 and a cover piece 11 cannot be used to close up the rear cover sheet 2 and the front cover sheet 1. Accordingly, the user must dispose the opened rear cover sheet 2 together with the holding portion 4 provided on the upper portion thereof through the containing port 301, causing the rear cover sheet 2 to be retained in a containing space 30 between the front cover sheet 1 and the flexible enclosure 3 (covering) (as shown in FIG. 2). When many articles are placed within the holding portion 4, disposing articles through the containing port 301 becomes difficult; moreover, the handling procedure is somewhat complex, and is not essential. However, contents of the prior art do not disclose how to prevent this complicated handling procedure in actual use.

In addition, in reference to a sixth embodiment of the prior art, wherein the containing structure for the flexible enclosure 3 (pet carrier bag) is applied to pets, as depicted in FIGS. 4 to 6, whereby the sixth embodiment primarily comprises the front cover sheet 1, the rear cover sheet 2, the cover piece 11 provided on the peripheral edge of the front cover sheet 1, the cover assembly 21 provided on the peripheral edge of the rear cover sheet 2, and the flexible enclosure 3 (pet carrier bag). The open/close direction of the cover piece 11 and the cover assembly 21 is positioned corresponding to the pet's head. An extension portion 132 is used to retain the flexible enclosure 3 (pet carrier bag) after folding between the front cover sheet 1 and the rear cover sheet 2, wherein the left and right sides of the front cover sheet 1 are respectively joined to the male snap 161 and the female snap 162. When a pet is wearing the clothing, the rear cover sheet 2 is below and the front cover sheet 1 is on top so as to be positionally aligned relative to the pet's body. Mutual connection between the male snap 161 and the female snap 162 is used to dress and securely fix the front and rear cover sheets 1(2) onto the pet's body; moreover, the upper portion of the front cover sheet 1 is provided with the holding portion 4, which facilitates the user to use the holding portion 4 to place pet paraphernalia therein, such as: plastic bags and related supplies related for cleaning up pet droppings. When in use, the cover piece 11 and the cover assembly 21 are used to open up the rear cover sheet 2, and after opening up the rear cover sheet 2 and unfolding the flexible enclosure 3 (pet carrier bag), the user can choose to use the cover assembly 21 and the cover piece 11 to partially close the rear cover sheet 2 and the front cover sheet 1 or fit the opened rear cover sheet 2 into the containing space 30 provided by the front cover sheet 1 through the containing port 301 (as shown in FIG. 5). After unfolding the flexible enclosure 3 (pet carrier bag), an opening 40 is correspondingly positioned at the pet's lower portion, and a pet can be upwardly fitted into the flexible enclosure 3 (pet carrier bag) through the opening 40, then a carrying handle 31 can be used to hand carry the pet or carry the pet on the shoulder by means of the flexible enclosure 3 (pet carrier bag).

The primary shortcomings of the flexible enclosure 3 as described above applied for use as a pet carrier bag structure are as follows:

《1》. Because the open/close direction of the cover piece 11 and the cover assembly 21 is positioned corresponding to the pet's head, hence, when the user opens up the rear cover sheet 2 to use the flexible enclosure 3 (pet carrier bag), the user must use the extension portion 132 to take out the flexible enclosure 3 (pet carrier bag). The extension portion 132 is a long fabric strip shape joined between the rear cover sheet 2 and the flexible enclosure 3 (pet carrier bag), and the fabric strip of the extension portion 132 must be of a predetermined length in order to facilitate the user to manipulate taking out the flexible enclosure 3 (pet carrier bag) and fit a pet inside the flexible enclosure 3 (pet carrier bag), or, after no longer needing to use the flexible enclosure 3 (pet carrier bag), folding up the flexible enclosure 3 (pet carrier bag) and returning it to a retaining space 20 between the front cover sheet 1 and the rear cover sheet 2. Accordingly, during the process of taking out and putting back, phenomena resulting in the fabric strip of predetermined length of the extension portion 132 curling up or turning inside out easily occur that hindrance manipulation thereof. However, contents of the prior art do not disclose a structure that prevents the aforementioned phenomena in actual use.

《2》. Because the open/close direction of the cover piece 11 and the cover assembly 21 is positioned corresponding to the pet's head, after opening up the front cover sheet 1 and unfolding the flexible enclosure 3 (pet carrier bag), slight awkwardness is apparent in the front cover sheet 1 because it is necessary to choose to use the cover piece 11 and the cover assembly 21 to partially close up the front cover sheet 1 and the rear cover sheet 2, or dispose the opened up front cover sheet 1 within the retaining space 20 provided by the rear cover sheet 2 through the containing port 301. However, contents of the prior art do not disclose a structure that prevents the aforementioned phenomenon in actual use.

《3》. When the user wishes to concurrently retain the functions of a flexible enclosure applied as a covering that protects the pet against wind and rain and apply the flexible enclosure as a pet carrier bag or as a function for hand carrying the pet, contents of the prior art do not disclose a structure that preserves the aforementioned phenomena in actual use.

Apart from the shortcomings of the aforementioned prior art related to the flexible enclosures applied in a covering and a pet carrier bag, a conventional droppings collector for pet use is also available in the market, which primarily comprises a holding device that is clipped onto a dog's tail, and a paper bag or a plastic bag is concurrently securely fixed to the holding device corresponding to the position of the dog's anus to receive droppings, whereby, when the dog is defecating and discharging the droppings onto the floor, the droppings collector can prevent not only impacting environmental sanitation but also troubling the pet owner to clean up the excrement. Because the aforementioned conventional holding device needs to be firmly clipped onto the dog's tail, apart from causing discomfort to the dog, when the dog is wagging its tail, the paper bag or a plastic bag used to receive the dog droppings will at the same time swing along with the wagging tail, thus affecting use effectiveness and degree of difficulty in use. Furthermore, the structure of the holding device can only be applied to long tailed dogs, meaning the holding device cannot be used on other short-tailed or tailless dogs, and is thus extremely unideal.

Apart from applying embodiments of the flexible enclosure for pets, the present invention can also apply a structure using the same principle for the flexible enclosure to cover a variety of target subjects, including people and other animals. Moreover, apart from the above-described covering body and pet carrier bag having waterproof and windproof functions, the application range of the flexible enclosure further includes application in body protective devices for either protective clothing, hollow sphere, hollow airbag, or airbag clothing.

In view of the above shortcomings, the applicant, having accumulated many years of experience in related arts, and following continuous research and experimentation, finally succeeded in producing a new and improved containing structure able to achieve the objective of combining multiple functions, which can also further variably apply the flexible enclosure structure in products such as a pet covering and a pet carrier bag.

SUMMARY OF THE INVENTION

The primary object of the present invention lies in providing a body-worn structure, and more particularly to a body-worn structure that is worn on a pet's body using a support enclosure. When a user is taking their dog for a walk outdoors, apart from allowing the pet to walk on the ground using a pull cord, the support enclosure also concurrently combines multiple functions, enabling the user to use in various different circumstances. The present invention primarily comprise a front cover sheet, an edge of which is provided with a cover piece; a rear cover sheet, an edge of which is provided with a cover assembly corresponding to the cover piece; a connecting portion provided on the front cover sheet, wherein the front cover sheet and the rear cover sheet are mutually joined using the connecting portion; a first joining edge provided on the front cover sheet; a second joining edge provided on the rear cover sheet; and the support enclosure comprising a first fastening portion and a first fastening assembly portion.

Based on the aforementioned characteristics of the primary structure, the support enclosure is provided with a drawstring, and the extremity of the drawstring is provided with a fixing ring. The drawstring further comprises a pull cord and a hook ring provided on the pull rope. When the covering is in an unfolded state, the drawstring is able to pass through a through hole, and the fixing ring at the extremity of the drawstring is mutually fastened with the hook ring at the front-end of the pull cord.

Based on the aforementioned characteristics of the primary structure, the rear cover sheet is provided with a holding portion to form a small carrier bag, thereby facilitating the user to use the holding portion to place pet paraphernalia, such as: plastic bags and related supplies for cleaning up pet droppings. The small carrier bag is provided with a switching piece and a switching assembly.

Based on the aforementioned characteristics of the primary structure, the support enclosure is designed as a vest-formed covering body. The first fastening portion and the first fastening assembly portion are formed as an integral body and provided on the left and right sides of the vest-formed covering body; moreover, the vest-formed covering body is made from mesh fabric, which enables achieving ventilation effectiveness when the weather is scorching hot. The front left and right ends of the vest-formed covering body are respectively provided with an annular belt disposed on the chest of the pet.

Based on the aforementioned characteristics of the primary structure, the support enclosure directly forms the front cover sheet. The left and right sides of the front cover sheet are respectively joined to the first fastening portion and the first fastening assembly portion. The first fastening portion and the first fastening assembly portion are used to mutually secure fixing of the front cover sheet and the rear cover sheet, thereby securely fixing the clothing onto the pet. The front left and right sides of the front cover sheet are respectively provided with the annular belt disposed on the chest of the pet, The aforementioned annular belts are provided with at least one first adjustment piece, and the adjustment piece is used to adjust the length of the annular belt, accordingly, facilitating slipping the annular belt onto pets with different body types.

Based on the aforementioned characteristics of the primary structure, either the aforementioned first fastening portion or the first fastening assembly portion is provided with at least one female buckle, which enables connecting with male buckles provided on the front ends of the annular belts, thereby enabling mutual joining thereof. Furthermore, the stress of the pull rope is dispersed to the first fastening portion and the first fastening assembly portion. Each of the female buckles assumes an X-shaped intersecting device or a Y-shaped double-ended type buckle, and the connection between the female and male buckles forms a Y-shaped or X-shaped buckle component structure, which further disperse the strain of the drawstring to the first fastening portion and the first fastening assembly portion. In addition, each of the female buckles is provided with a second adjustment piece, and the second adjustment piece is used to adjust the tightness between the annular belts and the first fastening portion and the first fastening assembly portion, accordingly, facilitating comfortable slipping the annular belt onto a pet; the female buckle can alternatively be replaced by male buckle and vise versa.

Based on the aforementioned characteristics of the primary structure, the flexible enclosure of the present invention is a covering that assumes a cover sheet form. A retaining space formed between the front cover sheet and the rear cover sheet is used to retain the folded up covering, and the cover piece and the cover assembly are further used to close up the front cover sheet and the rear cover sheet. When the front cover sheet and the rear cover sheet are in a closed state, the connecting portion is horizontally positioned between the rear cover sheet and the front cover sheet; and when the front cover sheet and the rear cover sheet are in an opened state, the rear cover sheet and the front cover sheet, after being horizontally connected through the connecting portion, are aligned on the back of a pet. In addition, the guiding principle applied is that the unfolded length after opening up does not exceed the entire body length of the pet. The covering is fabricated from material provided with a waterproof function, and when in an unfolded state, the entire covering area of the covering is greater than or equal to the total area of the front cover sheet and the rear cover sheet when in an opened state, thereby enabling the covering to entirely cover the front cover sheet and the rear cover sheet combined with the upper portion of the small carrier bag formed by the holding portion, accordingly, achieving the effectiveness to protect against rain. The front portion of the covering is provided with a head cover corresponding to a pet's head position, and can be used to prevent the pet's head from getting soaked by rain.

Based on the aforementioned characteristics of the primary structure, the front portion of the covering is provided with a through hole corresponding to the position of the drawstring, and the through hole is provided with a first waterproof piece and a second waterproof. The first waterproof piece effects a structure on the upper portion of the second waterproof piece that overlaps and covers a partial area of the through hole to form a variable opening, which is used to prevent rain water from seeping into the through hole. When its raining, and the covering is in an unfolded state, the user is able to pass the drawstring through the through hole, and the fixing ring at the extremity of the drawstring is used to fasten to the hook ring at the front end of the pull cord, thereby achieving the objective allowing the user to still able to walk their pet on the ground using the pull cord on a rainy day.

Based on the aforementioned characteristics of the primary structure, apart from the aforementioned covering entirely covering the aligned front cover sheet and the rear cover sheet as well as the upper portion of the small carrier bag formed by the holding portion, during use, the user can choose to dispose the rear cover sheet and the small carrier bag formed by the holding portion into a containing space formed between the front cover sheet and the covering because the third joining edge and the first joining edge adopt a partial joiningway, and the unconnected area forms a containing port. When the flexible enclosure is in an unfolded state, the containing port is used to dispose the rear cover sheet within the containing space between the front cover sheet and the flexible enclosure. On the other hand, when it is desired to contain the folded flexible enclosure inside the containing space, the user can take out the rear cover sheet from the containing space through the containing port, and close up the rear cover sheet and the front cover sheet using the cover piece and the cover assembly.

Based on the aforementioned characteristics of the primary structure, the front cover sheet is further provided with a side surround, and the side surround uses a fourth joining edge and a fifth joining edge to respectively join to the third joining edge of the flexible enclosure and the first joining edge of the front cover sheet, thereby enlarging the capacity within the containing space, accordingly, achieving the effectiveness of easily containing the rear cover sheet and the small carrier bag.

Based on the aforementioned characteristics of the primary structure, the covering comprises a forepart, one side of which is provided with a second fastening portion, and another side is provided with a second fastening assembly portion corresponding to the second fastening portion. The second fastening portion and the second fastening assembly portion are mutually joined to enable covering and securely fixing the covering to the chest position of a pet. The left side and the left rear angled end of the covering are respectively provided with a third fastening portion and a third fastening assembly portion, while the right side and the right rear angled end are respectively provided with a fourth fastening portion and a fourth fastening assembly portion. The mutual joining between the third fastening portion and the third fastening assembly portion and the mutual joining between the fourth fastening portion and the third fastening assembly portion are used to enable the covering to respectively cover and be securely fixed on the hind legs portions of a pet.

Another object of the present invention is applying the body-worn structure for flexible enclosures to a pet carrier bag for carrying a pet, wherein the pet carrier bag is provided with an opening, and the opening is used to place a pet within the pet carrier bag to achieve a portability function that enables the user to carry the pet on their shoulder or hand carry, which is particularly suitable for use in a situation that prohibits a pet on a leash from entering a certain location. The pet carrier bag is joined between the rear cover sheet to effect secure fixing to the support enclosure fitted on the pet. The retaining space formed between the front cover sheet and the rear cover sheet enables retaining the folded pet carrier bag, and the cover piece and the cover assembly are further used to close up the front cover sheet and the rear cover sheet.

Based on the aforementioned characteristics of the primary structure, when the front cover sheet and the rear cover sheet are in a closed state. the connecting portion is horizontally positioned between the rear cover sheet and the front cover sheet, and when the front cover sheet and the rear cover sheet are in an opened state, the front cover sheet is positioned on the upper portion of a pet's back. The rear cover sheet fulfills an extension function of an extension portion that hangs on one side of the pet's body through longitudinal connection of the connecting portion, and the extension function is used to further join to the pet carrier bag. When in use, opening and extending of the bag opening downwards to a pet's legs facilitates placing the pet within the pet carrier bag through the bag opening in an upward direction. In addition, the bag opening of the pet carrier bag corresponding to one end of the pet's head is provided with a curve bend to facilitate enabling the pet's head to protrude out from the bag opening.

Another object of the present invention lies in the body-worn structure applied to the covering for a pet to wear and the pet carrier bag for carrying a pet, thereby concurrently providing two functions, which primarily uses the rear cover sheet to fulfill an extension function of the extension portion to join to the pet carrier bag and concurrently join the front cover sheet to the covering.

Based on the aforementioned characteristics of the primary structure, the rear cover sheet is provided with a first fixing member and a first fixing assembly member. The first fixing member and the first fixing assembly member are used to securely fix the pet carrier bag after folding thereof. The front cover sheet is provided with a second fixing member and a second fixing assembly member. The second fixing member and the first fixing assembly member are used to securely fix the covering after folding thereof. The containing port is longitudinally provided on the side of the pet's body, and when the covering is in an unfolded state, the rear cover sheet uses the first fixing member and the first fixing assembly member to completely retain and hang the pet carrier bag on one side of the pet's body. Hence, because the pet carrier bag hangs on one side of the pet's body, it's possible an unbalanced state in the center of gravity results in the support enclosure becoming askewed due to a single side bearing the load, therefore, at this time, the user can use the containing port to dispose the rear cover sheet within the containing space between the front cover sheet and the covering. Accordingly, the rear cover sheet together with the retained covering are disposed on the lower portion of the front cover sheet using a longitudinal overlapping method, thus achieving the function that enables the entire structure, after completing retaining the pet carrier bag and the covering, to be concurrently longitudinally positioned on the upper portion of the pet's body.

Yet another object of the present invention lies in application of the support enclosure being worn on a pet's body, the support enclosure being further fitted with a front harness and a rear harness, wherein the front harness further comprises a first traverse belt, a second traverse belt, and a lengthwise belt. The two ends of the first traverse belt are respectively fitted with a left, right female buckle, and the two ends of the second traverse belt are respectively fitted with a second traverse belt male and a corresponding second traverse belt female buckle to enable fastening together to form a front connected section. In addition, each side of the second traverse belt buckles are respectively fitted with a corresponding fixing ring, which facilitate connecting the hook ring fitted at the front end of the leash to the fixing rings when taking a dog for a walk outdoors. The rear harness comprises a third transverse belt, the two ends of the third traverse belt are respectively fitted with a third traverse belt male buckle and a corresponding third traverse belt female buckle to facilitate forming a rear connected section after mutual fastening; moreover, the third transverse belt is respectively fitted with left, right connecting male buckles corresponding to the left, right female buckles at the two ends of the first traverse belt, which facilitate forming left, right assembly sections after connecting together. After assembling all the belts as described above, the belt system assumes a square belt harness structure; the female buckle can alternatively be replaced by male buckle and vise versa.

According to the above-described characteristics of the primary structure, the square belt harness structure system is further fitted with a holding portion, which is a small, split type structural bag. Two sides of the holding portion are respectively provided with a fixing member, and corresponding fixing members are fitted to the main body of the holding portion. The fixing members and the corresponding fixing members are used to movable cover and fix either the left, right assembly sections or the front, rear connected sections therebetween, thus enabling positioning the holding portion on the upper side of the square belt structured support enclosure.

According to the above-described characteristics of the primary structure, application is provided enabling the front, rear harnesses to be separated or joined. When the small bag provided with the holding portion is not needed, the user can choose to singly use the front harness, thereby enabling connecting the leash to the fixing rings when taking the dog for a walk outdoors. When the user needs to use the small bag, the front and rear harnesses are joined together, with the fixing members and the corresponding fixing members being used to position the small bag on the upper side of the support enclosure.

A further object of the present invention lies in application of the support enclosure being worn on a pet's body, and being further applied in a fixing device for a pet droppings collection bag, wherein either the structure rear side, support enclosure rear side, the front harness, or the rear harness formed by the front cover sheet and rear cover sheet is fitted with at least one ring, and the rings are fitted to an external connected fixing device, which is used to securely fix the pet droppings collection bag. The fixing device is provided with left, right positioning devices able to fixedly position to either the rings or a belt intersecting member. Either the two left, right positioning devices, the two left, right hook members, or the fixing belts are used to pass through and be fixed to the rings or the belt intersecting device, thereby enabling achieving the function to securely position the pet droppings collection bag at the position of the pet's anus and receive the excrement discharged by the pet.

Based on the aforementioned characteristics of the primary structure, the fixing device is a ring member provided with corresponding male and female clasp grooves. The bend structures on the two ends of the male and female clasp grooves are used to achieve an open/close function. Moreover, the male and female clasp grooves comprise a male fastener and a female fastener, respectively. When in use, the opening of the pet droppings collection bag is correspondingly positioned at a clip opening formed before closing the male and female clasp grooves, whereupon the clip opening and the closing action of the male and female fasteners are used to securely fix the pet droppings collection bag; the female clasp groove or fastener can alternatively be replaced by male clasp groove or fastener and vise versa.

Another object of the present invention lies in application of the aforementioned structures in the support enclosure worn on the pet's body, with further application in a fixing device for a pet droppings collection bag, the only difference is in the fixing device that comprises a left fixing belt and a right fixing belt; the ring comprises a first ring and a second ring corresponding to the left fixing belt; and a third ring and a fourth ring corresponding to the right fixing belt the left hook member comprises a left upper hook member and a left lower hook member provided on the left fixing belt. The right hook member comprises a right upper hook member and a right lower hook member provided on the right fixing belt. The left fixing belt is wrapped round the pet's left leg after securely hooking the left upper hook member with the first ring, and then the left lower hook member is used to securely hook onto the second ring. The right fixing belt is wrapped round the pet's right leg after securely hooking the right upper hook member with the third ring, and then the right lower hook member is used to securely hook onto the fourth ring.

Based on the above-described characteristics of the primary structure, the fixing device comprises a first main body, a second main body, and a bending member positioned between the first main body and the second main body. The first main body and the second main body are respectively fitted with at least one corresponding male buckle and female buckle, as well as being provided with a central positioned, corresponding first passage and a second passage.

The first main body and the second main body are respectively fitted with a corresponding male clasp and female clasp. A protruding edge is provided on the first passage of the first main body, and the protruding edge is used to mount the pet droppings collection bag thereon. The corresponding male buckle and female buckle are used to hold down and fix the pet droppings collection bag between the first main body and the second main body and be located at the position on the of the first passage and the second passage; the female buckle can alternatively be replaced by male buckle and vise versa.

Based on the above-described characteristics of the primary structure, the protruding edge located on the first passage is provided with a predetermined height and diameter, and after folding down the first main body and the second main body, the protruding edge of the pet droppings collection bag protrudes out from the second main body. Moreover, after covering the pet droppings collection bag on the fixing device and contacting the area surrounding the pet's anus, then feces excreted by the pet is unlikely to soil the fixing device. In addition, the protruding edge is provided with a clasp groove, thus, when the protruding edge protrudes out from the second main body, a clasping pin fitted on the peripheral edge of the second passage enables achieving a stable clasping effect therein.

Based on the above-described characteristics of the primary structure, at least one external extended member is disposed at the top edge position of the end opening of the protruding edge provided on the first main body. After folding down the first main body and the second main body, the protruding edge protrudes out from the second main body, whereupon the external extended member is used to enable achieving a stable clasping effect with the peripheral edge of the second passage. Because the top edge at the end opening of the protruding edge is provided with the external extended member, when the user needs to open the first main body and the second main body, the user can press the external extended member to cause slight deformation thereof to enable separation of the first main body and the second main body.

Based on the above-described characteristics of the primary structure, the two sides of the second main body are respectively fitted with left, right active holes and left, right swinging members. The left, right swinging members are respectively fitted with left, right movable members, and the left, right movable members and the left, right active holes correspondingly clasp together to form a movable configuration, which is used to adjust the circumferential angle of the fixing device surrounding the pet's anus.

Based on the above-described characteristics of the primary structure, the upper edge of the second main body is provided with an indentation, and the upper portion of the second main body is further fitted with an arched body provided with a recess, which provides space for the pet's tail to pass through. The arched body is provided with a bending angle relative to the second main body, and is horizontally disposed on the pet's back after passing the pet's tail through the recess.

Based on the above-described characteristics of the primary structure, the upper portion of the arched body is additionally provided with an upper hole, enabling connecting to a movable separable upper fixing belt through the upper hole and to the rings or the belt intersecting device provided on the support enclosure, thereby enabling more stable holding of the fixing device to the area surrounding the pet's anus. Because the upper edge of the second main body is provided with the indentation, after clasping together the first and second main bodies, only the upper edge of the first main body is positioned between the pet's anus and tail; moreover, because the area of contact surrounding the pet's anus is very small, thus, the pet's defecation easily drops into the interior of the pet droppings collection bag.

Yet another object of the present invention lies in applying the covering body in a body protective device, such as protective clothing or airbag clothing. The body protective device comprises a front cover sheet, which is a jacket formed from a front inner piece and a rear inner piece, wherein the jacket is provided with openings to enable the user to put on. The body protective device is fitted to the outer side of the jacket to enable use as an outer clothing or covering for the wearer. A containing space formed between the front cover sheet and the rear cover sheet is used to retain the folded up covering body, with fixing members and corresponding fixing members used to close up the front cover sheet and the rear cover sheet. When the body protective device is an airbag clothing, the airbag clothing comprises an inner airbag and an outer airbag. The structures of the inner and outer airbags can be either a single piece airbag or a plurality of independent airbags. Using a plurality of independent airbags as an example, each of the independent airbags is provided with an independent air chamber and a free end. When in a deflated state, the airbags assume a partial overlapping configuration, and when in an inflated state, the airbags are set upright and connected together.

Based on the above-described characteristics of the primary structure, when applied in a body protective device, such as protective clothing or airbag clothing, the covering body mainly comprises three configurations, wherein the rear cover sheet of the first configuration further comprises a first covering piece, which is fitted to the periphery of the jacket. Moreover, the first covering piece is fitted with a front left covering piece and a front right covering piece, wherein the front left covering piece and the front right covering piece are respectively connected to a front inner piece, and are further respectively fitted with at least one fixing member and a corresponding fixing member. The covering body further comprises a front covering body, and a retaining space formed between the front inner piece and the left, right covering pieces is able to retain the folded up front covering body, as well as further close up the left, right covering pieces using the fixing members and the corresponding fixing members. In addition, the rear cover sheet further comprises a second covering piece.

Based on the above-described characteristics of the primary structure, the rear cover sheet of the second configuration is the first covering piece corresponding to the front inner piece. The first covering piece is fitted to the periphery of the front side of the jacket, wherein the fixing members are fitted to the first covering piece, and the corresponding fixing members are fitted to the edge of the front inner piece. A retaining space formed between the front inner piece and the first covering piece is able to retain the folded up front covering body, as well as further close up the first covering piece using the fixing members and the corresponding fixing members.

Based on the above-described characteristics of the primary structure, the rear cover sheet of the third configuration is fitted to the periphery of the front side of the jacket using the single covering piece. The single covering piece corresponds to the single inner piece, wherein the fixing members are fitted to the single covering piece, and the corresponding fixing members are fitted to the edge of the single inner piece. A retaining space formed between the single inner piece and the single covering piece is able to retain the folded up single covering body, as well as further close up the single covering piece using the fixing members and the corresponding fixing members.

Yet another object of the present invention lies in the covering body using a hollow spherical body or a hollow airbag as embodiments of a body protective device, wherein the body protective device is provided with a plurality of support columns, which are either inflatable air cylindrical body structures or foldable elastic cylindrical bodies. In addition, the plurality of support columns are connected to either the front inner piece or the rear inner piece, and are used to support fixing the configurational shape of the exterior of the hollow spherical body or the hollow airbag. When the support columns are configured as air column structures, a connective inflating channel is provided between the air column structures and the hollow spherical body or the surface of the hollow spherical body. The surface of the hollow spherical body or the hollow airbag can be configured as a single sheet flat surface or a plurality of airbag surfaces. When the surface is configured as a plurality of airbags, an outer airbag having a plurality of independent airbag structures is adopted, with each of the independent airbags being provided with an independent air chamber and a free end. When in an deflated state, the structure assumes a partial overlapping configuration, and when in an inflated state, the airbags are set upright and connected together. The hollow spherical body or the hollow airbag either comprise at least front cover sheets or rear cover sheets, and further comprise at least one joining opening. The joining opening is formed from the joining of two joining ends, and the joining opening is provided with a sealing member.

Based on the above-described characteristics of the primary structure, the body protective device comprises either an air supply, a manual inflating device, or an automatic inflating device. In an emergency situation, the jacket wearer can carry out a manual inflation operation. The automatic inflating device is fitted with a synchronous start switch, a sensor, and a manual changeover switch. In an emergency situation, the sensor transmits a signal to the synchronous start switch to open a fourth valve to channel in air from the air supply, thereby enabling achieving the objective of inflating the airbags. Under certain conditions, when the sensor malfunctions or is inappropriate to auto-start, the manual changeover switch can be used to control the fourth valve. In addition, the body protective device can further comprise a global satellite positioning device, which is connected to the synchronous start switch and the sensor. In an emergency situation, the sensor can automatically transmit a satellite positioning signal to facilitate rescuing the accident victim.

Based on the above-described characteristics of the primary structure, the body protective device of the present invention has application in activities including mountain-climbing and skiing, use as a safety airbag when riding a motorcycle, in water activities such as boating, and aerial activities such as hand gliding or paragliding, or after pairing with essential life support equipment, can also be further applied in safety equipment for passengers travelling by airplane. According to the criteria required for each of the activities described above (such as: temperature, speed, altitude, pressure, impact force, etc.) the sensor can be set to transmit the appropriate signal to the synchronous start switch and when to transmit the signal.

To enable a further understanding of said objectives and the technological methods of the invention herein, a brief description of the drawings is provided below followed by a detailed description of the preferred embodiments.

DETAILED DESCRIPTION OF THE PREFERRED EMBODIMENTS

Figure 1:
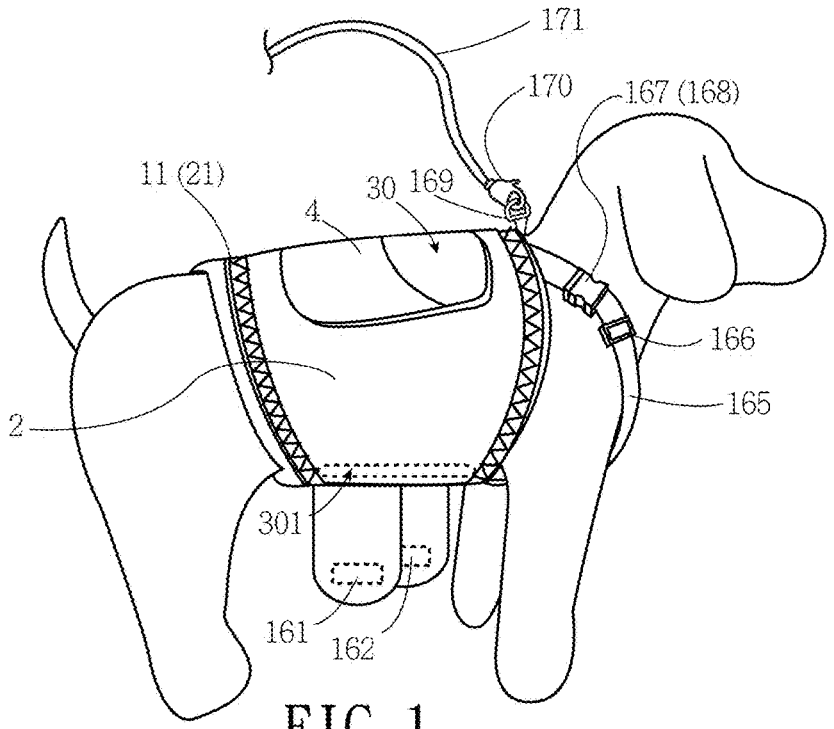
FIG. 1 Prior Art
FIG. 1 is a structural schematic view depicting an operating state of a pet covering of the prior art.
Figure 2:
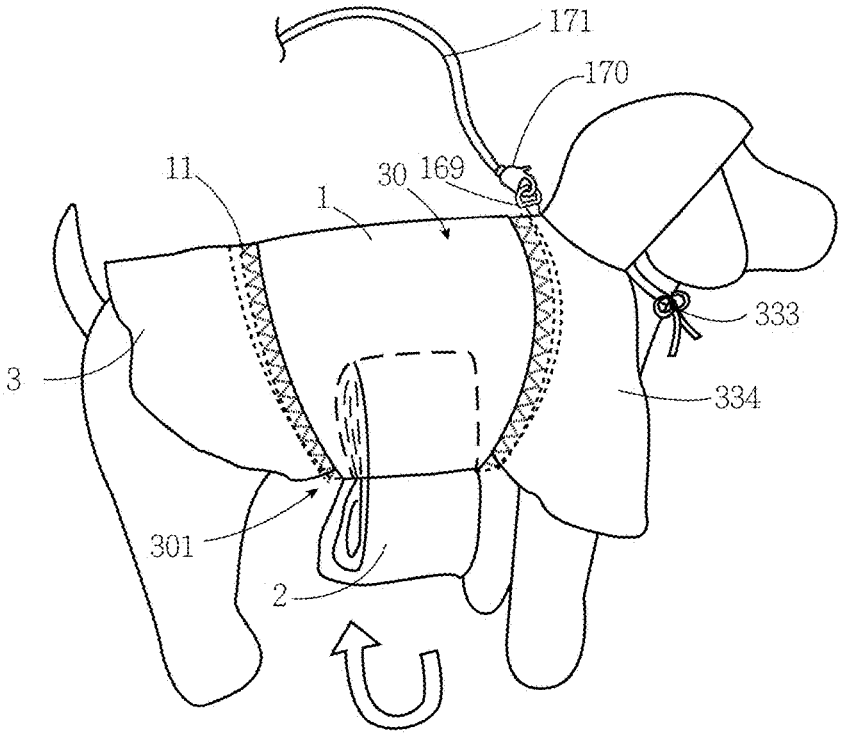
FIG. 2 Prior Art
FIG. 2 is a structural schematic view depicting an operating state of the pet covering of the prior art.
Figure 3:
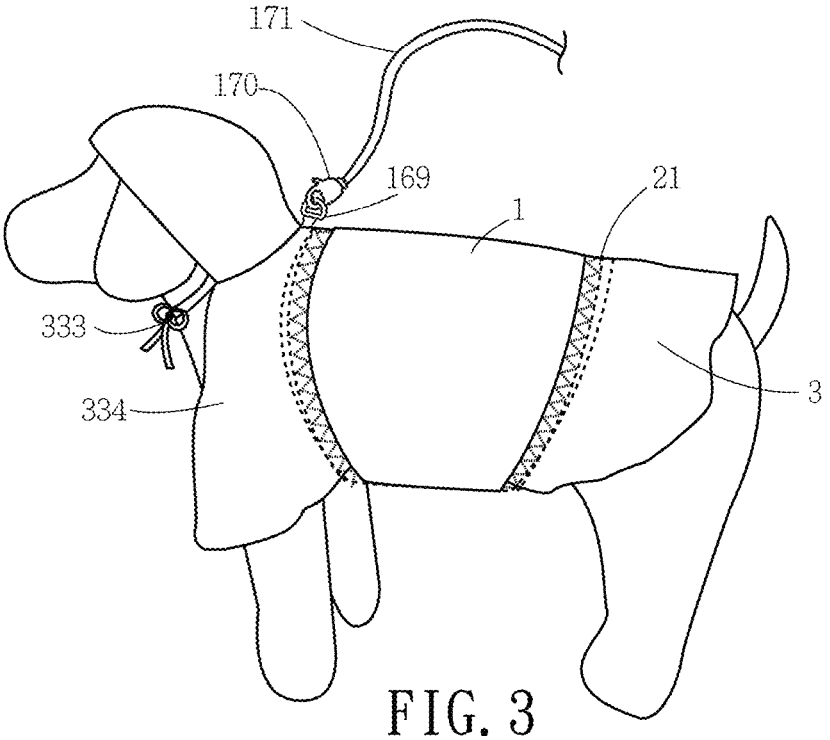
FIG. 3 Prior Art
FIG. 3 is a structural schematic view of the pet covering in an unfolded state of the prior art.
Figure 4:
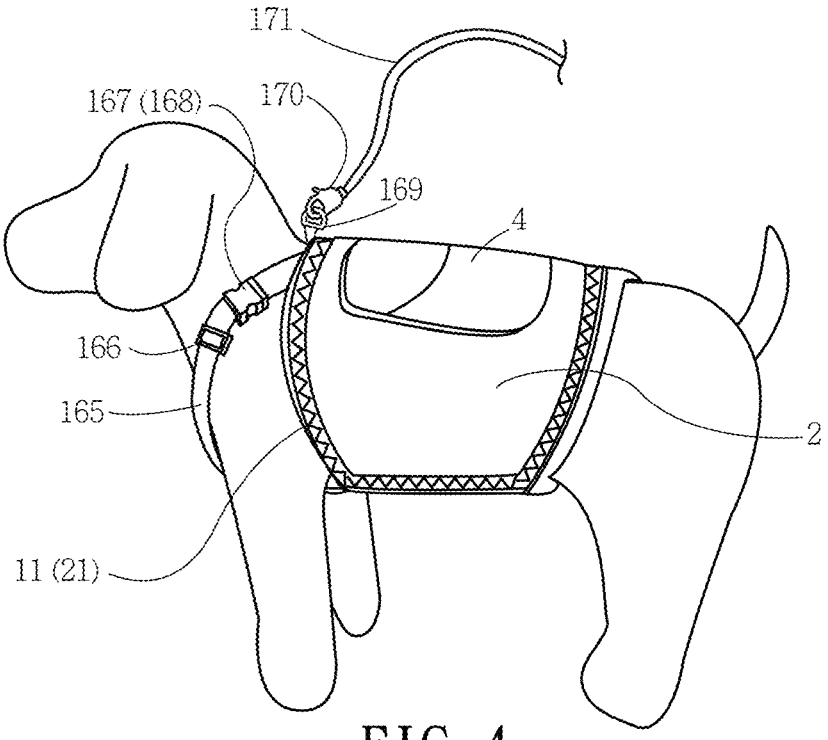
FIG. 4 Prior Art
FIG. 4 is a structural schematic view depicting the pet covering in a stored away state of the prior art.
Figure 5:
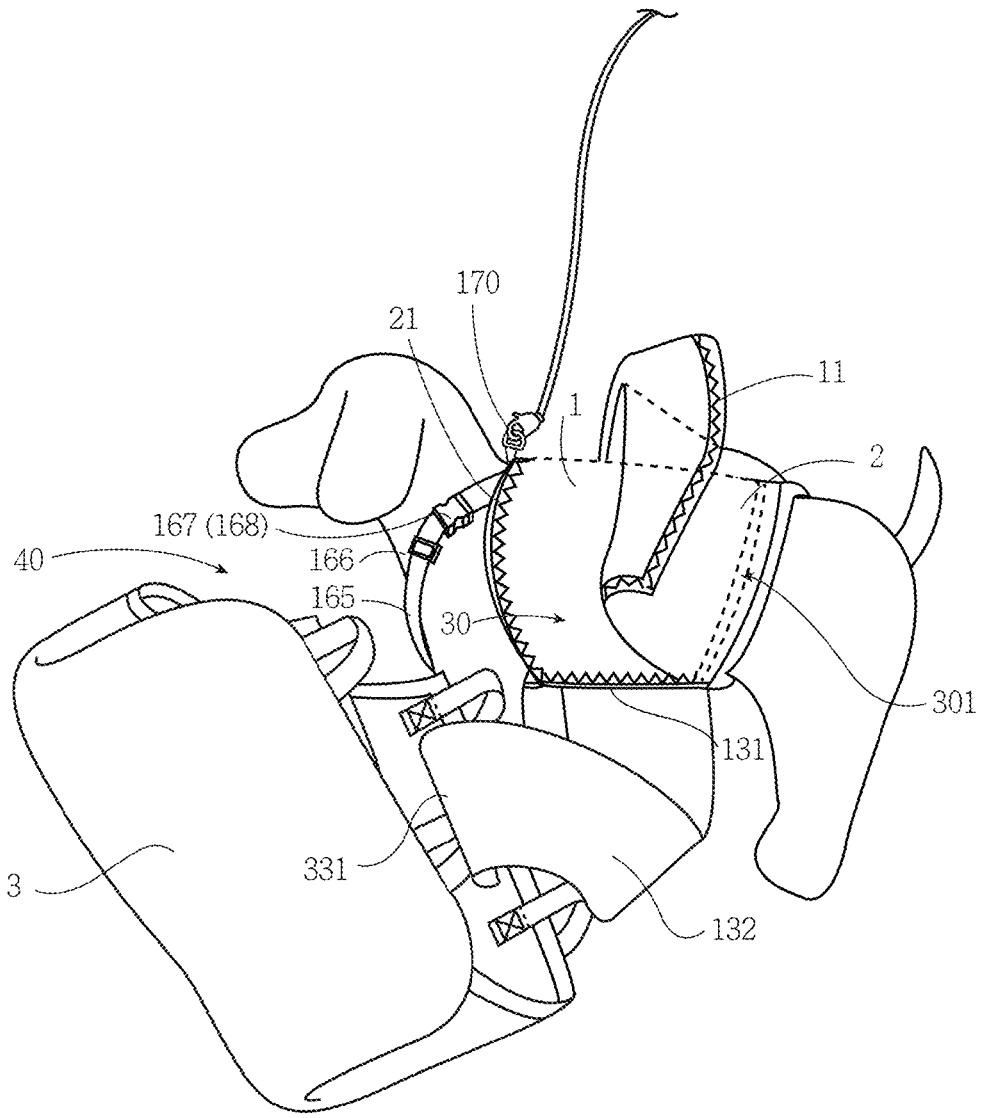
FIG. 5 Prior Art
FIG. 5 is a structural schematic view depicting a pet carrier in an unfolded state of the prior art.
Figure 6:
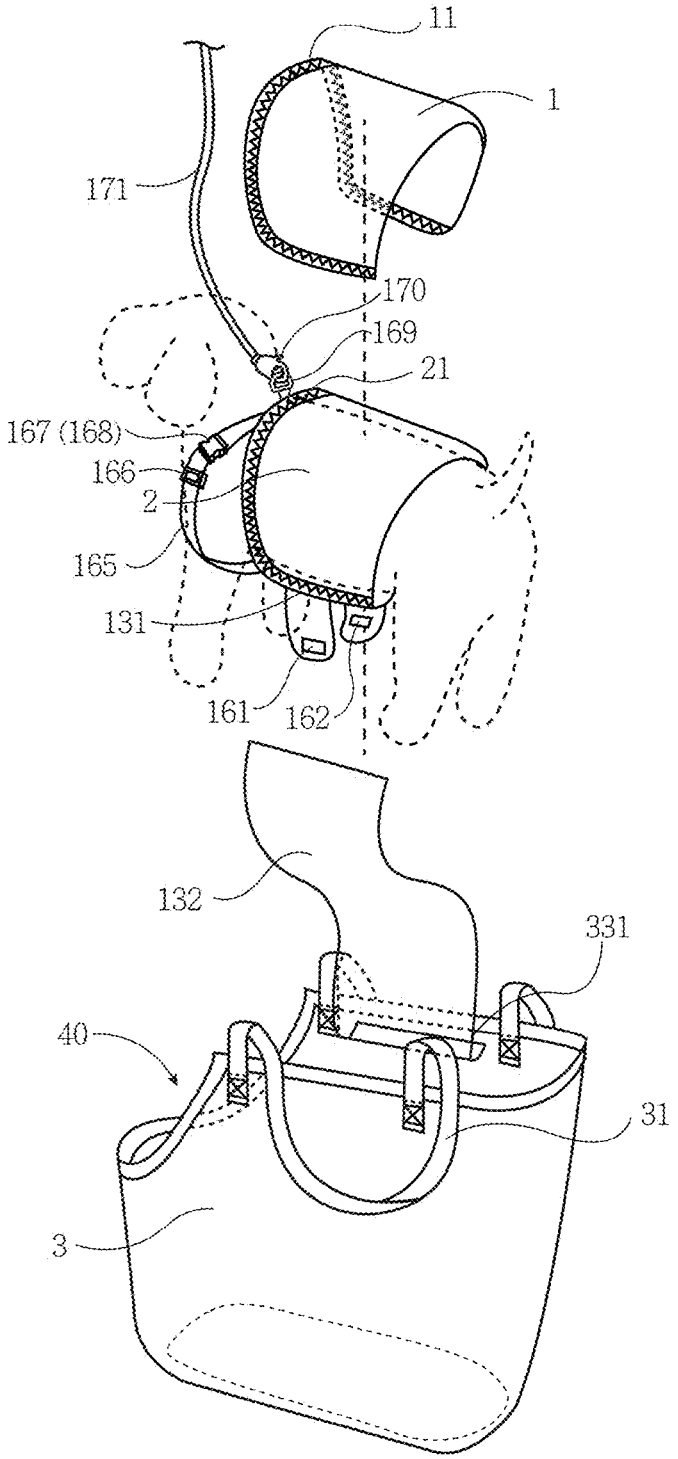
FIG. 6 Prior Art
FIG. 6 is a structural exploded view depicting an opened state of a pet carrier of the prior art.
Figure 7:
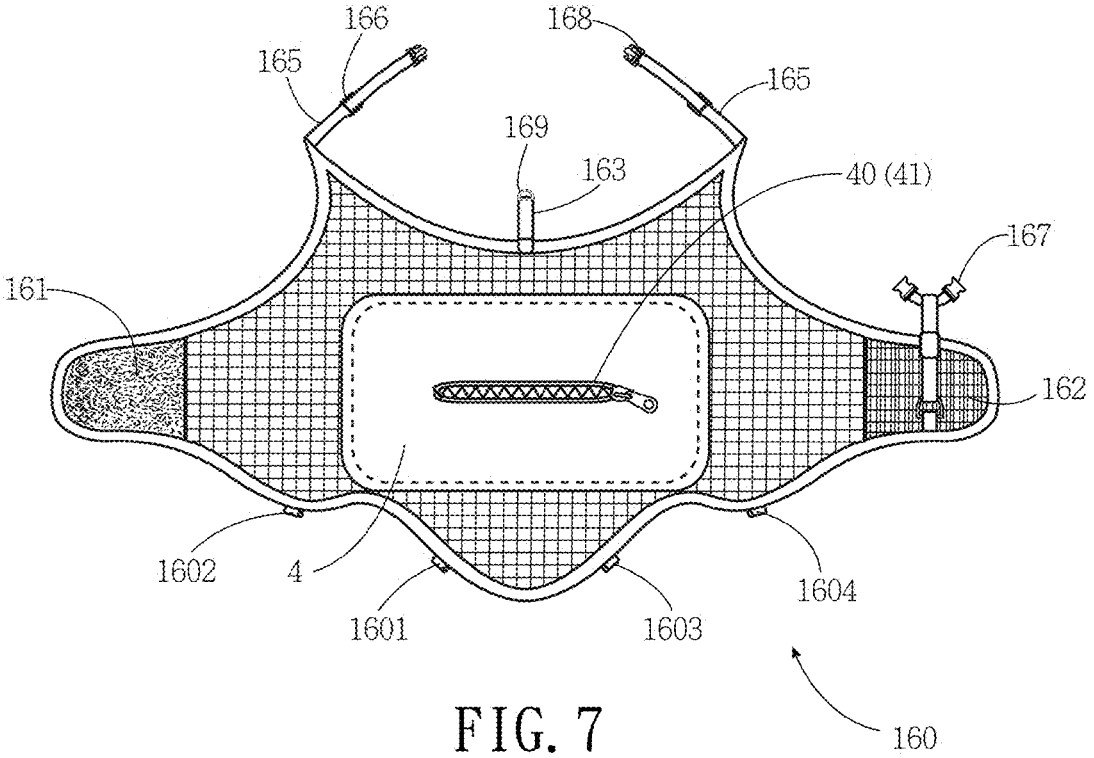
FIG. 7 is a structural schematic view of a first embodiment of the present invention.
Figure 8:
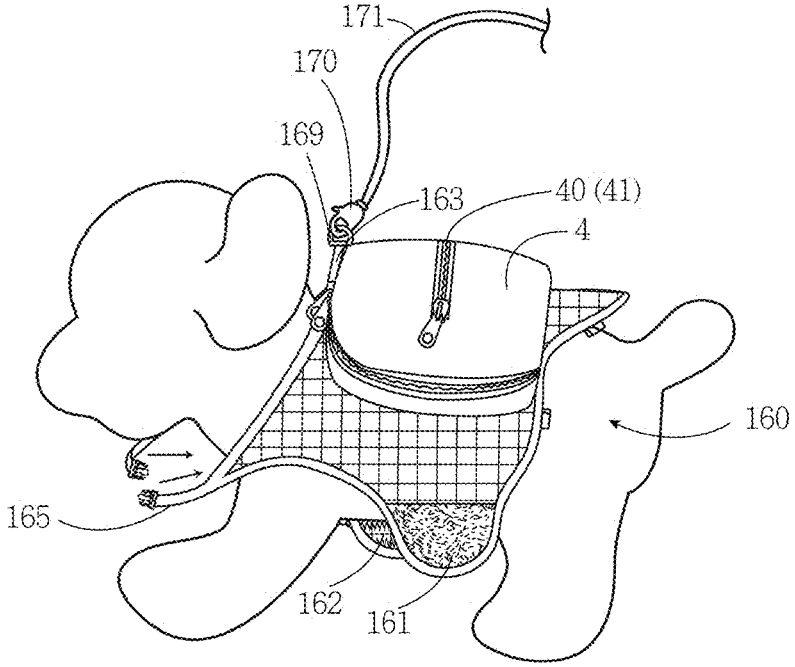
FIG. 8 is a structural schematic view depicting an operating state of the first embodiment of the present invention.

Referring to FIGS. 7 to 10, which show the first embodiment of a body-worn structure of the present invention applied in a covering for a pet to wear, wherein a covering 3*a* primarily comprises a front cover sheet 1, an edge of which is provided with a cover piece 11; a rear cover sheet 2, an edge of which is provided with a cover assembly 21 corresponding to the cover piece 11; a connecting portion 12 provided on the front cover sheet 1 (and can also be provided on the rear cover sheet 2), wherein the front cover sheet 1 and the rear cover sheet 2 are mutually joined using the connecting portion 12; a first joining edge 131 provided on the front cover sheet 1; a second joining edge 231 provided on the rear cover sheet 2; and a support enclosure 16 comprising a first fastening portion 161 and a first fastening assembly portion 162. Referring to FIG. 8, which shows the support enclosure 16 provided with a drawstring 163; the extremity of the drawstring 163 is provided with a fixing ring 169. The drawstring 163 further comprises a pull cord 171 and a hook ring 170 provided on the front end of the pull cord 171. When the covering 3*a* is in an unfolded state, the drawstring 163 is able to pass through a through hole 332, and the fixing ring 169 at the extremity of the drawstring 163 is mutually fastened with the hook ring 170 at the front end of the pull cord 171. In addition, the rear cover sheet 2 is provided with a holding portion 4 (if the rear cover sheet 2 is set up as the support enclosure 16, then the holding portion 4 can also be set up as the front cover sheet 1), which forms a small carrier bag 44, thereby facilitating the user to use the holding portion 4 to place pet paraphernalia, such as plastic bags and other related supplies for cleaning up pet droppings. The small carrier bag 44 is provided with a switching piece 40 and a switching assembly 41.

Figure 9:
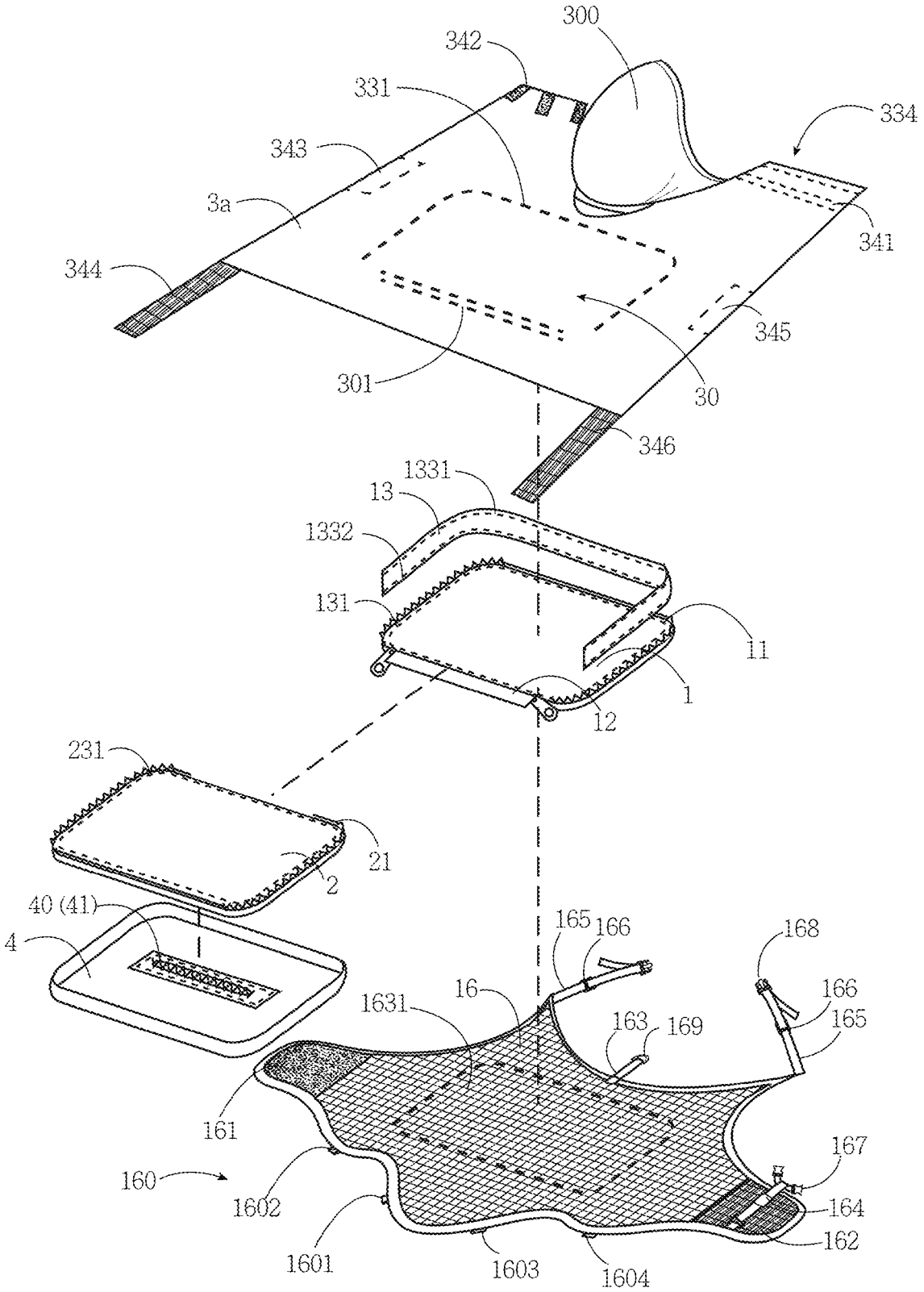
FIG. 9 and FIG. 10 are structural exploded views depicting an unfolded state of the first embodiment of the present invention.
Figure 10:
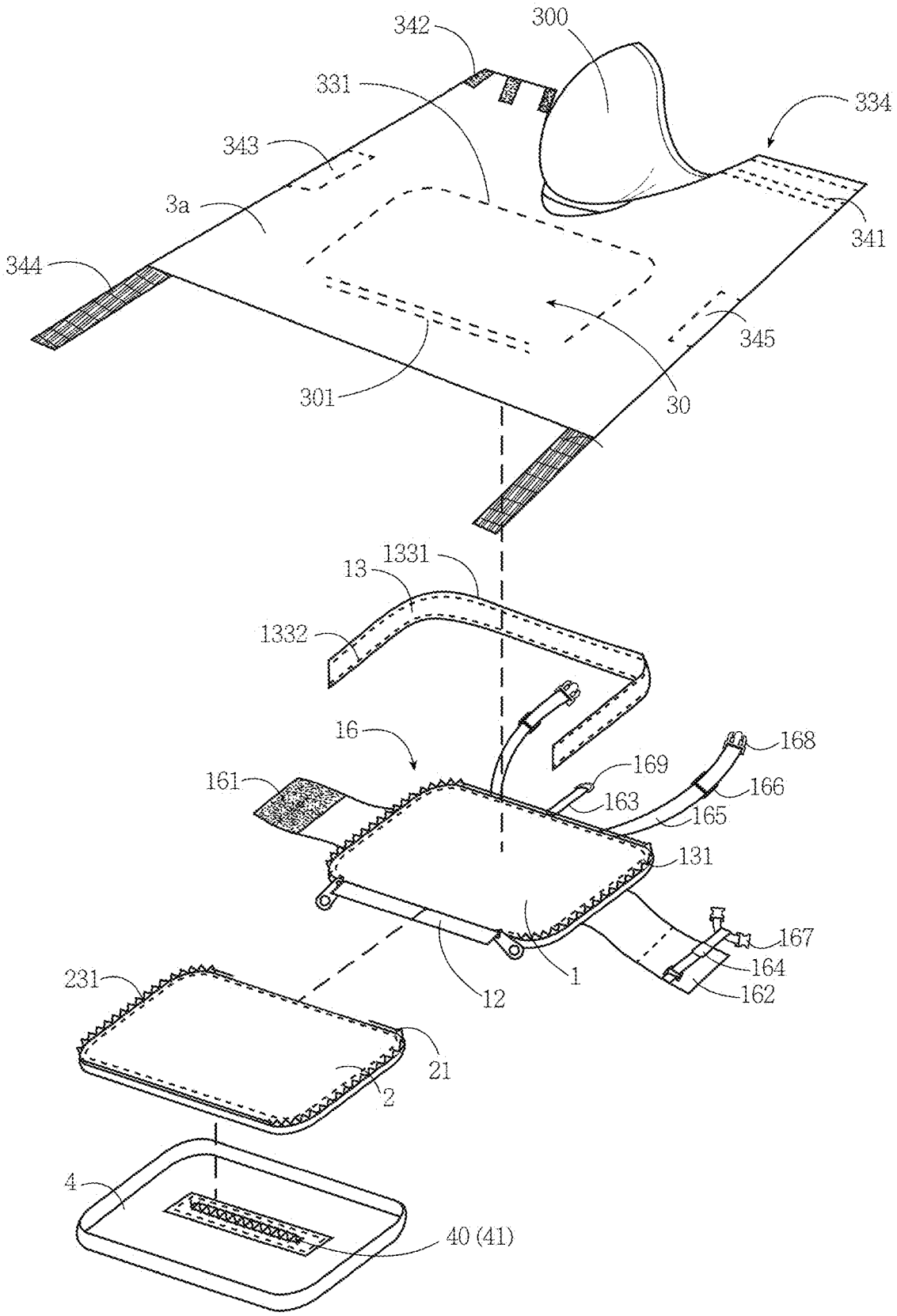
Figure 57:
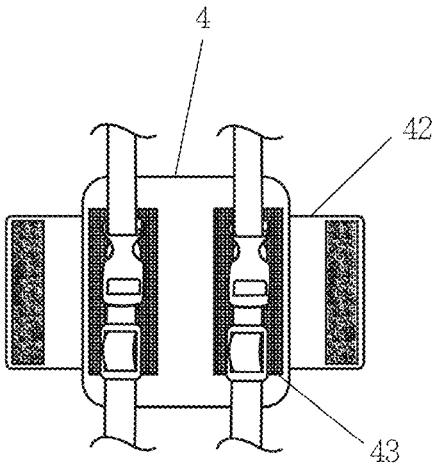
FIG. 57 is a bottom schematic view depicting the process of movable assembling the support enclosure and the holding portion according to the present invention.
Figure 58:
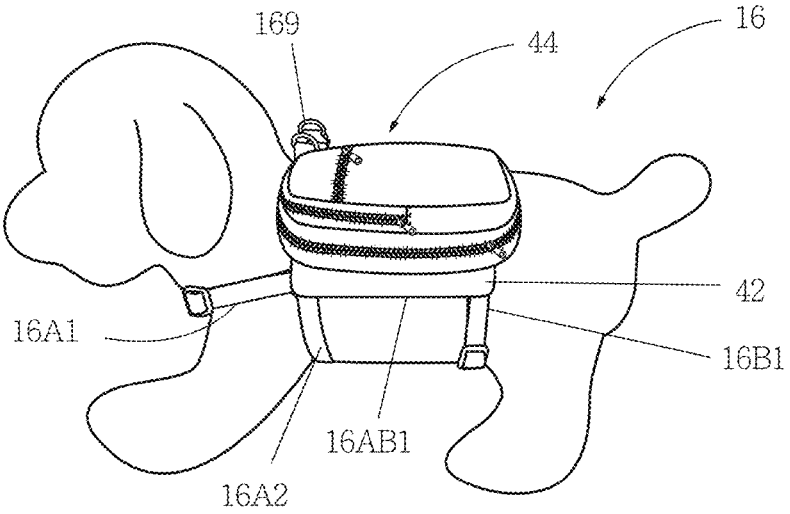
FIG. 58 is a bottom schematic view depicting completion of movable assembling the support enclosure and the holding portion according to the present invention.

Referring to FIG. 9, which shows the support enclosure 16 designed as a vest-formed covering body, wherein the first fastening portion 161 and the first fastening assembly portion 162 are provided on the left and right sides of the vest-formed covering body and formed as integral bodies thereof. Moreover, the vest-formed covering body is fabricated from mesh fabric, which enables achieving ventilation effectiveness when the weather is scorching hot. The vest-formed covering body of the support enclosure 16 comprises a support enclosure joining edge 1631, wherein the support enclosure joining edge 1631 and the first joining edge 131 are used to secure fixing to the front cover sheet 1 (the second joining edge 231 can also be used to secure fixing to the rear cover sheet 2). The support enclosure 16 is either undetachable or detachable to the front cover sheet 1, wherein, a detachable member (not shown in FIG. 9 but the same function with the fixing member 42 referring to FIG. 57) can be disposed on an upper side of the support enclosure 16 at around the area covered by the support enclosure joining edge 1631, while a corresponding detachable member (not shown in FIG. 9 but the same function with the corresponding fixing member 43 referring to FIG. 57) can be disposed on a bottom side of either the front cover sheet 1 or the rear cover sheet. The front left and right ends of the vest-formed covering body are respectively provided with an annular belt 165, which are used to fit around the chest of the pet; or as depicted in FIG. 10, the support enclosure 16 directly forms the front cover sheet 1, wherein the left and right sides of the front cover sheet 1 are respectively joined to the first fastening portion 161 and the first fastening assembly portion 162 (if the rear cover sheet 2 is set up as the support enclosure 16, then the first fastening portion 161 and the first fastening assembly portion 162 can also be provided on the rear cover sheet 2). The first fastening portion 161 and the first fastening assembly portion 162 are used to mutually secure fixing the front cover sheet 1 and the rear cover sheet 2 to secure fixing the covering body onto a pet. Furthermore, the front left and right sides of the front cover sheet 1 are respectively provided with the annular belt 165, which are used to fit around the chest of the pet (if the rear cover sheet 2 is set up as the support enclosure 16, then the annular belts 165 can also be provided on the rear cover sheet 2). The aforementioned annular belts 165 are provided with at least one first adjustment piece 166, and the first adjustment pieces 166 are used to adjust the length of the annular belts 165, accordingly, facilitating slipping the annular belt 165 onto pets with different body types.

Figure 11:
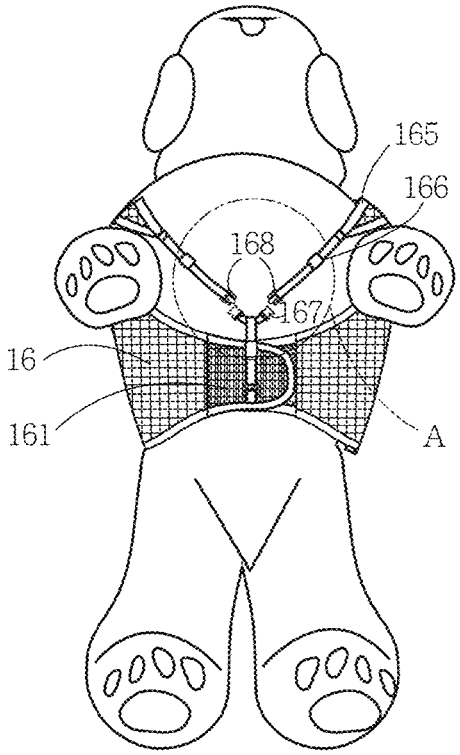
FIG. 11 to FIG. 13 are structural schematic views and a partial enlarged view depicting operating states of the first embodiment of the present invention.
Figure 12:
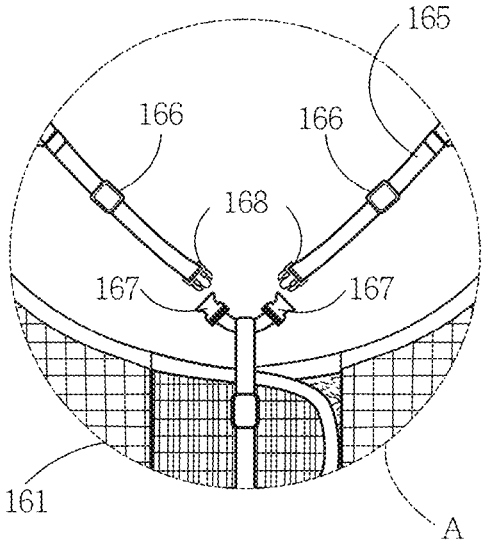
Figure 13:
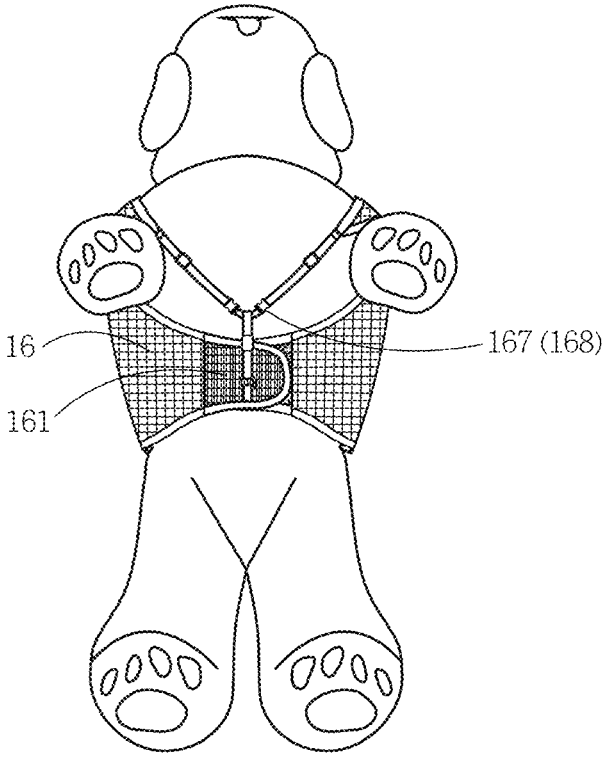

Referring together to FIGS. 11 to 13, either the aforementioned first fastening portion 161 or the first fastening assembly portion 162 is provided with at least one female buckle 167, which provide for a connection with male buckles 168 provided on the front ends of the annular belts 165. The connection between the female and male buckles 167, 168 is used to further disperse the strain of the drawstring 163 to the first fastening portion 161 and the first fastening assembly portion 162. Each of the female buckles 167 is a Y-shaped double-ended type buckle, and the Y-shaped double-ended type the female buckles 167 are used to connect with the male buckles 168 provided on the left and right ends of the annular belts 165 to form a Y-shaped buckle component structure after connecting thereof, and further disperses the strain of the drawstring 163 to the annular belts 165 and the first fastening portion 161 and the first fastening assembly portion 162. Furthermore, the female buckles 167 is provided with a second adjustment piece 164, and the second adjustment pieces 164 is used to adjust the tightness between the annular belts 165 and the first fastening portion 161 and the first fastening assembly portion 162, accordingly, facilitating comfortable slipping the annular belt 165 onto a pet. The aforementioned male buckles 168 can also be combined with the tightness adjustment function of the first adjustment pieces 166 of the annular belts 165, such as: combined with tri-glide cross buckles, thereby forming female buckles provided with an adjustment function; the female buckle 167 can alternatively be replaced by male buckle 168 and vise versa.

Referring to FIGS. 9 and 10, the aforementioned structure comprises the flexible enclosure 3, and the flexible enclosure 3 is the covering 3*a* that assumes a sheet form, which can be used to cover a pet's body to protect the pet from the wind and rain. The covering 3*a* comprises a third joining edge 331, and the first joining edge 131 (if the rear cover sheet 2 is set up as the support enclosure 16, then the second joining edge 231 can also be used) is used to join to a third joining edge 331 and securely fix the front cover sheet 1 (if the rear cover sheet 2 is set up as the support enclosure 16, then the rear cover sheet 2 can also be used) to the covering 3*a*. A retaining space formed between the front cover sheet 1 and the rear cover sheet 2 is used to retain the folded up covering 3*a*, and the cover piece 11 and the cover assembly 21 are further used to close up the front cover sheet 1 and the rear cover sheet 2.

Figure 14:
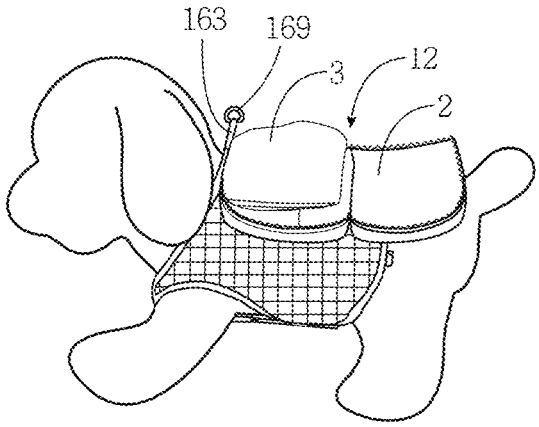
FIG. 14 to FIG. 18 are structural schematic views and a partial enlarged view depicting operating states and unfolded states of the first embodiment of the present invention.
Figure 15:
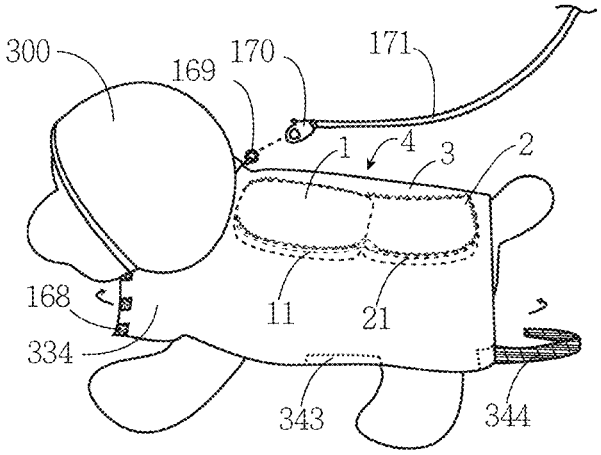

Referring together to FIGS. 14 and 15, when the front cover sheet 1 and the rear cover sheet 2 are in a closed state, the connecting portion 12 is horizontally positioned between the rear cover sheet 2 and the front cover sheet 1, and when the front cover sheet 1 and the rear cover sheet 2 are in an open state, the rear cover sheet 2 and the front cover sheet 1, after being horizontally connected through the connecting portion 12, are aligned on the back of a pet. In addition, the guiding principle applied is that the unfolded length after opening up does not exceed the entire body length of the pet. The covering 3*a* is fabricated from material provided with a waterproof function, and when in an unfolded state, the entire covering area of the covering 3*a* is greater than or equal to the total area of the front cover sheet 1 and the rear cover sheet 2 when in an open state (as shown in FIG. 15), thereby enabling the covering 3*a* to entirely cover the front cover sheet 1 and the rear cover sheet 2 combined with the upper portion of the small carrier bag 44 formed by the holding portion 4, accordingly, achieving the effectiveness to protect against rain. The front portion of the covering 3*a* is provided with a head cover 300 corresponding to a pet's head position, and can be used to prevent the pet's head from getting soaked by rain.

Figure 16:
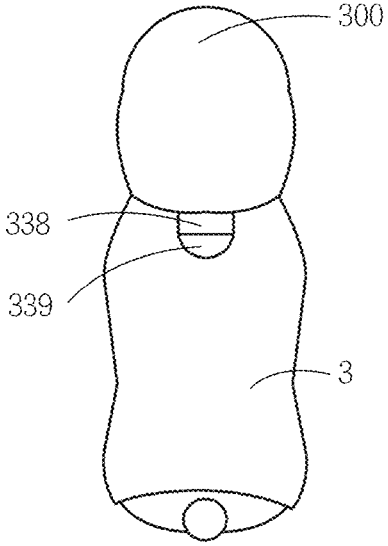
Figure 17:
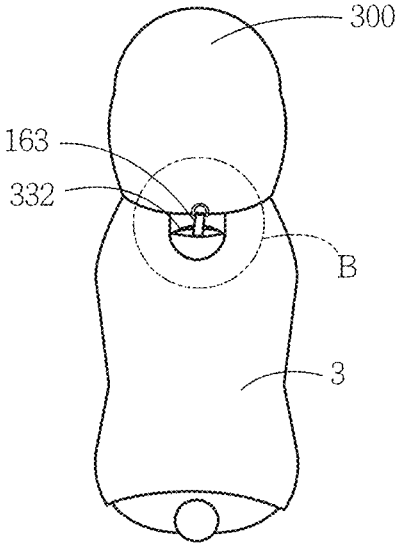
Figure 18:
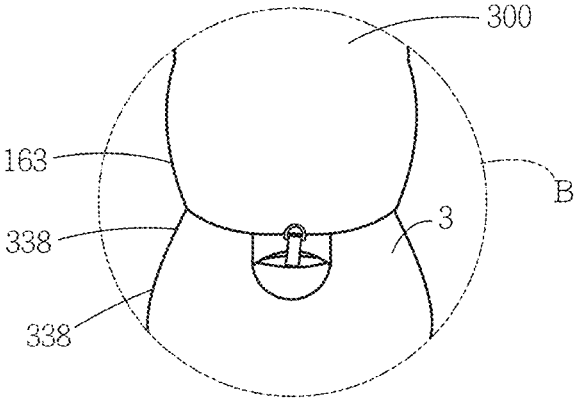

Referring to FIGS. 16 to 18, the front portion of the covering 3*a* is provided with a through hole 332 corresponding to the position of the drawstring 163, and the through hole 332 is provided with a first waterproof piece 338 and a second waterproof piece 339. The first waterproof piece 338 effects a structure on the upper portion of the second waterproof piece 339 that overlaps and covers a partial area of the through hole 332 to form a variable opening, which is used to prevent rain water from seeping into the through hole 332. When its raining, and the covering 3*a* is in an unfolded state, the user is able to pass the drawstring 163 through the through hole 332, and the fixing ring 169 at the extremity of the drawstring 163 is used to fasten to the hook ring 170 at the front end of the pull cord 171, thereby achieving the objective allowing the user to still able to walk their pet on the ground using the pull cord 171 on a rainy day (see FIG. 15).

Apart from the diagrams depicted in FIGS. 14 and 15, which show the mode whereby the user can take charge of their pet with the covering 3*a* in an unfolded state, wherein the covering 3*a* entirely covers the aligned front cover sheet 1 and the rear cover sheet 2 as well as the upper portion of the small carrier bag 44 formed by the holding portion 4; moreover, the user can also choose to dispose the rear cover sheet 2 combined with the small carrier bag 44 formed by the holding portion 4 into a containing space 30 formed between the front cover sheet 1 and the covering 3*a*.

Figure 22:
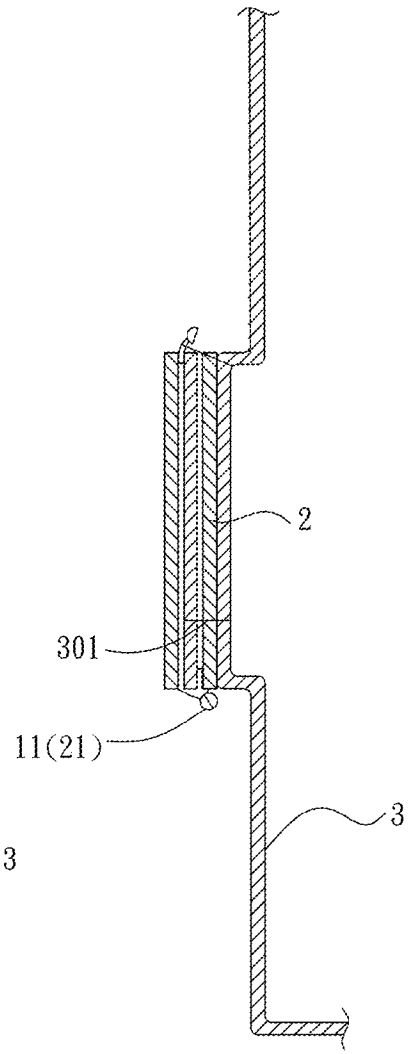
FIG. 19 to FIG. 22 are cross-section structural schematic views depicting stored away, unfolding and open, and closed states of the first embodiment of the present invention.
Figure 21:
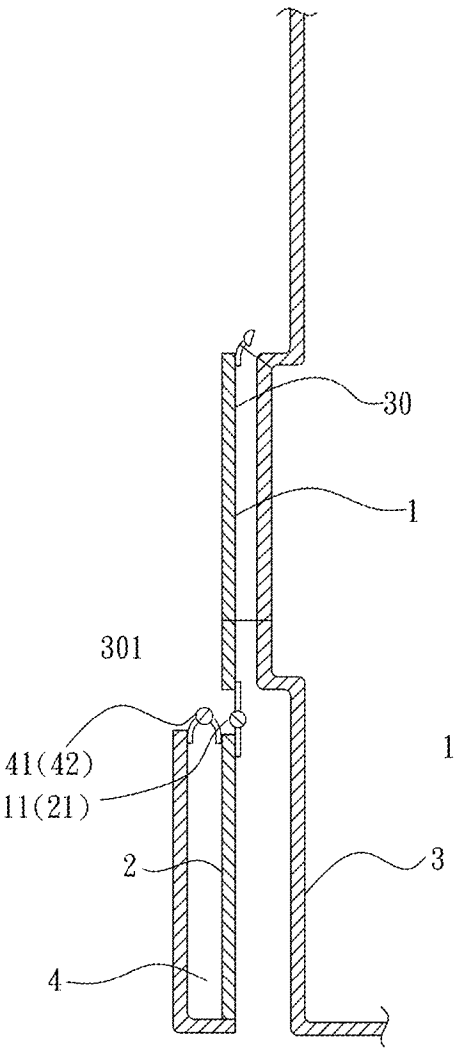
Figure 20:
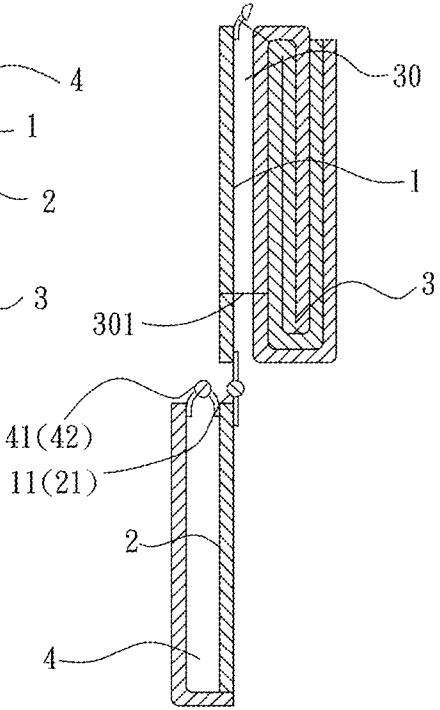
Figure 19:
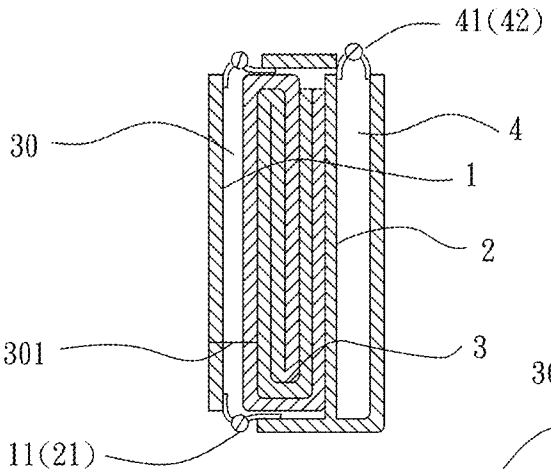
Figure 23:
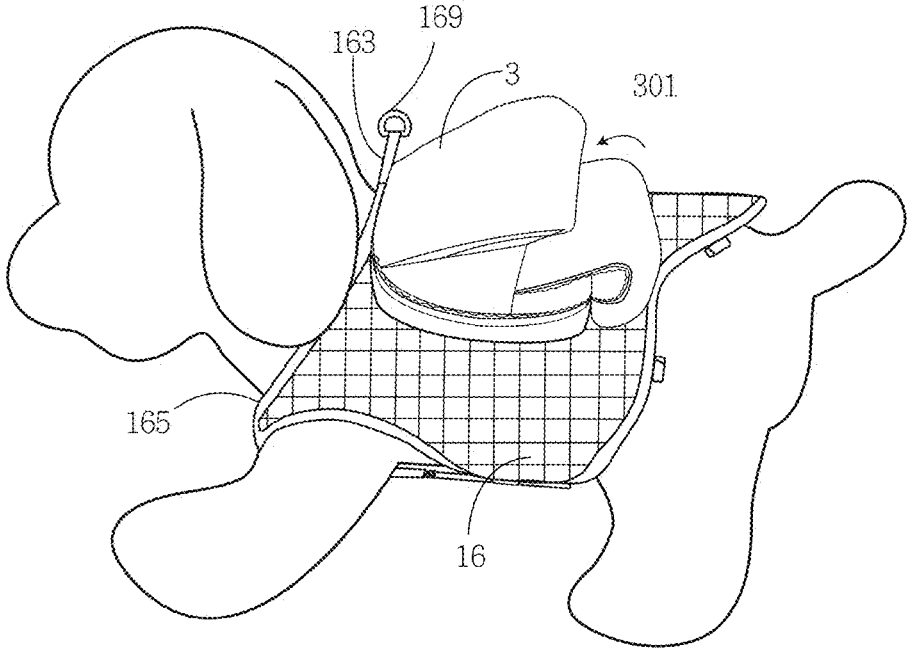
FIG. 23 to FIG. 28 are structural and partial cross-section schematic views depicting unfolding and operating states of the first embodiment of the present invention.
Figure 24:
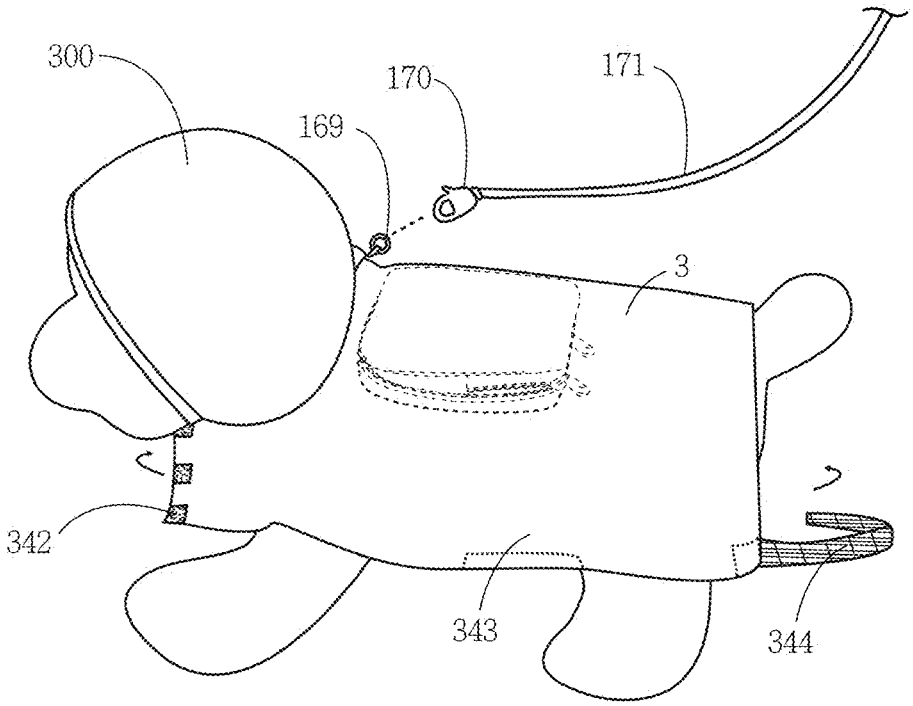
Figure 25:
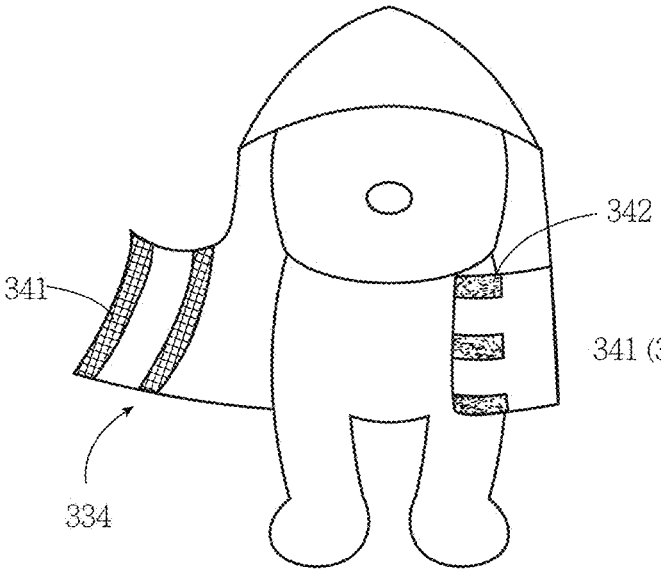
Figure 26:
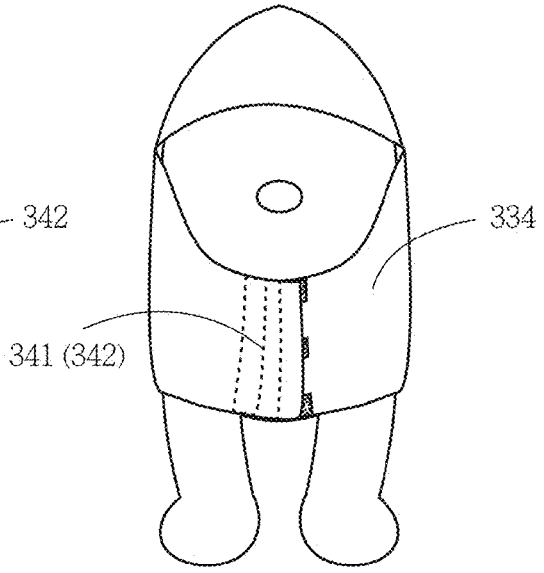
Figure 27:
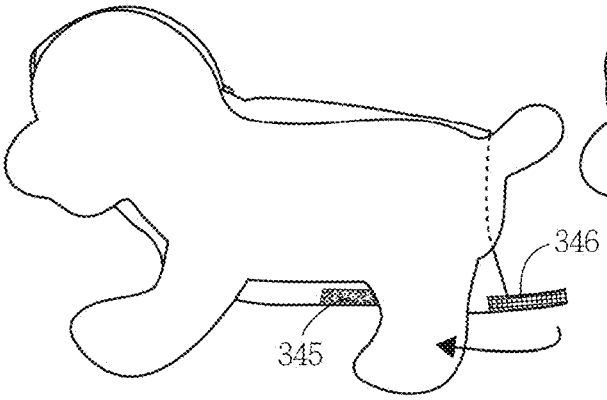
Figure 28:
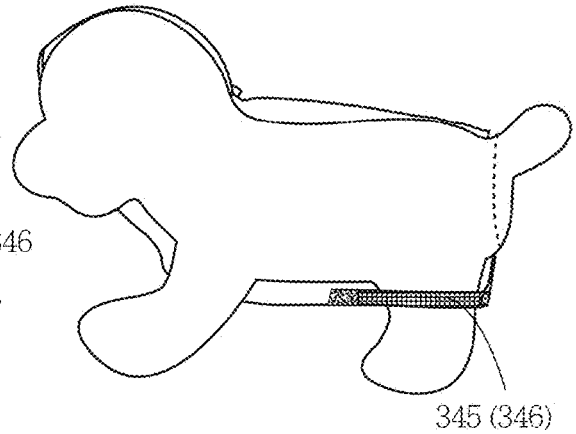
Figure 29:
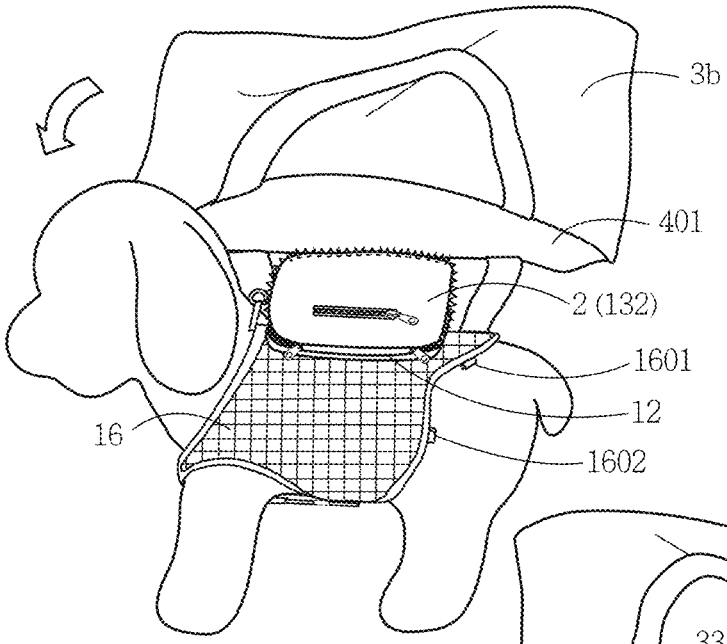
FIG. 29 to FIG. 31 are structural schematic views depicting unfolding and operating states of a second embodiment of the present invention.
Figure 30:
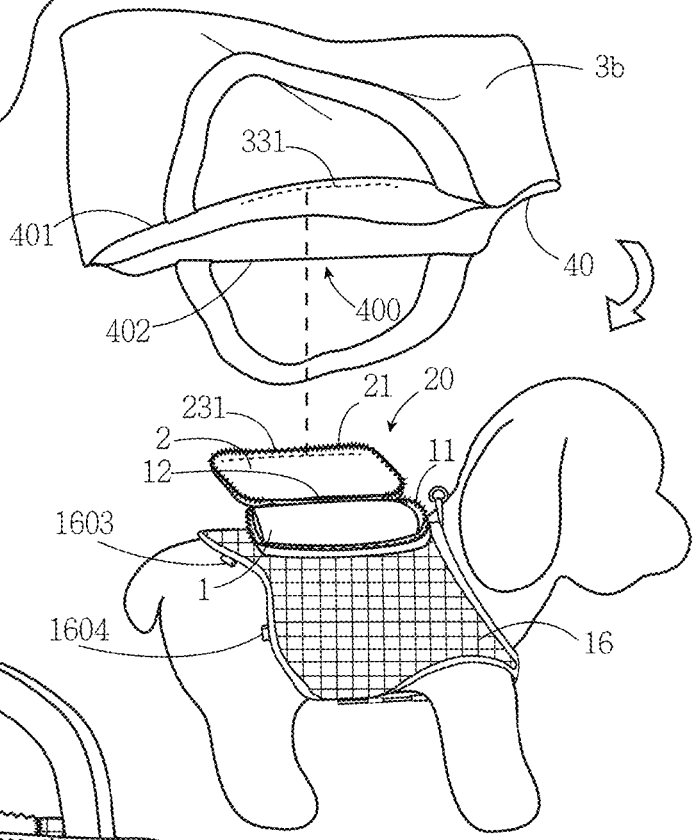

Referring together to FIGS. 9 and 10 and FIGS. 19 to 24, wherein FIG. 19 depicts the rear cover sheet 2 and the flexible enclosure 3 both in a contained state; FIG. 20 depicts that the rear cover sheet 2 in an opened state and the flexible enclosure 3 in a contained state; FIG. 21 depicts the rear cover sheet 2 and the flexible enclosure 3 both in opened states; FIG. 22 depicts the rear cover sheet 2 in a closed state and the flexible enclosure 3 in an unfolded state. As shown in the diagrams, the third joining edge 331 and the first joining edge 131 adopt a partial joining way, and the unconnected area forms a containing port 301. When the flexible enclosure 3 is in an unfolded state, the containing port 301 is used to dispose the rear cover sheet 2 within the containing space 30 between the front cover sheet 1 and the flexible enclosure 3. On the other hand, when it is desired to contain the folded flexible enclosure 3 inside the containing space 30, the user can take out the rear cover sheet 2 from the containing space 30 through the containing port 301, and close up the rear cover sheet 1 and the front cover sheet 2 using the cover piece 11 and the cover assembly 21. In addition, the front cover sheet 1 is further provided with a side surround 13. The side surround 13 comprises a fourth joining edge 1331 corresponding to the third joining edge 331, and a fifth joining edge 1332 corresponding to the first joining edge 131. The side surround 13 uses the fourth joining edge 1331 to join to the third joining edge 331 of the flexible enclosure 3, and joins the fifth joining edge 1332 to the first joining edge 131 of the front cover sheet 1 (if the rear cover sheet 2 is set up as the support enclosure 16, then it can also be joined to the rear cover sheet 2), thereby enlarging the capacity within the containing space 30, accordingly, achieving the effectiveness of easily containing the rear cover sheet 2 and the small carrier bag 44.

Referring together to FIGS. 9 and 10 and FIGS. 24 to 28, the covering 3*a* comprises a forepart 334, wherein one side of the forepart 334 is provided with a second fastening portion 341, and another side is provided with a second fastening assembly portion 342 corresponding to the second fastening portion 341. The second fastening portion 341 and the second fastening assembly portion 342 are mutually joined, which enables covering and securely fixing the covering 3*a* to the chest position of a pet. The left side and the left rear angled end of the covering 3*a* are respectively provided with a third fastening portion 343 and a third fastening assembly portion 344, while the right side and the right rear angled end are respectively provided with a fourth fastening portion 345 and a fourth fastening assembly portion 346. The mutual joining between the third fastening portion 343 and the third fastening assembly portion 344 and the mutual joining between the fourth fastening portion 345 and the third fastening assembly portion 346 are used to enable the covering 3*a* to respectively cover and be securely fixed on the hind legs portions of a pet.

Referring to FIGS. 29 to 32, which show a second embodiment of the present invention, wherein the cover-type containing structure for flexible enclosures is applied to a pet carrier bag 3*b* for carrying a pet. The second embodiment is basically identical to the structure of the aforementioned first embodiment, the only difference being in the flexible enclosure 3 of the second embodiment is the pet carrier bag 3*b*. The pet carrier bag 3*b* is provided with an opening 400, and the opening 400 is used to place a pet within the pet carrier bag 3*b*. The pet carrier bag 3*b* comprises the third joining edge 331, and the second joining edge 231 is used to join to the third joining edge 331, thereby connectively securing the pet carrier bag 3*b* and the rear cover sheet 2. A retaining space 20 formed between the front cover sheet 1 and the rear cover sheet 2 enables retaining the folded pet carrier bag 3*b*, with the cover piece 11 and the cover assembly 21 being further used to close up the front cover sheet 1 and the rear cover sheet 2.

Figure 31:
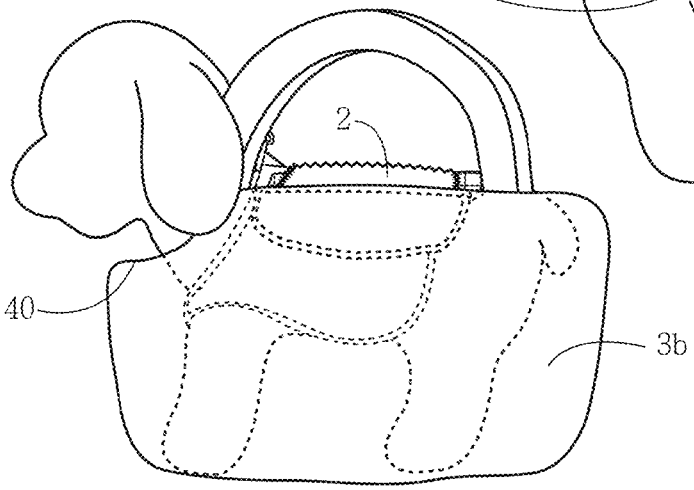
Figure 32:
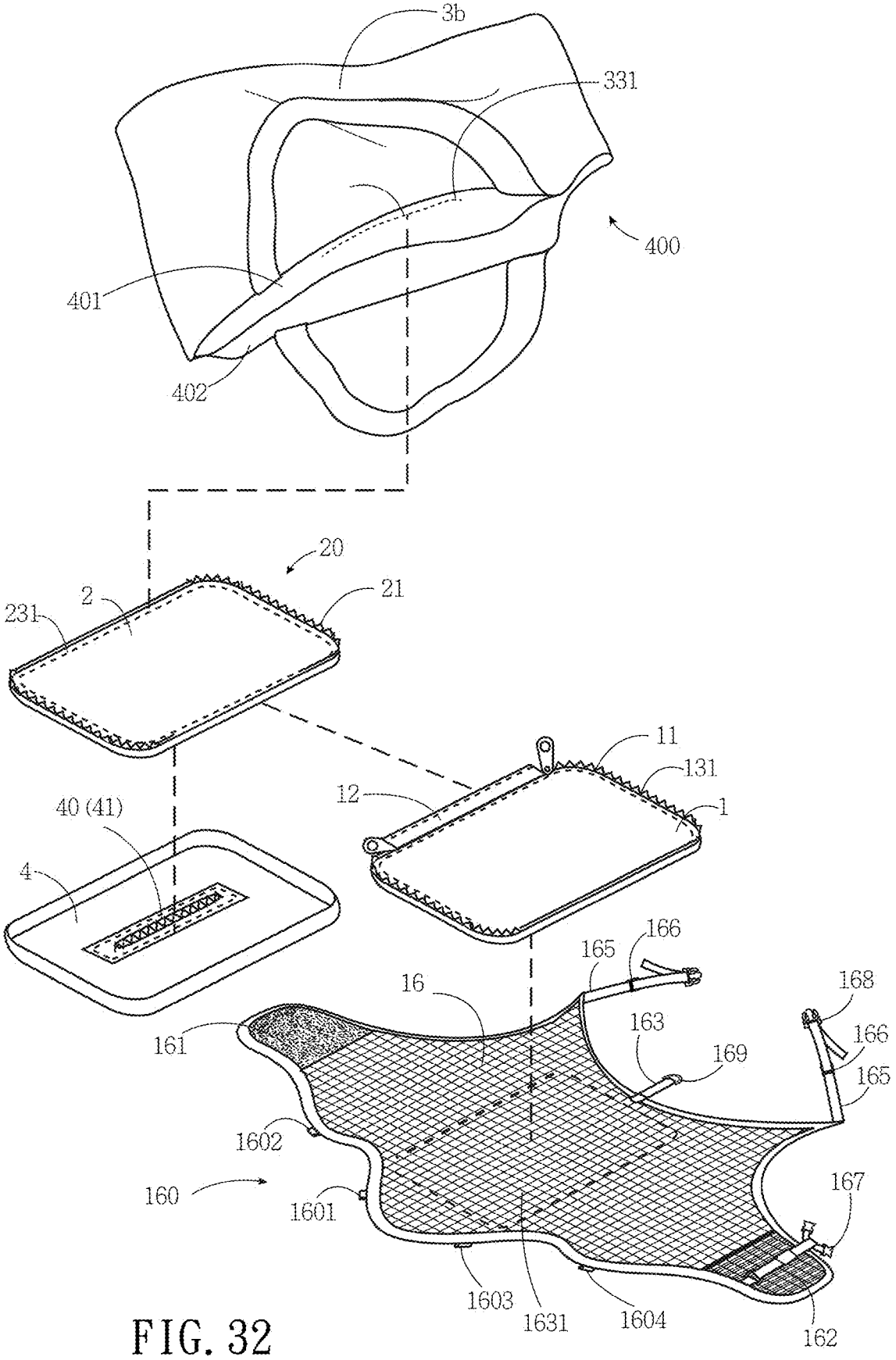
FIG. 32 is a structural exploded view depicting an unfolded state of the second embodiment of the present invention.

When the front cover sheet 1 and the rear cover sheet 2 are in a closed state, the connecting portion 12 is horizontally positioned between the rear cover sheet 2 and the front cover sheet 1, and when the front cover sheet 1 and the rear cover sheet 2 are in an open state, the front cover sheet 1 is positioned on the upper portion of a pet's back. Longitudinal connection of the connecting portion 12 is used to enable the rear cover sheet 2 to function as an extension portion 132 that hangs on one side of the pet's body. The extension function of the extension portion 132 of the rear cover sheet 2 is used to further connect the front cover sheet 1 to the pet carrier bag 3*b*, wherein the rear cover sheet 2 is joined to the third joining edge 331 of the pet carrier bag 3*b* through the second joining edge 231. The third joining edge 331 is provided on a side edge 401 of the bag opening 400 of the pet carrier bag 3*b*, and another side edge opposite the side edge 401 is a free side edge 402. When in use, the free side edge 402 is used to manipulate opening and extending of the bag opening 400 downwards to the pet's legs, to facilitate placing the pet within the pet carrier bag 3*b* through the bag opening 400 in an upward direction. In addition, the bag opening 400 of the pet carrier bag 3*b* corresponding to one end of the pet's head is provided with a curve bend 40 (as shown in FIG. 31) to facilitate enabling the pet's head to protrude out from the bag opening 400.

Referring to FIGS. 33 to 36, which show a third embodiment of the present invention, wherein the cover-type containing structure for flexible enclosures is concurrently applied to the covering 3*a* for a pet to wear and the pet carrier bag 3*b* for carrying a pet. The third embodiment is basically identical to the structures of the aforementioned first and second embodiments, wherein apart from the rear cover sheet 2 serving as an extension portion, the third embodiment of the present invention is also used to join the pet carrier bag 3*b* to form the function described for the second embodiment. Furthermore, the front cover sheet 1 is joined to the covering 3*a* to form the function described for the first embodiment, accordingly, the third embodiment is concurrently provided with the two functions. In addition, the rear cover sheet 2 of the third embodiment is provided with a first fixing member 28 and a first fixing assembly member 29. The first fixing member 28 and the first fixing assembly member 29 are used to securely fix the pet carrier bag 3*b* after folding thereof. The front cover sheet 1 is provided with a second fixing member 18 and a second fixing assembly member 19, which are used to securely fix the covering 3*a* after folding thereof.

As shown in the diagrams, the containing port 301 of the third embodiment is longitudinally provided on the side of the pet's body. When the covering 3*a* is in an unfolded state, because the rear cover sheet 2 uses the first fixing member 28 and the first fixing assembly member 29 to completely retain the pet carrier bag 3*b* and hang on one side of the pet's body (see FIG. 35), hence, when the pet is running, because the pet carrier bag 3*b* hangs on one side of the pet's body, it's possible an unbalanced state in the center of gravity occurs resulting in the support enclosure 161 becoming askewed because of a single side bearing the load, therefore, at this time, the user can use the containing port 301 to dispose the rear cover sheet 2 within the retaining space 20 between the front cover sheet 1 and the covering 3*a* (see FIG. 36). Accordingly, the rear cover sheet 2 together with the retained covering 3*a* are disposed on the lower portion of the front cover sheet 1 using an overlapping method. When the pet carrier bag 3*b* and the covering 3*a* are concurrently in unfolded states, the entire structure, after complete retaining thereof, is longitudinally positioned on the upper portion of the pet's body, that is, positioned on the upper side of the support enclosure 16 worn by the pet.

Figure 37:
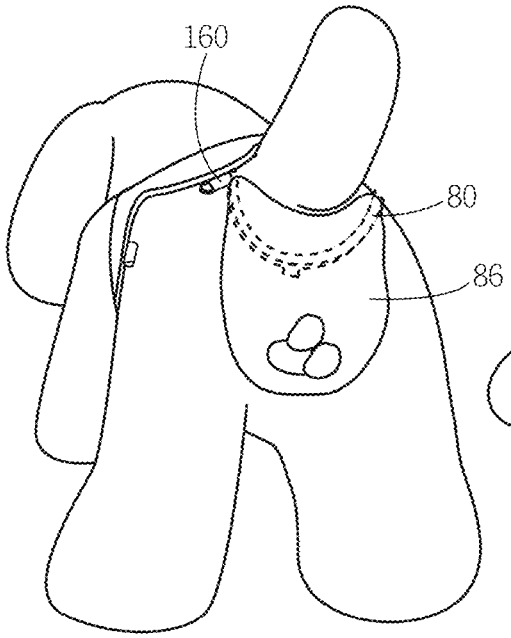
FIG. 37 to FIG. 39 are structural schematic views and a partial enlarged view of a fourth embodiment of the present invention.
Figure 38:
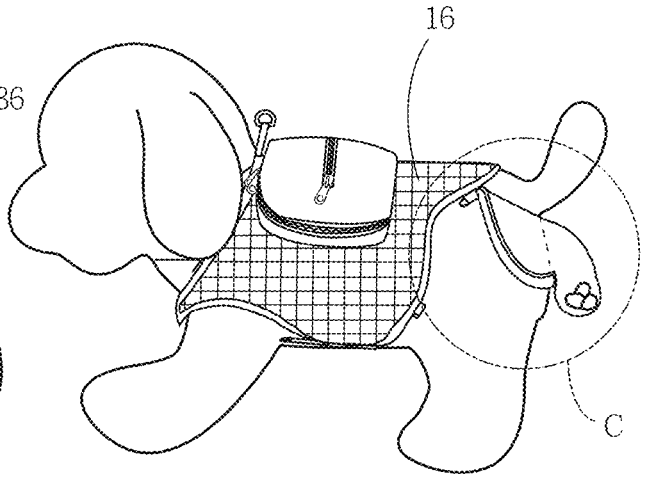
Figure 39:
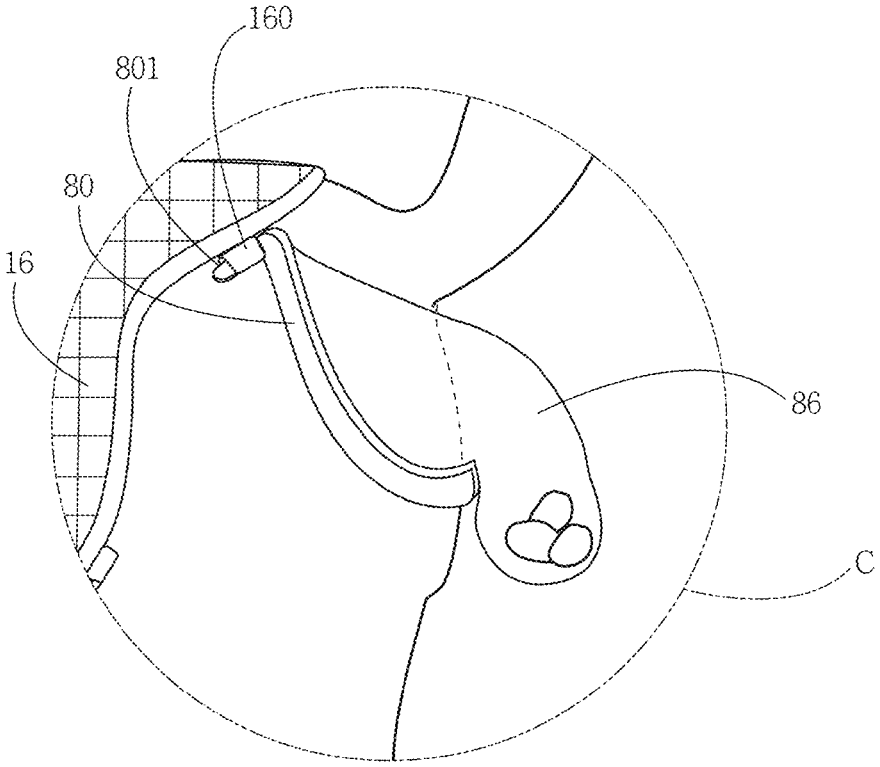
Figure 40:
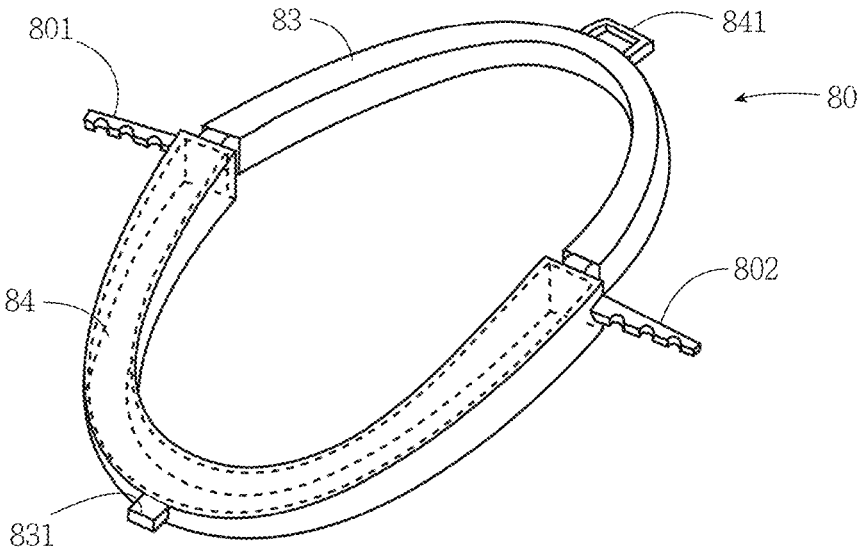
FIG. 40 to FIG. 42 are structural schematic views depicting operating states of the fourth embodiment of the present invention.
Figure 41:
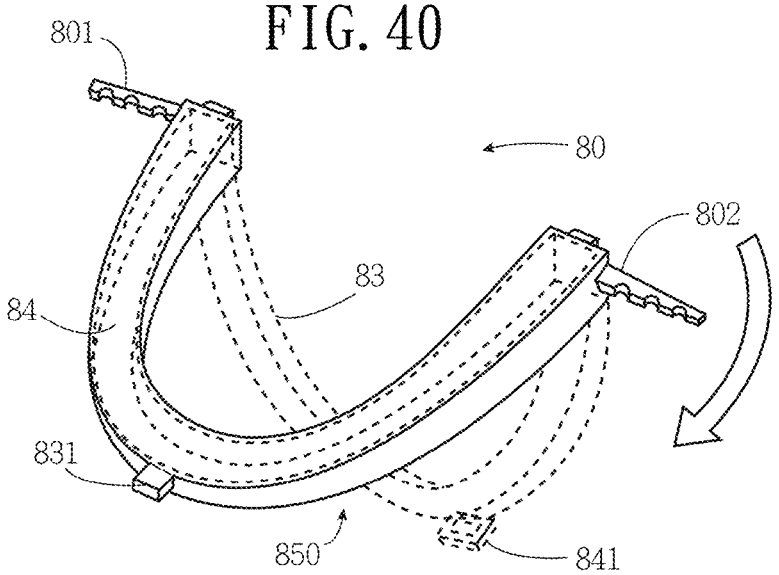
Figure 42:
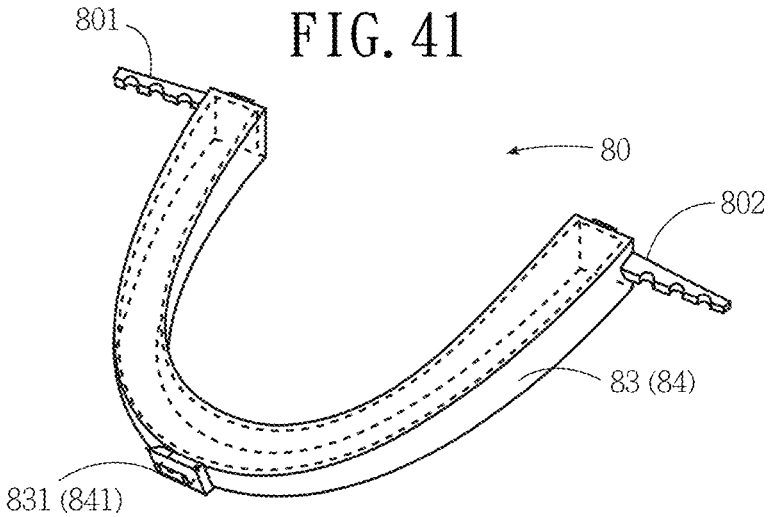
Figure 43:
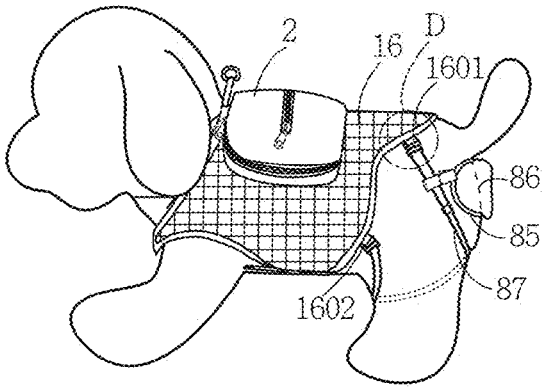
FIG. 43 to FIG. 45 are structural schematic views and a partial enlarged view depicting operating states of a fifth embodiment of the present invention.
Figure 44:
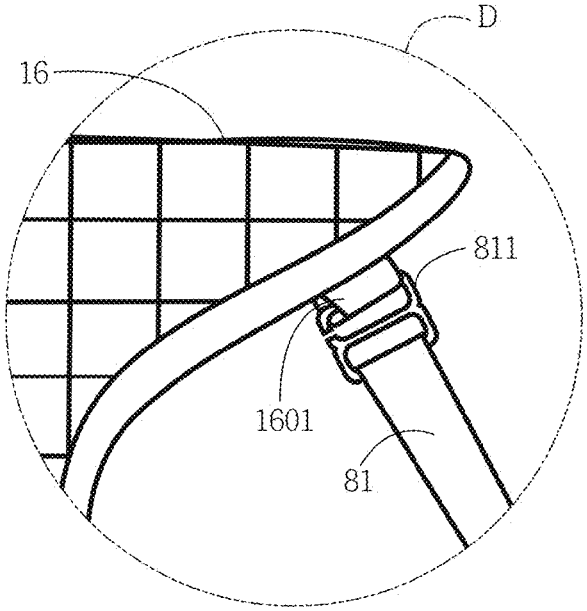
Figure 45:
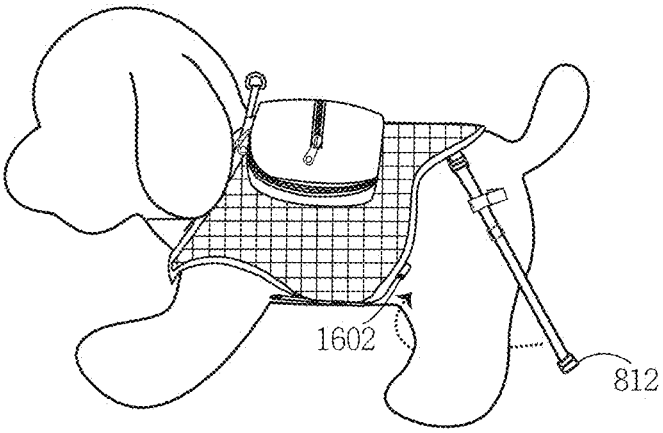

Referring to FIGS. 37 to 42, which show a fourth embodiment of the present invention, wherein the aforementioned structures are applied in the support enclosure 16 worn on the pet's body, and further applied in a fixing device 80 for a pet droppings collection bag 86, wherein the rear side of the support enclosure 16 is provided with a plurality of rings 160. The plurality of rings 160 are fitted with the external connection fixing device 80, and the fixing device 80 is used to securely fix the pet droppings collection bag 86. The fixing device 80 is provided with left and right hook members 801, 802 able to securely hook onto the plurality of rings 160. The surfaces of the left and right hook members 801, 802 are provided with a plurality of indentations or at least one indentation to reinforce the secure hooking effectiveness. The left and right hook members 801, 802 are used to penetrate inside the plurality of rings 160, enabling secure positioning of the pet droppings collection bag 86 at the position of a pet's anus. The fixing device 80 is a ring member provided with corresponding male and female clasp grooves 83, 84. The bend structure on the two ends of the male and female clasp grooves 83, 84 are used to achieve an open/close function; moreover, the male and female clasp grooves 83, 84 comprise a male fastener 831 and a female fastener 841, respectively. When in use, the opening of the pet droppings collection bag 86 is correspondingly positioned at a clip opening 850 formed before closing the male and female clasp grooves 83, 84 (as shown in FIG. 41), whereupon the clip opening 850 and the closing action of the male and female fasteners 831, 841 are used to securely fix the pet droppings collection bag 86 (as shown in FIGS. 37 to 39).

Figure 33:
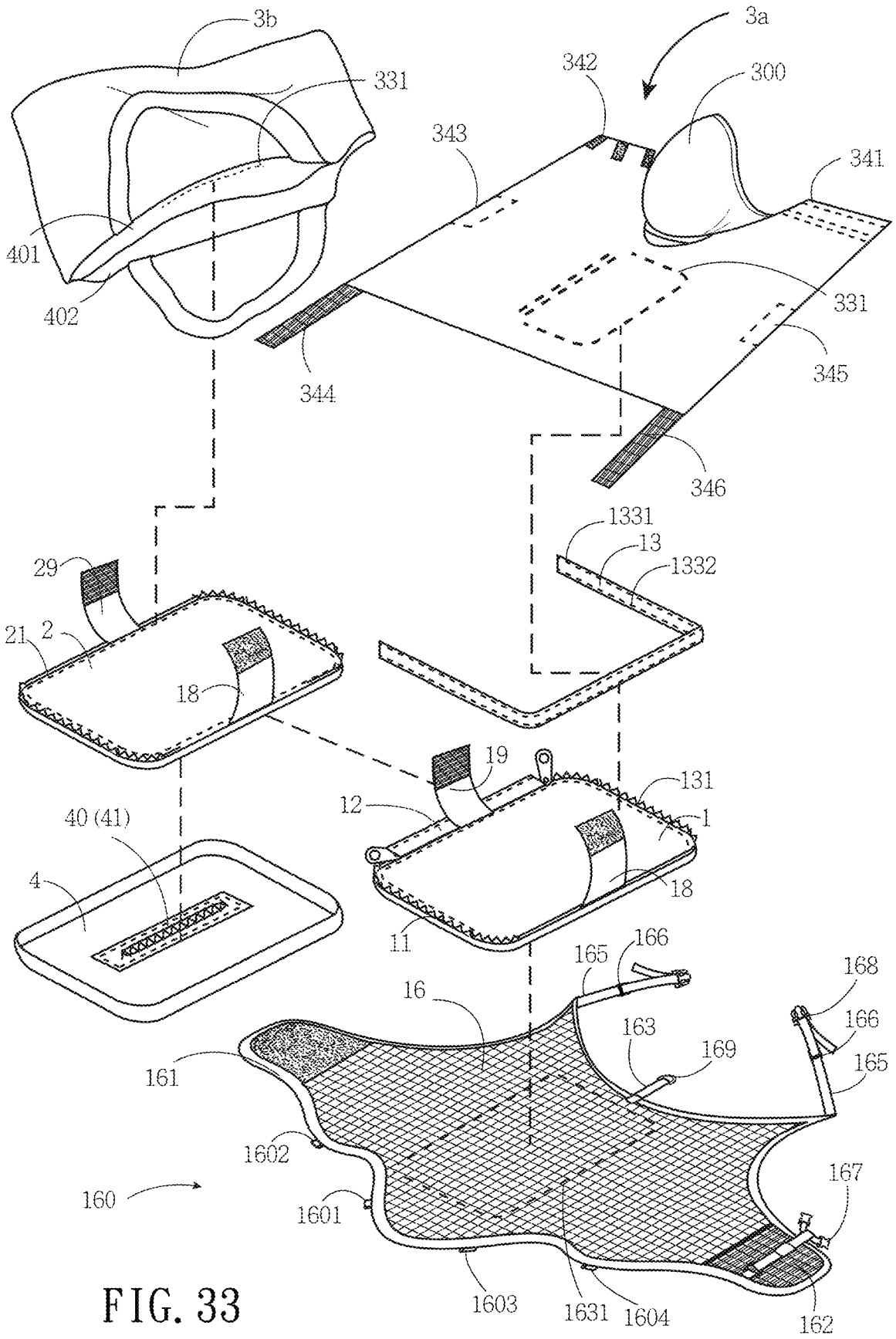
FIG. 33 to FIG. 34 are structural exploded views depicting partial and completely unfolded states of a third embodiment of the present invention.
Figure 34:
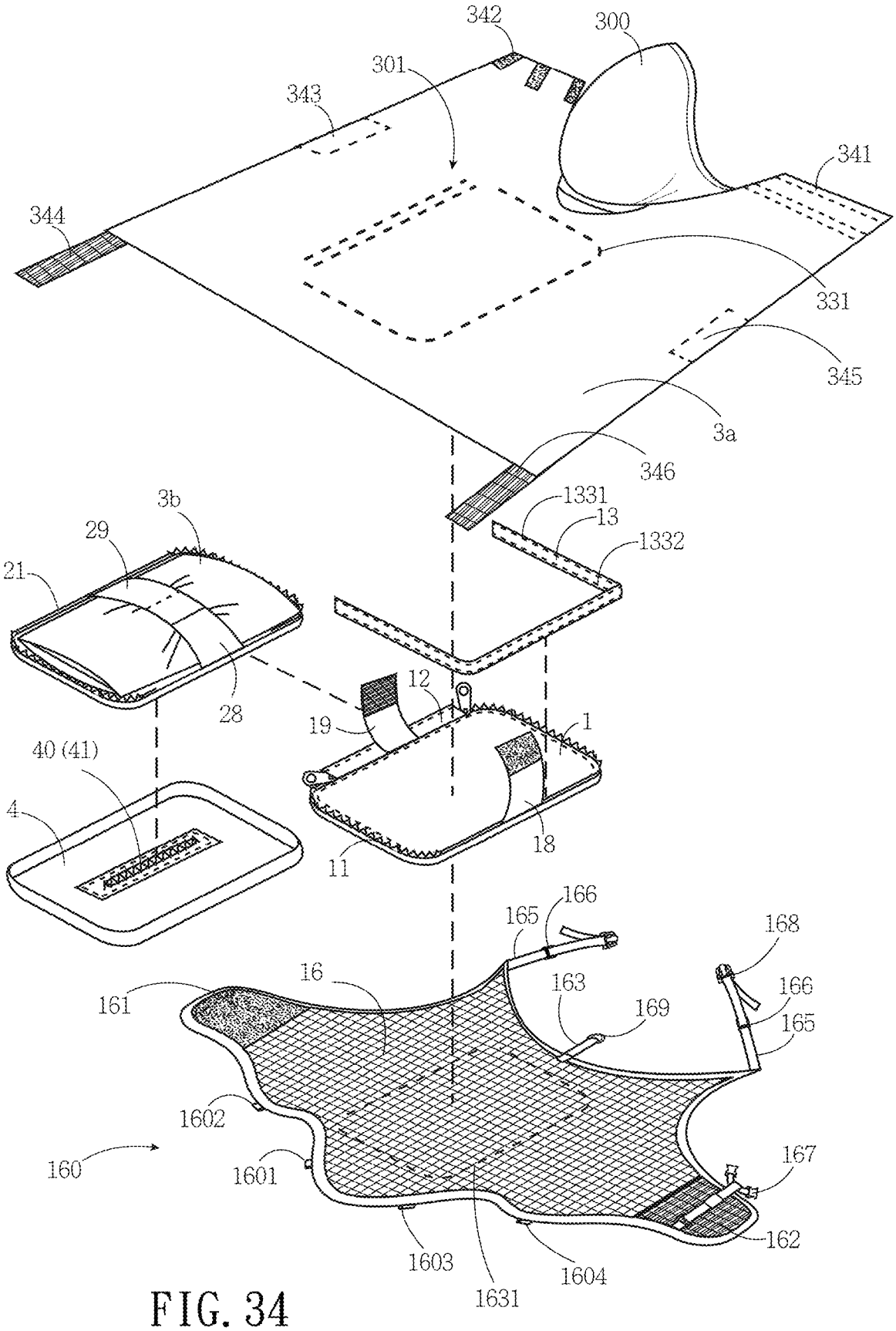
Figure 35:
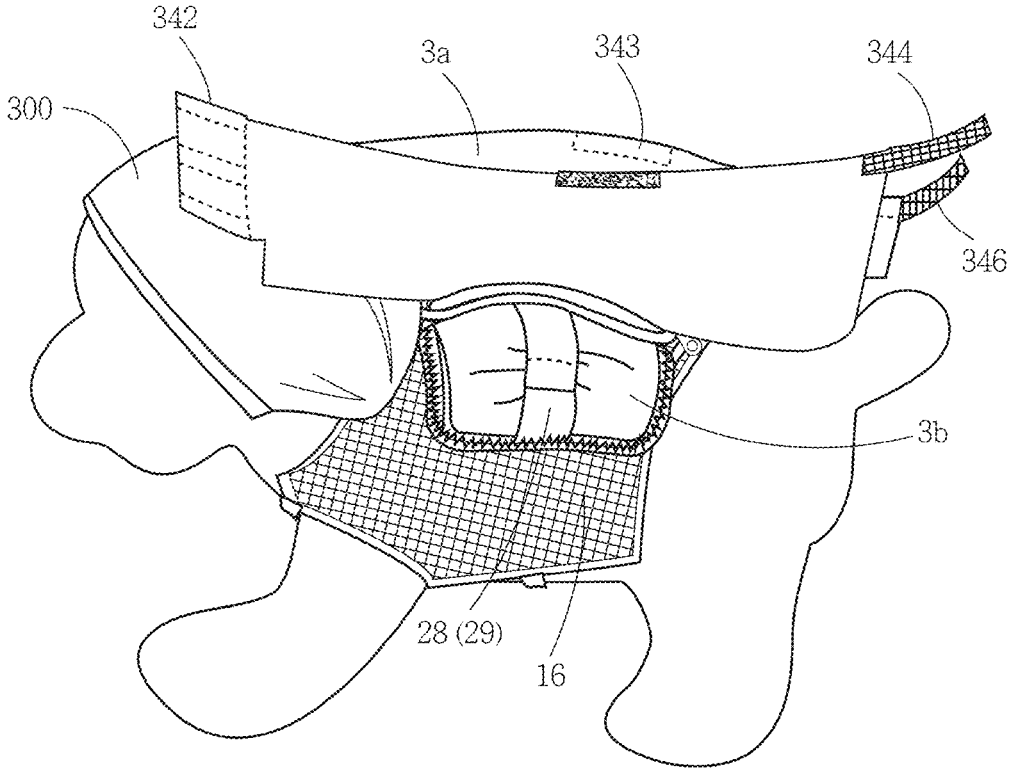
FIG. 35 to FIG. 36 are structural schematic views depicting unfolding and operating states of the third embodiment of the present invention.
Figure 36:
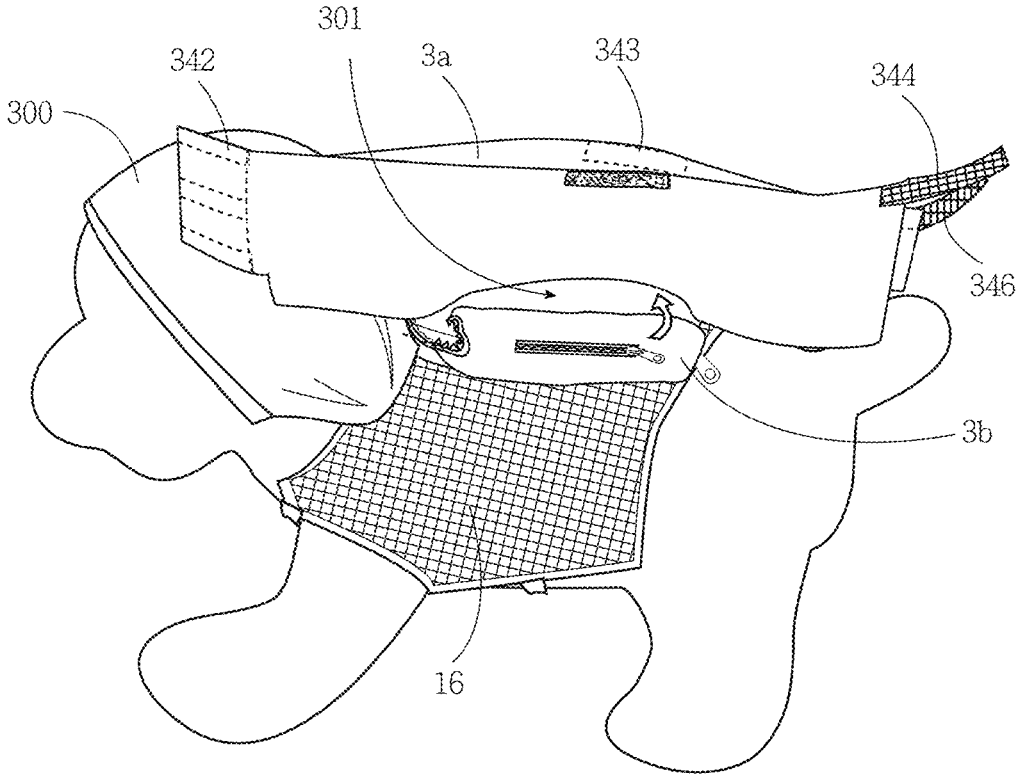
Figure 46:
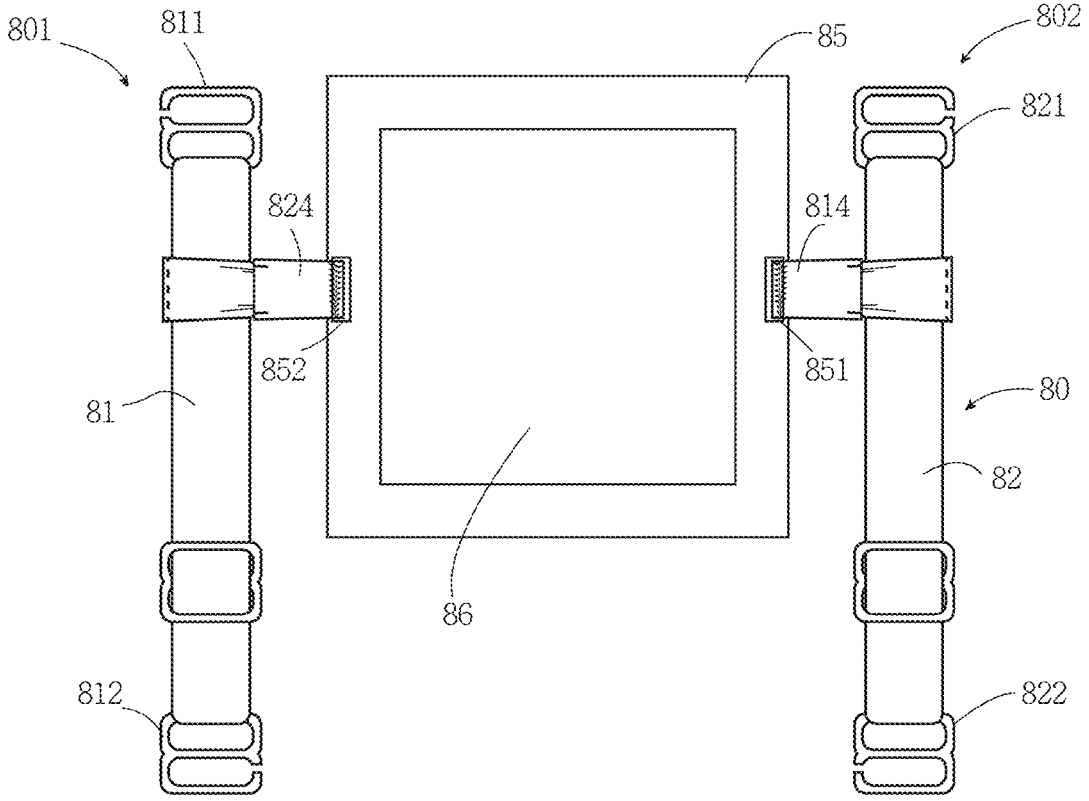
FIG. 46 to FIG. 47 are structural schematic views depicting operating states of the fifth embodiment of the present invention.
Figure 47:
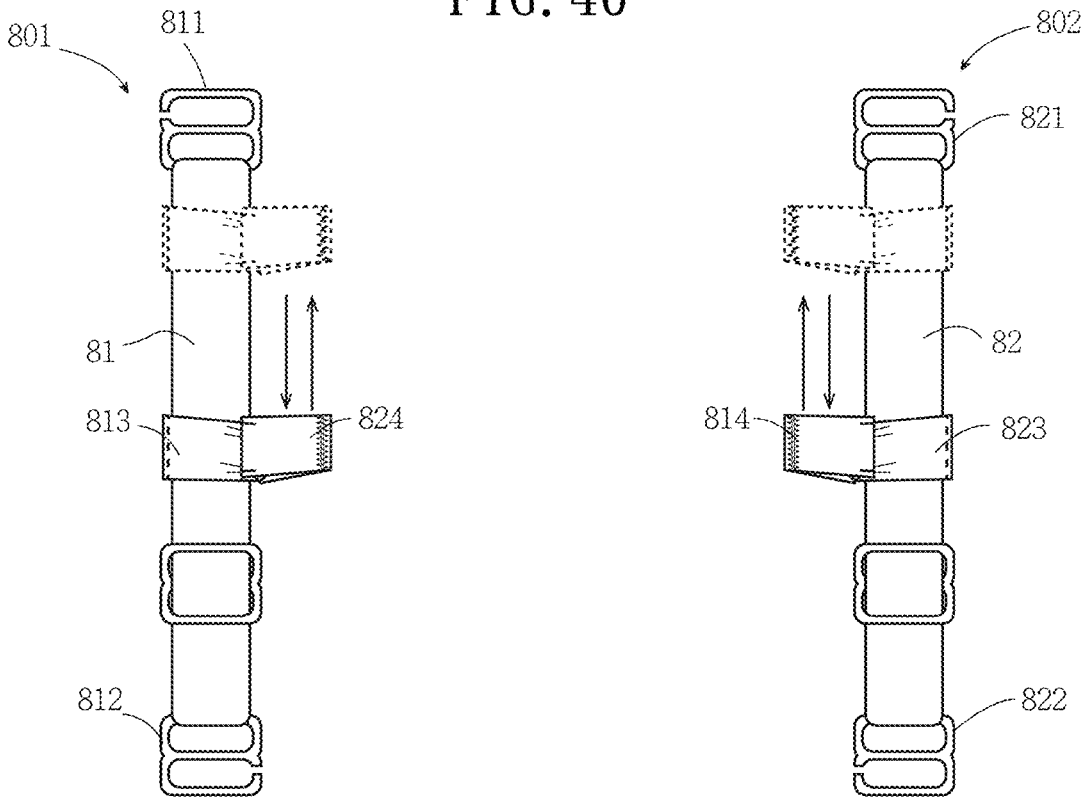

Referring together to FIG. 33 and FIGS. 43 to 47, which show a fifth embodiment that is similar to the fourth embodiment of the present invention, wherein the aforementioned structures are applied in the support enclosure 16 worn on the pet's body, and further applied in the fixing device 80 for the pet droppings collection bag 86, the only difference being in the fixing device 80 of the fifth embodiment comprises a left fixing belt 81 and a right fixing belt 82; the plurality of rings 160 comprise a first ring 1601 and a second ring 1602 corresponding to the left fixing belt 81, and a third ring 1603 and a fourth ring 1604 corresponding to the right fixing belt 82 (see FIG. 33). The left hook member comprises a left upper hook member 811 and a left lower hook member 812 provided on the left fixing belt 81. The right hook member 802 comprises a right upper hook member 821 and a right lower hook member 822 provided on the right fixing belt 82. The left fixing belt 81 is wrapped round the pet's left leg after securely hooking the left upper hook member 811 with the first ring 1601, and then the left lower hook member 812 is used to securely hook onto the second ring 1602. The right fixing belt 82 is wrapped round the pet's right leg after securely hooking the right upper hook member 821 with the third ring 1603, and then the right lower hook member 822 is used to securely hook onto the fourth ring 1604. In addition, the left and right fixing belts 81, 82 are provided with a left movable member 813 and a right movable member 823, respectively, as well as being provided with a left holding member 814 and a right holding member 824 respectively provided on the left movable member 813 and the right movable member 823, as depicted in FIG. 46. The pet droppings collection bag 86 is further provided with a frame 85, and the frame is provided with a left hole 851 and a right hole 852. The left and right holding members 814, 824 are used to secure fixing the pet droppings collection bag 86 to the left and right holes 851, 852 of the frame 85.

Figure 48:
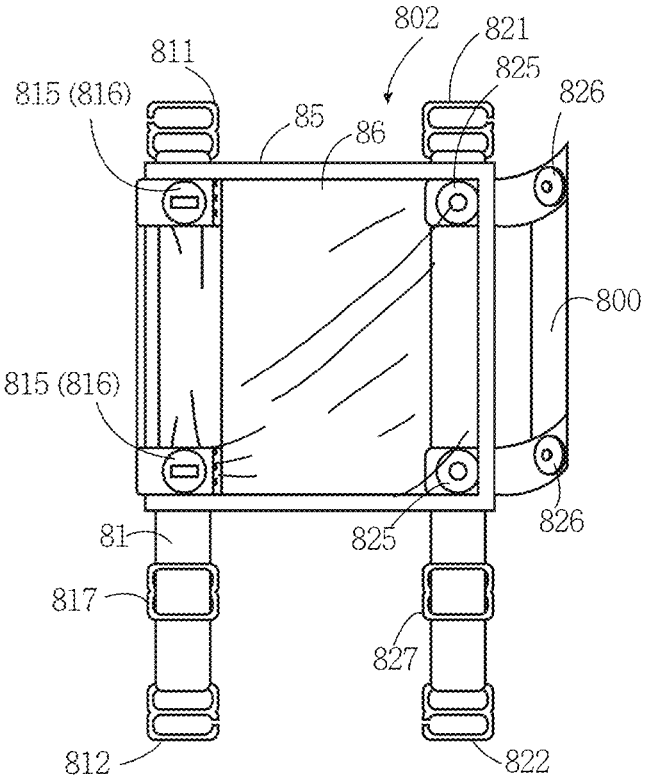
FIG. 48 to FIG. 49 are structural schematic views depicting operating states of a sixth embodiment of the present invention.
Figure 49:
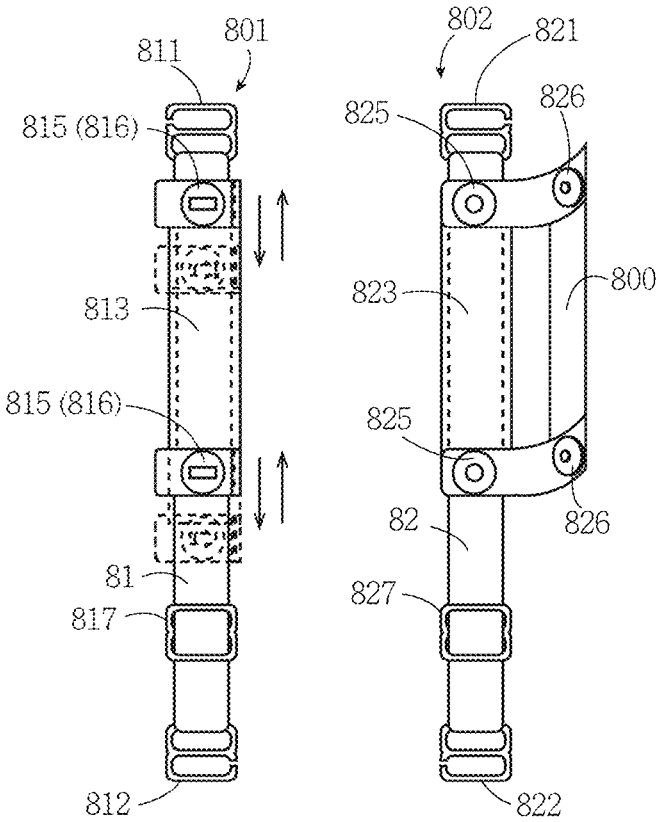

Referring to FIGS. 48 and 49, which show a sixth embodiment that is similar to the fifth embodiment of the present invention, wherein the aforementioned structures are applied in the support enclosure 16 worn on the pet's body, and further applied in the fixing device 80 for the pet droppings collection bag 86, the only difference being in the left and right movable members 813, 823 which are further respectively provided with a pair of bendable left male and female magnetic clasps 815, 816, and a pair of bendable right male and female magnetic clasps 825, 826, respectively. The left male and female magnetic clasps 815, 816 and the right male and female magnetic clasps 825, 826 are used to form an entire body that assumes an inverse n-shape after connecting to a connecting belt 800, thereby achieving the function that facilitates the user to simultaneously manipulate the two pairs of magnetic clasps 815, 816 and 825, 826. After bending the left male and female magnetic clasps 815, 816 and fastening them together, and after bending the right male and female magnetic clasps 825, 826 and fastening them together, the pet droppings collection bag 86 is thereby held and securely positioned (see FIG. 48). The left and right movable members 813, 823 are provided on the left and right fixing belts 81, 82 using movable connected means, and the left and right movable members 813, 823 are used to enable upward or downward position adjustment. The left and right fixing belts 81, 82 are provided with a left adjustment member 817 and a right adjustment member 827, respectively, which are used to adjust the length of the left and right fixing belts 81, 82 for pets of different body types to suitably wear and enable secure fixing of the clothing.

Figure 50:
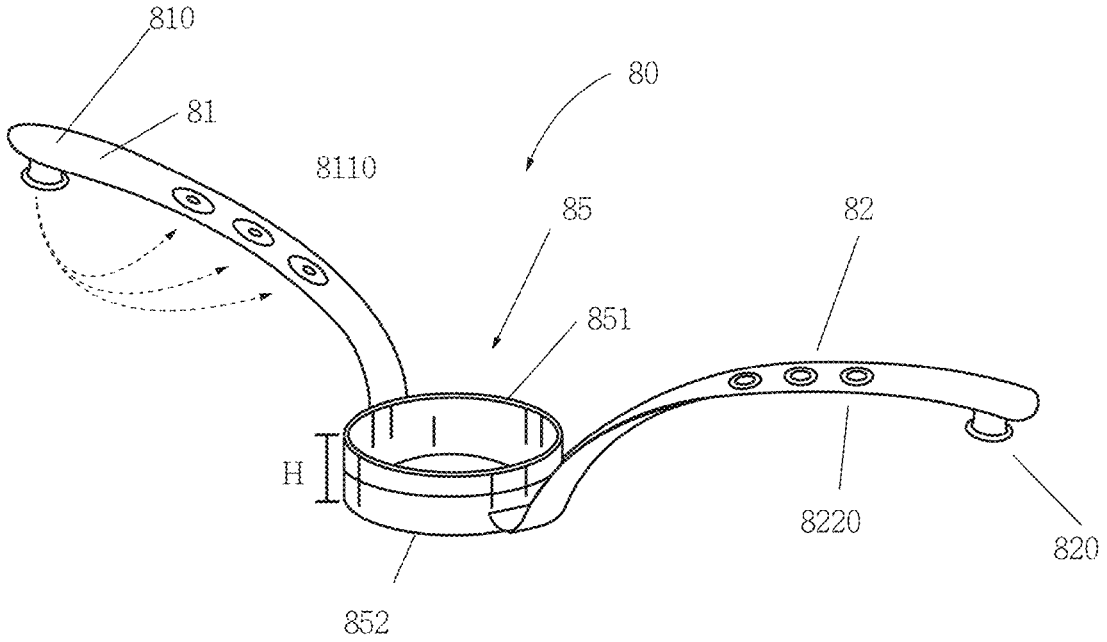
FIGS. 50 and 51 are structural schematic views showing the fixing device of a seventh embodiment of the present invention.
Figure 51:
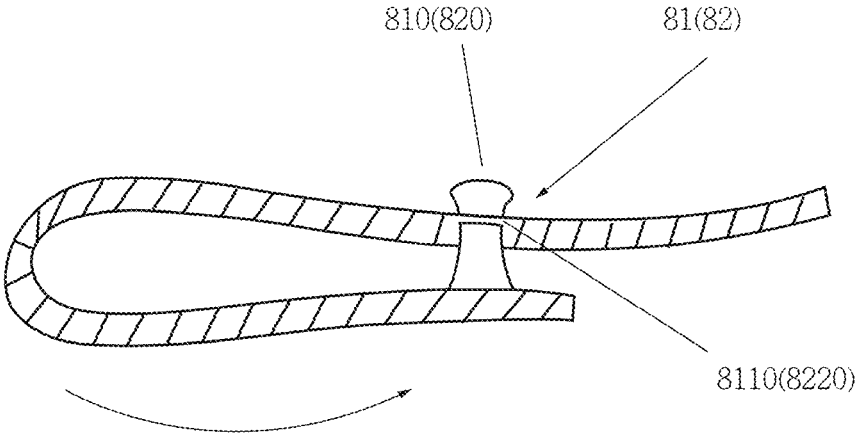
Figure 54:
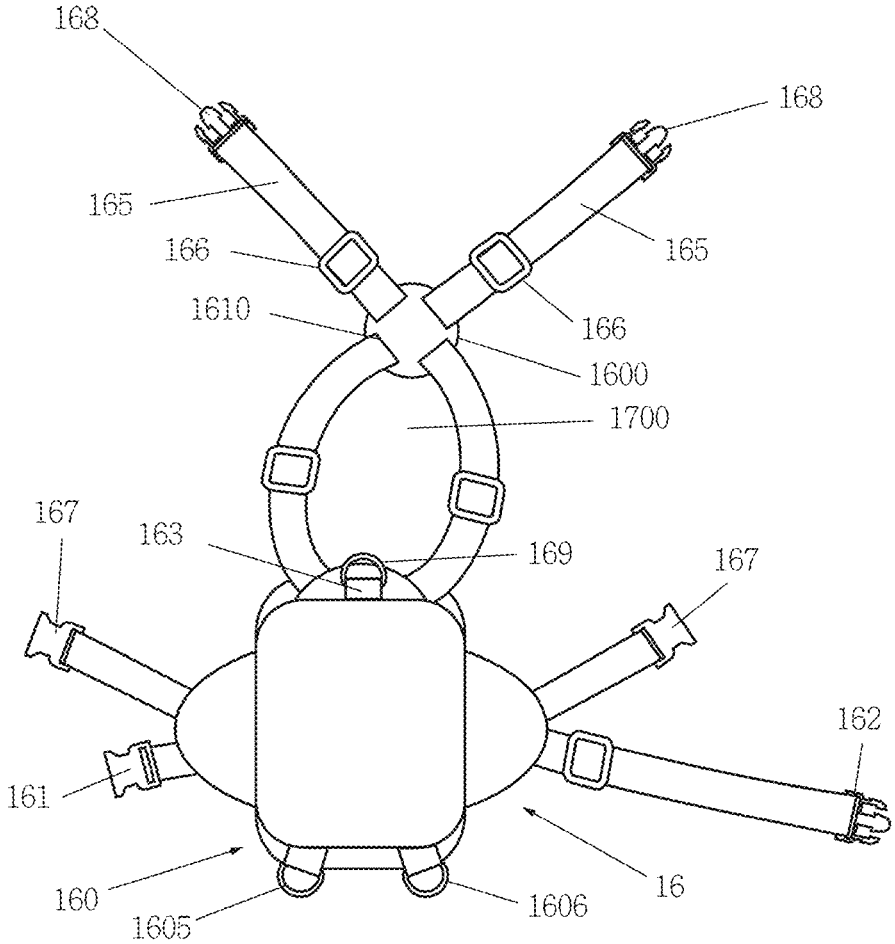

Referring to FIGS. 50 and 51, which show a seventh embodiment of the present invention that, similar to the fifth and sixth embodiments, is applied in the fixing device 80 for the pet droppings collection bag 86, wherein the frame 85 and the left, right fixing belts 81, 82 are formed as an integral body (see FIG. 50) or the separated left, right fixing belts 81, 82 (see FIG. 51) are structurally assembled to the frame 85. The side of the frame 85 is provided with a predetermined height H that forms an upper opening 851, a lower opening 852, and a passage between the upper, lower openings 851, 852. The left and right fixing belts 81, 82 are respectively fitted to the side of the frame 85 close to the area of the lower opening 852. Because of the predetermined height H that separates the upper opening 851 from the lower opening 852 that forms the passage between the left and right fixing belts 81, 82 that are connected close to the area of the lower opening 852, thus, when in use, the user can mount the opening of the pet droppings collection bag 86 (see FIG. 39) on the upper opening 851 and pass the body of the pet droppings collection bag 86 through the lower opening 852, using the upper opening 851 to correspond to the position of the pet's anus to achieve the function to receive the feces discharged by a pet. Referring to FIG. 54, the rear side of the structure formed by the front and rear cover sheets 1, 2 is fitted with the at least one ring 160. In addition, the present embodiment is respectively fitted with a fifth ring 1605 and a sixth ring 1606. During fitting, the above-described fifth ring 1605 and the sixth ring 1606 are used to respectively pass the left and right fixing belts 81, 82 therethrough, and are also used to assemble and fix together locating members 810, 820 respectively fitted on the left and right fixing belts 81, 82 (see FIG. 51), thereby pressing and fixedly positioning the upper opening 851 at the position of the pet's anus.

Figure 52:
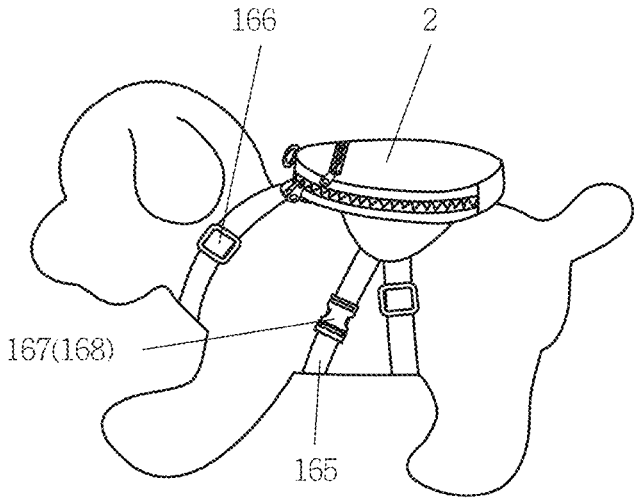
FIGS. 52, 53, and 54 show a further embodiment of the present invention developmentally derived from the first embodiment.
Figure 53:
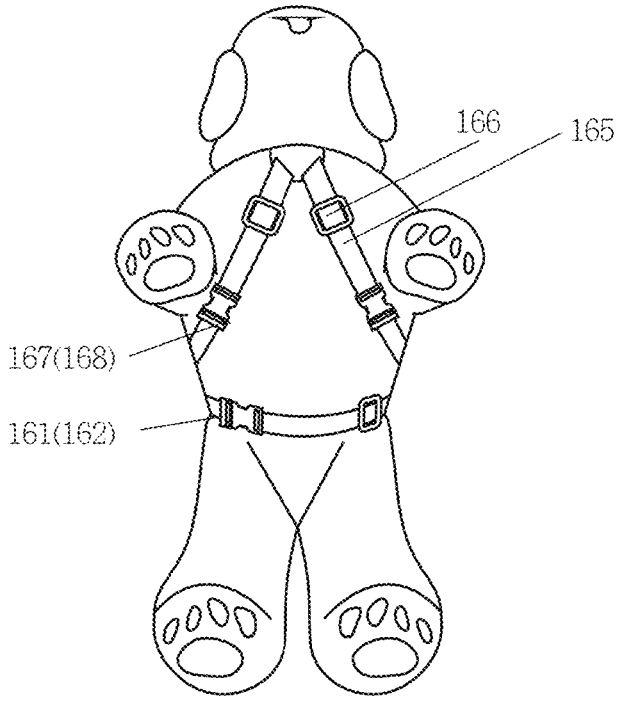

FIGS. 52, 53, and 54 show a further embodiment of the present invention developmentally derived from FIG. 10, wherein the support enclosure 16 is formed on the left and right two sides of the front and rear cover sheets 1, 2. In addition, the support enclosure 16 comprises the first fastening portion 161 and the first fastening assembly portion 162, whereby the first fastening (assembly) portions 161, 162 are joined together to enable joining the front and rear cover sheets 1, 2 to form a structure that enables wearing and fixing onto a pet's body. The front left and right two ends of the front and rear cover sheets 1, 2 are respectively configured with the annular belt 165, which are used to pass through or be positioned at the pet's chest to enable joining the front and rear cover sheets 1, 2 to form the structure that enables wearing and fixing onto the pet's body. Each of the annular belts 165 is provided with the at least one first adjustment piece 166, and the adjustment pieces 166 are used to adjust the length of the annular belt 165.

The front ends of the left and right annular belts 165 are respectively provided with the female buckle 167 (the first adjustment piece 166 and the female buckles 167 can also be joined together to form female buckles provided with an adjustment function). The left and right annular belts 165 use through holes 1610 to pass through an intersecting member 1600 and form a fixable positioning X-shaped intersection, or the left, right annular belts 165 are directly machine cross-stitched to fix and form the X-shaped intersection, thereby enabling the formed X-shaped intersection portion to be placed in the narrow space between the pet's chest or its two front legs, further enabling the left and right annular belts 165 to rearward extend in the direction of the crisscrossing thereof and assemble together the female buckles 167 and male buckles 168 fitted on the two sides of the front and rear cover sheets 1, 2 to form an X-shaped buckle component structure. Apart from providing the effect to pass through the narrow space of the pet's chest, the left and right annular belts 165 assume an X-shaped intersection by passing through the X-shaped intersection structure, and after putting onto a pet, the left and right annular belts 165 rearward extend to join together with the female buckles 167, causing the strain of the left and right annular belts 165 to be concentrated on the area of the X-shaped intersection, which forms an X-shaped structure from the fastening together of the female buckles 167 and male buckles 168 and provides a component forces effect.

According to what has been described above, an access opening 1700 is concurrently formed after the left and right annular belts 165 form the fixed X-shaped intersection, thus, when preparing to put the structure onto the pet, after passing the pet's head through the access opening 1700, the female buckles 167 and the male buckles 168, the male snap 161 and the female snap 162 are respectively joined together; the female buckle 167 can alternatively be replaced by male buckle 168 and vise versa; the female snap 162 can alternatively be replaced by male snap 161 and vise versa. Apart from the pull cord 171 connected to the fixing ring 169 (see FIG. 15) achieving a component force effect when taking the dog for a walk outdoors, compared to each of the above-described embodiments, which uses sheet material to form the support enclosure 16 structure worn on the pet's body, the above-described fixed X-shaped intersection structure of the present embodiment directly uses long strips of fabric tape provided with the adjustment members 166 to replace the support enclosure 16 for wearing on the pet's body. In addition, compared to the other embodiments described above, because the long strips of fabric tape are adjustable, the length ranges thereof are increased and thus suitable for use with more pets of different weight ranges.

Referring to FIGS. 55 to 61, which show the support enclosure 16 of the present embodiment fitted with a front harness 16A, which further comprises a first traverse belt 16A1, a second traverse belt 16A2, and a lengthwise belt 16A3. The first traverse belt 16A1 is connected or cross-connected with the second traverse belt 16A2; moreover, the lengthwise belt 16A3 is fitted between the first traverse belt 16A1 and the second traverse belt 16A2, forming left and right gaps 16A4 (the present embodiment is also feasible without the lengthwise belt 16A3) to facilitate passing a pet's front two legs therethrough, after which the front harness 16A is put onto the pet's front body from the pet's underside upwards (see FIGS. 59 and 60).

The two ends of the first traverse belt 16A1 are respectively provided with left, right female buckles 16A13, 16A14. The two ends of the second traverse belt 16A2 are respectively provided with a second traverse belt male buckle 16A22 and a corresponding second traverse belt female buckle 16A21 to facilitate clasping the two together forming a front connected section 16AB3. In addition, the second traverse belt female buckle 16A21 and the second traverse belt male buckle 16A22 are respectively provided with the fixing ring 169 on corresponding sides thereto to facilitate connecting the hook ring 170 fitted to the front end of the pull cord 171 to the fixing rings 169 (see FIG. 15) when the user is taking their dog for a walk outdoors, The support enclosure 16 is further fitted with a rear harness 16B, which comprises a third transverse belt 16B1, which is respectively provided with left, right male buckles 16B13, 16B14 corresponding to the left, right female buckles 16A13, 16A14 fitted to the two ends of the first traverse belt 16A1, thereby enabling forming left, right assembly sections 16AB1, 16AB2 after connecting together (see FIG. 59). The two ends of the third transverse belt 16B1 are respectively provided with a third traverse belt male buckle 16B12 and a corresponding third traverse belt female buckle 16B11 to facilitate forming a rear connected section 16AB4 after clasping together thereof. Accordingly, the above-described support enclosure 16 assumes a square belt structure configuration after assembly thereof (see FIG. 55); the female buckle 16A13, 16A14, 16A21, 16B11 can alternatively be replaced by male buckle 16B13, 16B14, 16A22 16B12 and vise versa.

The holding portion 4 of the present embodiment is a small, split type structural bag 44, wherein two sides of the holding portion 4 are respectively provided with a fixing member 42, and a corresponding fixing member 43 is provided on the main body of the holding portion 4. As shown in the diagrams, the fixing member 42 and the corresponding fixing member 43 can be hook and loop fasteners, and can also be other types of male and female fastening members (not shown in the drawings). The fixing members 42 and the corresponding fixing members 43 are used to movable cover and fix the left, right assembly sections 16AB1, 16AB2 therebetween, thus enabling positioning the holding portion 4 on the upper side of the support enclosure 16 assuming a square belt structure (see FIGS. 55, 56, and 57).

Referring to FIGS. 62 to 65, which show an embodiment developmentally derived from the fourth embodiment of the present invention shown in FIGS. 37 to 42, wherein the fixing device 80 of the embodiment comprises a first main body 830, a second main body 840, and a bending member 8400 positioned between the first main body 830 and the second main body 840. The first main body 830 and the second main body 840 are respectively fitted with a corresponding male fastener 832 and female fastener 842, as well as a first passage 834 and a corresponding second passage 844 centrally positioned on the first main body 830 and the second main body 840, respectively. The male fastener 832 and the corresponding female fastener 842 are used to fix and hold down the pet droppings collection bag 86 at the position of the first passage 834 and the second passage 844 between the first main body 830 and the second main body 840; the female fastener 842 can alternatively be replaced by male fastener 832 and vise versa.

Figure 64:
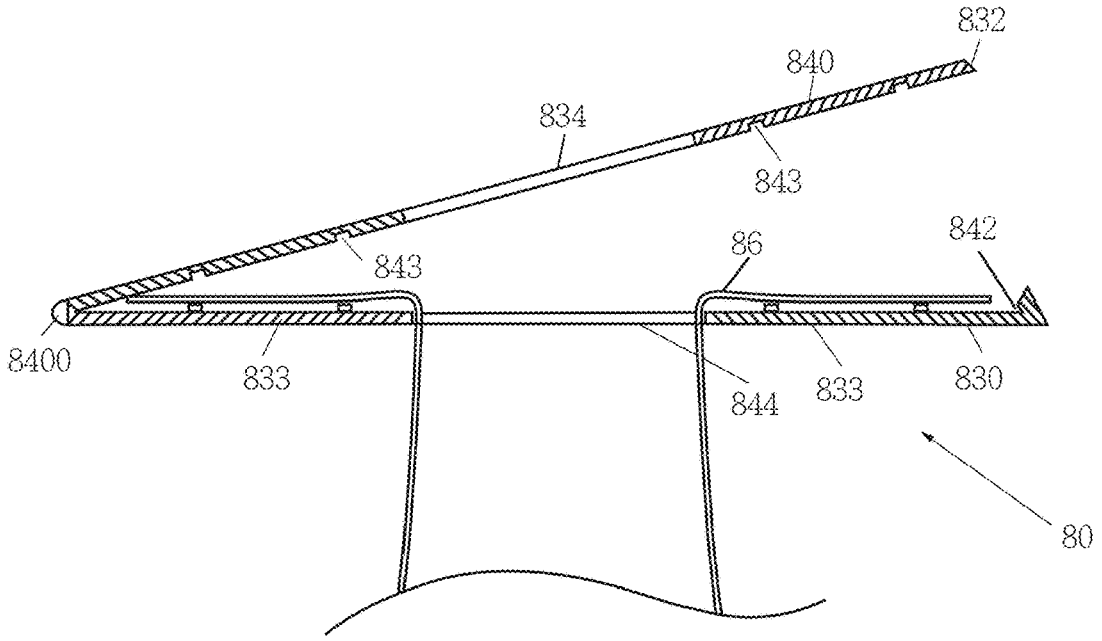
FIGS. 64 and 65 show lengthwise sectional schematic first views of an open and a closed operating state based on FIG. 55 according to the present invention.
Figure 65:
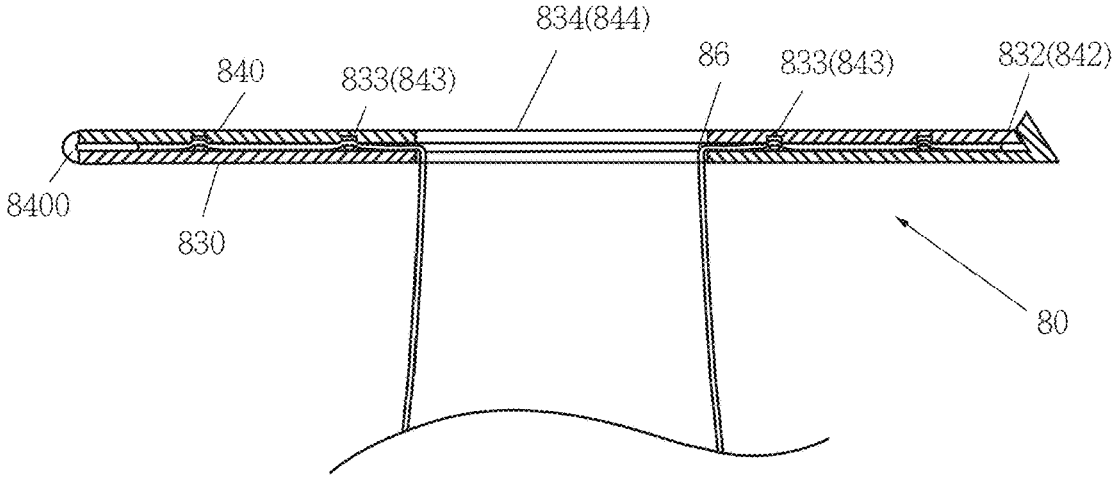

Referring to FIGS. 64 and 65, which show the first main body 830 and the second main body 840 respectively fitted with at least one set of corresponding male, female clasps 833, 843, which enable more firmly fixing and holding down the pet droppings collection bag 86 between the first main body 830 and the second main body 840. Hence, when the pet is defecating, the pet droppings collection bag 86 is able to bear the weight of the feces and, thus, prevent the pet droppings collection bag 86 from falling off because of the weight; the female clasp 843 can alternatively be replaced by male clasp 833 and vise versa.

Figure 62:
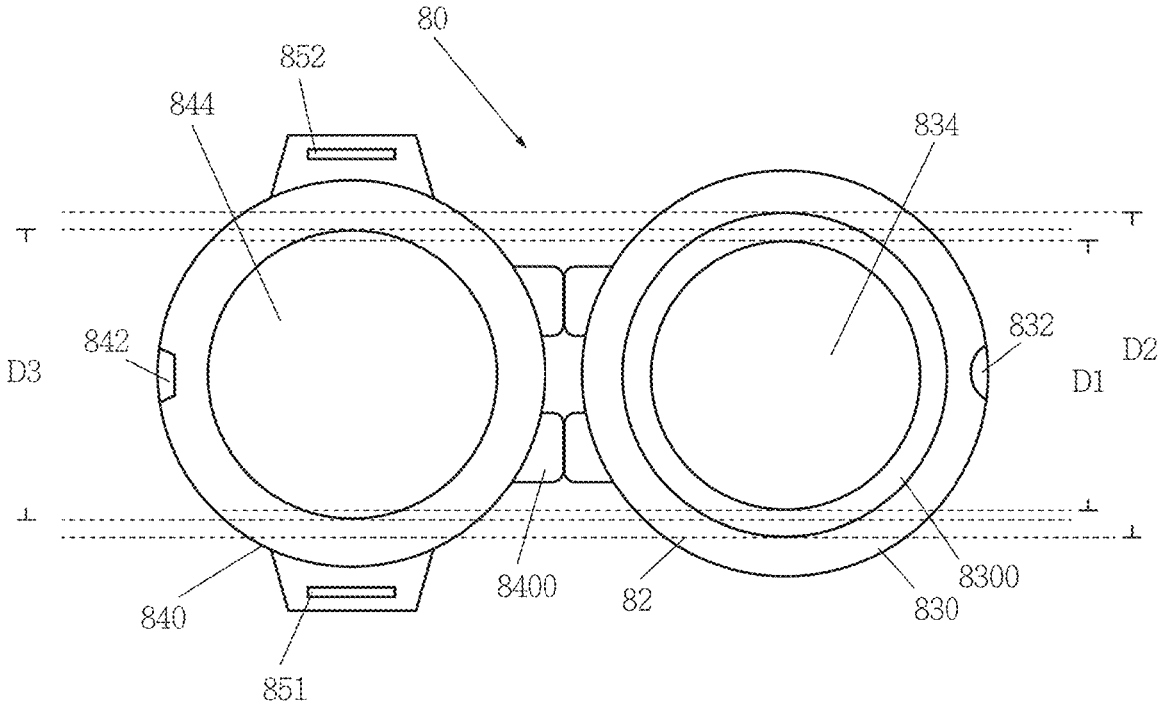
FIG. 62 is an open state schematic view of an embodiment of a fixing device of the present invention developmentally derived from the embodiment shown in FIGS. 37 to 42.
Figure 63:
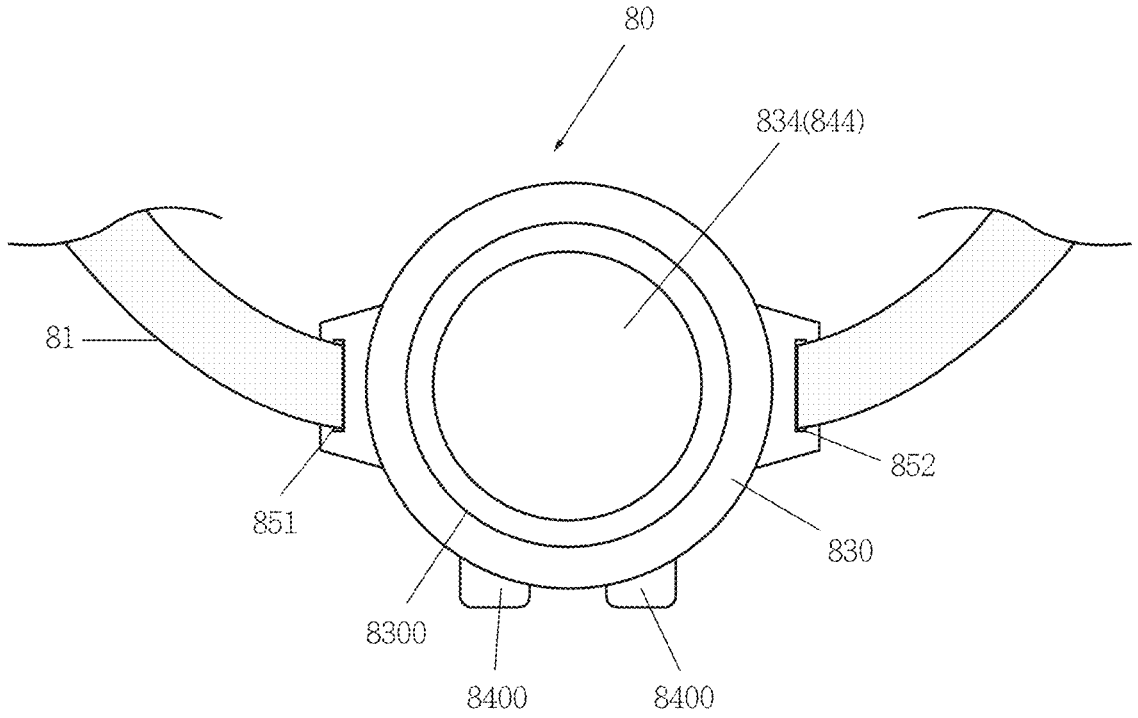
FIG. 63 is an application schematic view of a closed state of the embodiment shown in FIG. 62 according to the present invention.

Referring to FIGS. 66, 66A, 66B to FIGS. 67, 67A, 67B, together with FIG. 62, which show a protruding edge 8300 additionally provided on the first passage 834 of the first main body 830 of the embodiment, wherein the sides of the protruding edge 8300 assume a slight gradient with a narrow upper and wide lower. A diameter D1 of the end opening of the protruding edge 8300 is slightly smaller than a diameter D2 of the bottom portion of the protruding edge 8300; moreover, the diameter D1 is smaller than a diameter D3 of the second passage 844 (see FIG. 62), thereby enabling an easier and more stable clasping operation between the first main body 830 and the second main body 840. To operate, the user first places the pet droppings collection bag 86 onto the protruding edge 8300, and then uses the female fastener 832 of the first main body 830 and the male fastener 842 of the second main body 840 to hold down and fix the pet droppings collection bag 86 therebetween. Furthermore, because the protruding edge 8300 fitted on the first passage 834 is provided with a height H (see FIGS. 62 and 66), after folding down the first main body 830 onto the second main body 840, the protruding edge 8300 fitted with the pet droppings collection bag 86 protrudes out from the second main body 840 (see FIGS. 67 and 67A), thereby causing the pet droppings collection bag 86 to contact the area surrounding the pet's anus, and, thus preventing, when the pet has diarrhoea or is expelling soft stool, the discharged feces contacting and dirtying the fixing device 80 positioned surrounding the pet's anus.

As shown in the drawings, the exterior of the protruding edge 8300 is provided with a clasp groove 8301, and a corresponding clasp 8401 is provided on the peripheral edge of the second passage 844. The angle of an inclination S1 of the clasp 8401 is such to operate in coordination with the shape of the clasp groove 8301. Moreover, the male fastener 842 of the second main body 840 is provided with an inclination S2, and the angle of the inclination S2 is such to operate in coordination with the shape of the female fastener 832 of the first main body 830. After folding down the first main body 830 onto the second main body 840, the protruding edge 8300 protrudes out from the second main body 840, whereupon the clasp groove 8301 provided on the peripheral edge of the first passage 834 corresponds to the clasp 8401 provided on the peripheral edge of the second passage 844, and the female fastener 832 of the first main body 830 corresponds to the male fastener 842 of the second main body 840, thereby achieving a firmer clasping effect; the female fastener 842 can alternatively be replaced by male fastener 832 and vise versa.

Figure 66:
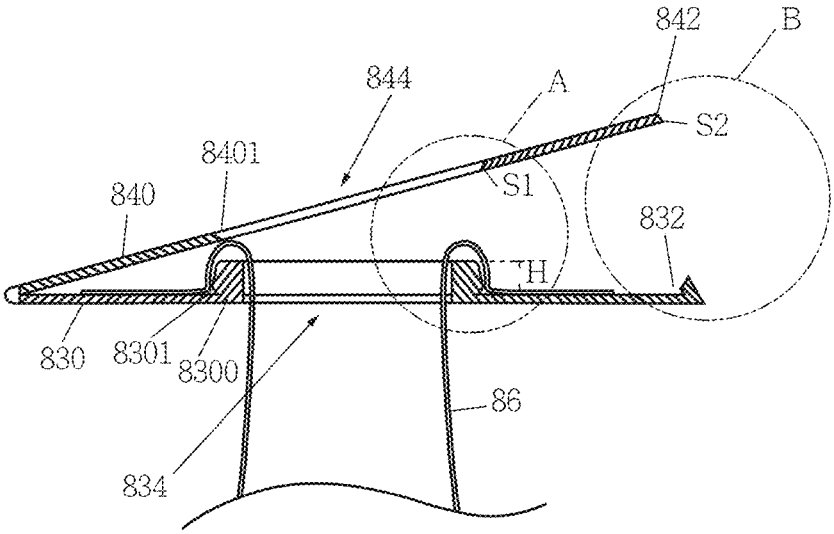
FIG. 66 shows a lengthwise sectional schematic second view of an open state based on FIG. 55 according to the present invention.
Figure 66B:
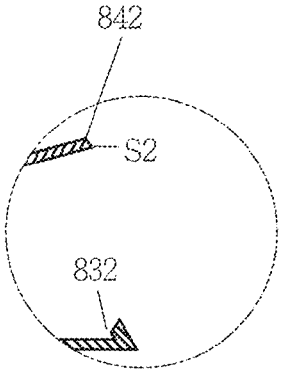
FIG. 66A and FIG. 66B are partial enlarged views of FIG. 66 according to the present invention.
Figure 66A:
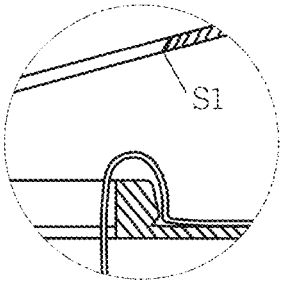
Figure 67:
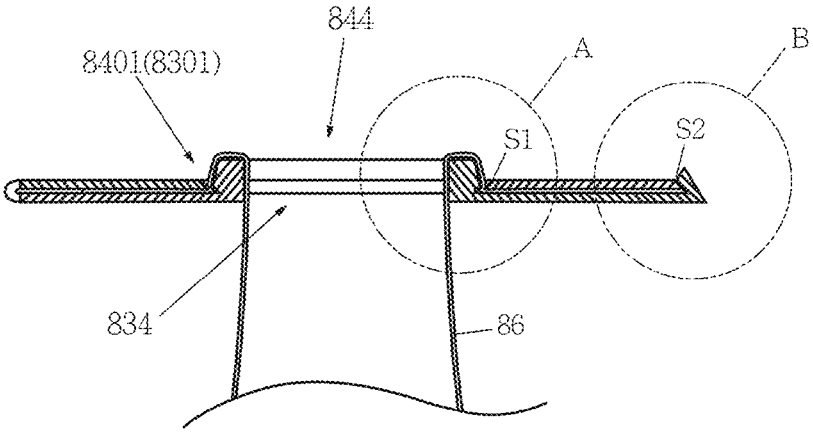
FIG. 67 shows a lengthwise sectional schematic second view of a closed state based on FIG. 55 according to the present invention.
Figure 67B:
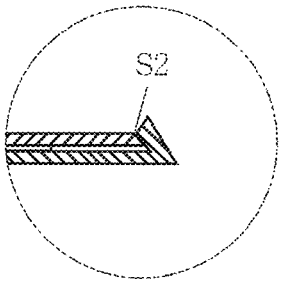
FIG. 67A and FIG. 67B are partial enlarged views of FIG. 67 according to the present invention.
Figure 67A:
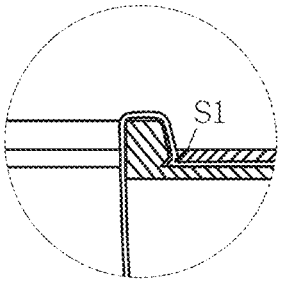
Figure 68:
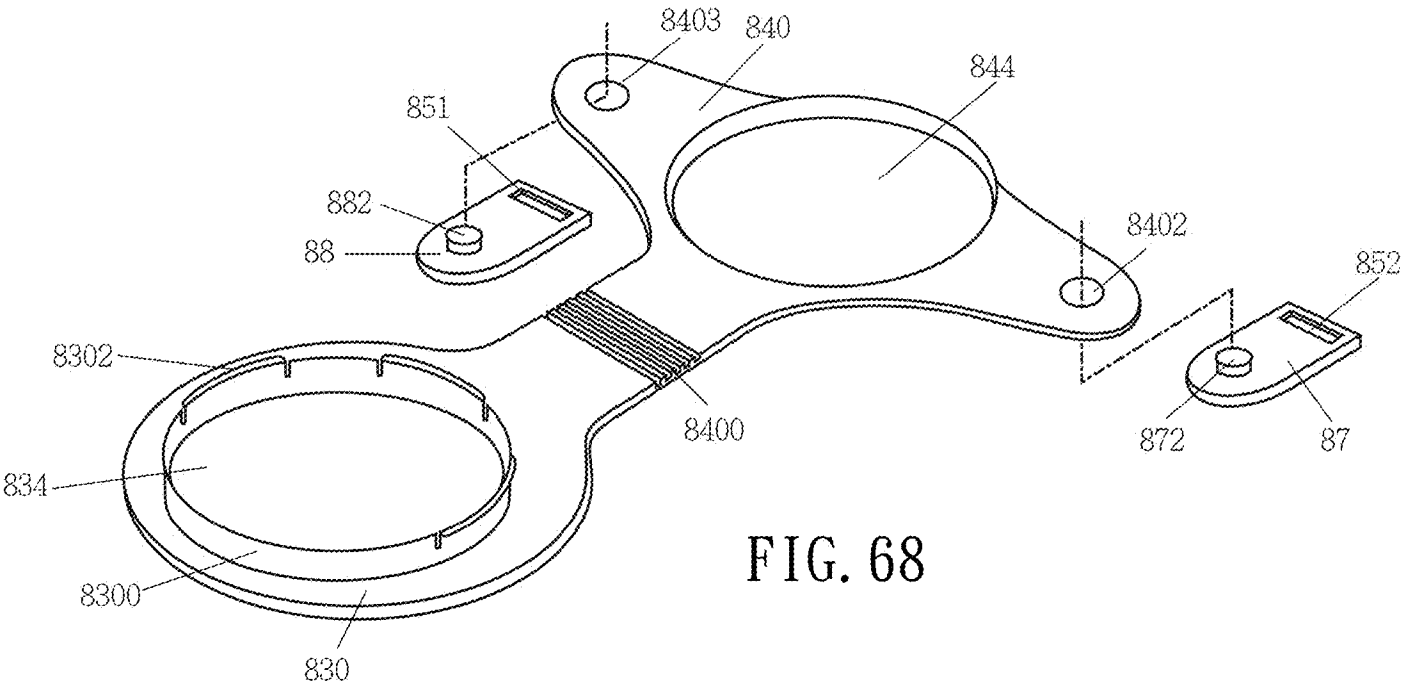
FIG. 68 is a partial exploded schematic view of a structure developmentally derived from the embodiment shown in FIG. 66 according to the present invention.
Figure 69:
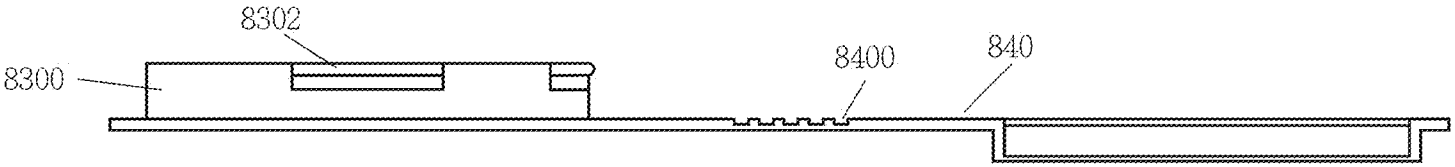
FIG. 69 is a side schematic view of FIG. 68 according to the present invention.
Figure 70:
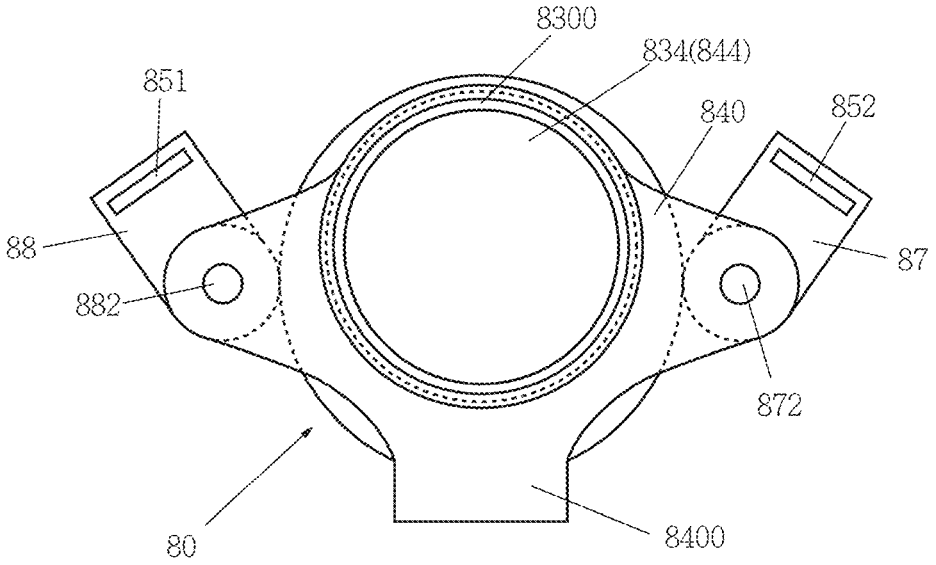
FIG. 70 is a front schematic view of an assembled state of the embodiment shown in FIG. 68 according to the present invention.
Figure 71:
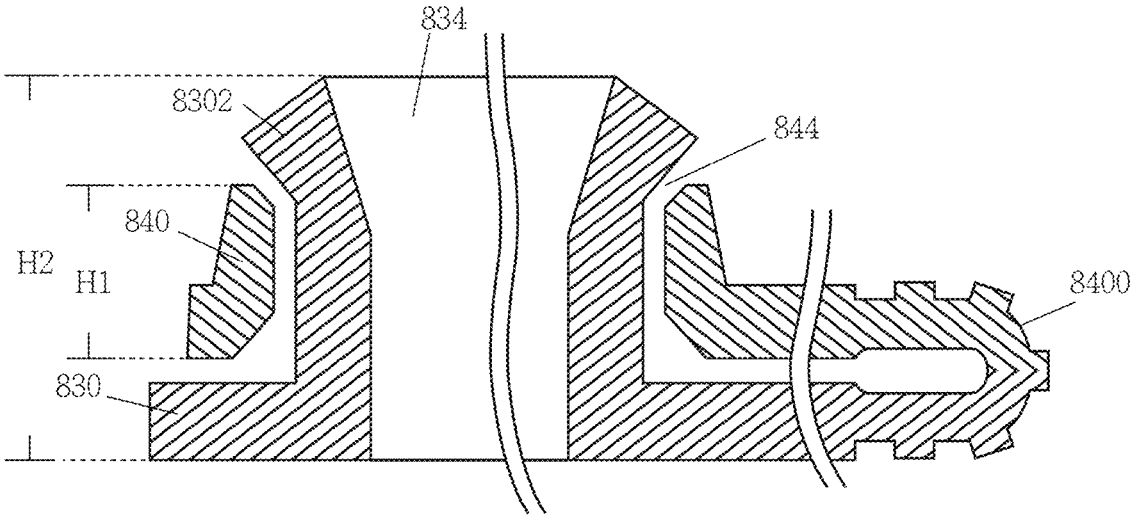
FIG. 71 is a partial structural cross-sectional schematic view of FIG. 70 according to the present invention.

Referring to FIGS. 68 to 71, which show a present embodiment developmentally derived from the fixing device 80 shown in FIGS. 66 to 67B. In the present embodiment, the two sides of the second main body 840 are additionally fitted with a left swinging member 88 and a right swinging member 87. Furthermore, the left, right swinging members 88, 87 are respectively provided with left, right holes 851, 852, which enable joining together of the separable left, right fixing belts 81, 82 (see FIG. 63). The two sides of the second main body 840 are respectively provided with left, right active holes 8403, 8402, and the left, right swinging members 88, 87 are respectively fitted with left, right movable members 882, 872 corresponding to the left and right active holes 8403, 8402. When the left, right fixing belts 81, 82 are joined together through the respective left, right holes 851, 852, the left, right movable members 882, 872 and the left, right active holes 8403, 8402 enable movable adjusting the joining angle of the left, right swinging members 88, 87 and the left, right fixing belts 81, 82 with the rings 160 fitted on the support enclosure 16 or the belt intersecting member 1600, as well as enabling forming a firmer joining angle between the fixing device 80 and the pet's buttocks.

In addition, at least one outer extended member 8302 is provided on the top edge position at the end opening of the protruding edge 8300 provided on the first main body 830. After folding down the first main body 830 onto the second main body 840, the protruding edge 8300 protrudes out from the second main body 840, whereupon the outer extended members 8302 are used to achieve a stable clasping effect with the peripheral edge of the second passage 844. In the present embodiment, because the end opening top edge of the protruding edge 8300 is provided with the outer extended members 8302, thus, the sides of the passage 834 do not need to assume a tapered shape with a narrow upper and wide lower; moreover, the clasp groove 8301 and the clasp 8401 shown in the above-described embodiment are also not needed between the first and second passages 834, 844.

When its required to open the first main body 830 and the second main body 840, the user can press the external extended members 8302 cause slight deformation thereof and enable separation of the first main body 830 and the second main body 840.

Figure 54A:
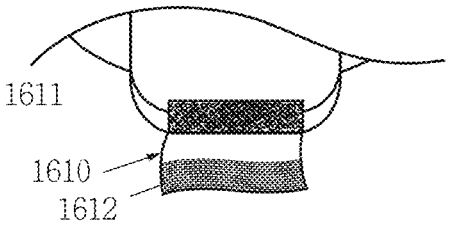
FIGS. 54A and 54B show a further embodiment of the present invention related to a belt intersecting device developmentally derived from FIG. 54.
Figure 54B:
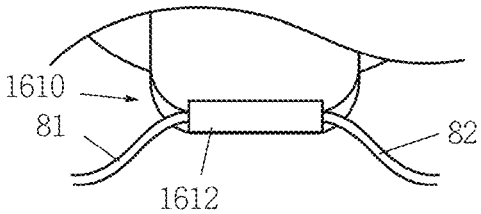
Figure 55:
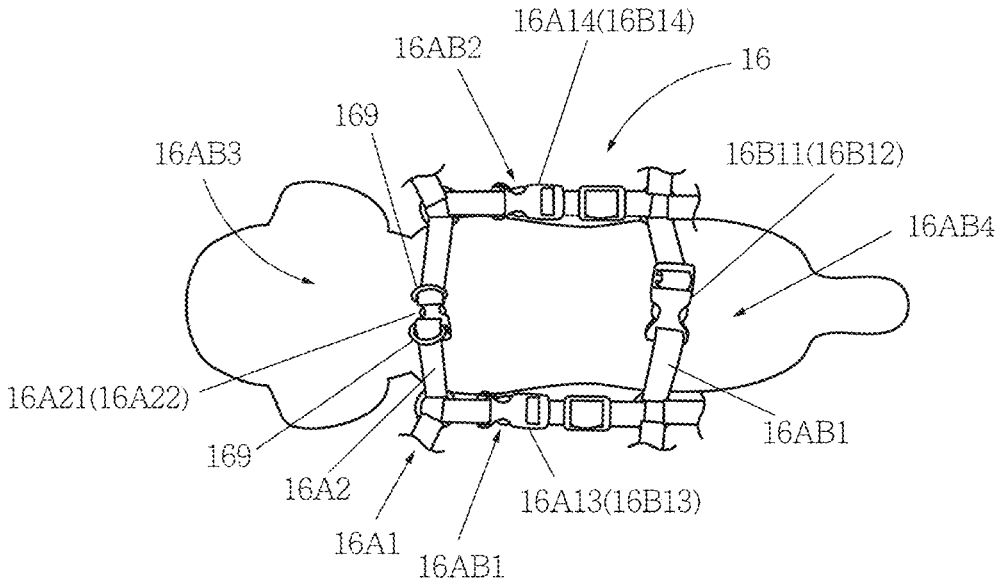
FIG. 55 is an overhead schematic view of an embodiment of a support enclosure structure of the present invention.
Figure 56:
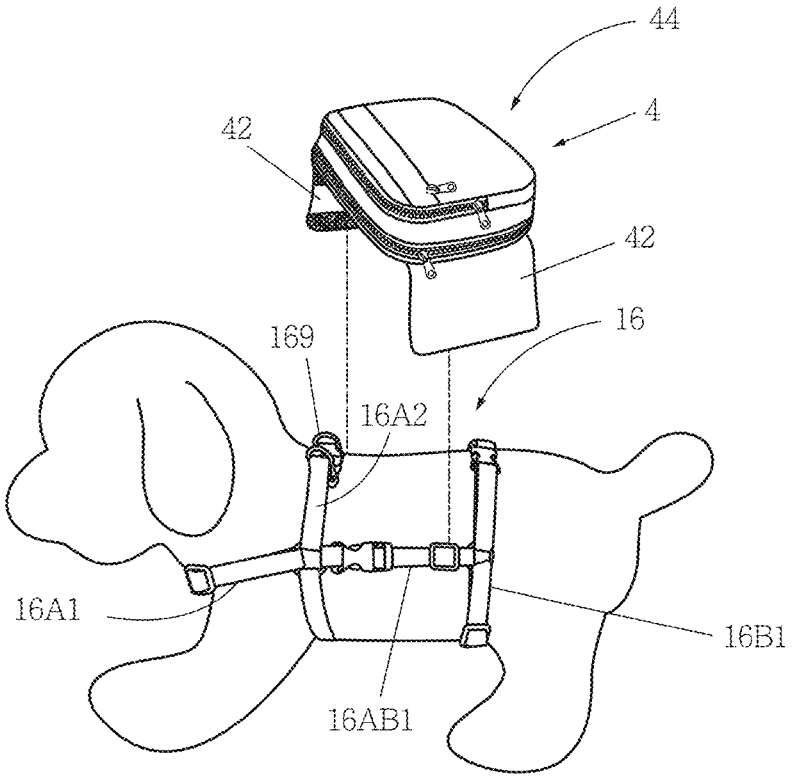
FIG. 56 is an exploded schematic view prior to movable assembling the support enclosure and a holding portion according to the present invention.
Figure 59:
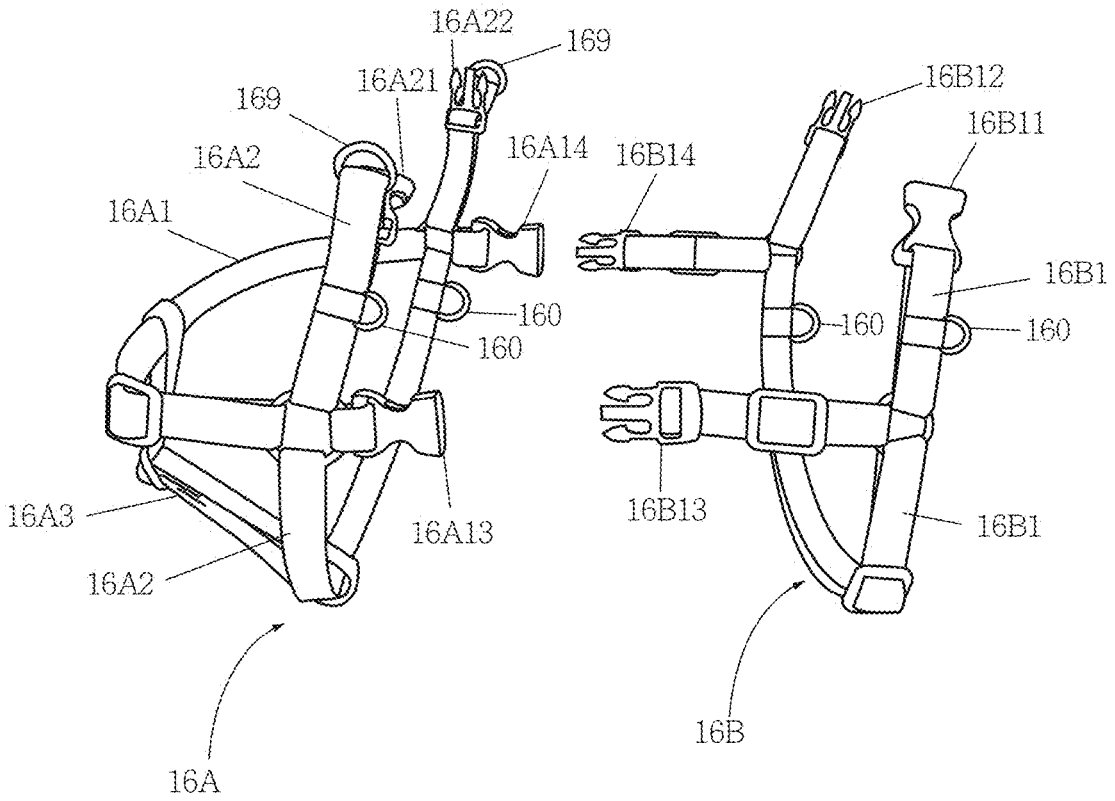
FIG. 59 is an exploded schematic view of the embodiment of the support enclosure structure of the present invention.
Figure 60:
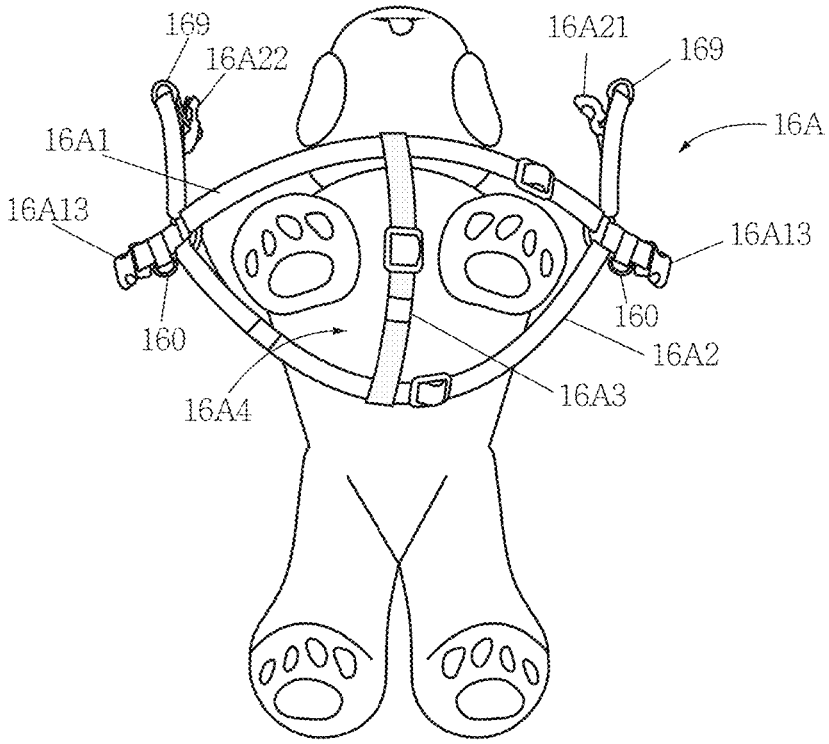
FIG. 60 is a bottom schematic first view of the embodiment of the support enclosure structure shown in FIG. 59 being put on a pet according to the present invention.
Figure 61:
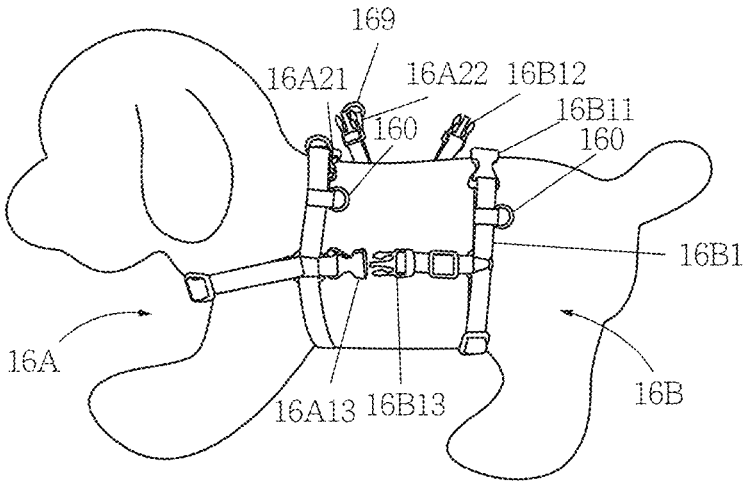
FIG. 61 is a side schematic second view of the embodiment of the support enclosure structure shown in FIG. 59 being put on a pet according to the present invention.

Furthermore, as shown in FIGS. 59 and 61, the front harness 16A or the rear harness 16B of the present embodiment fitted with either the at least one ring 160 or a sleeve member device 1610, (see the embodiment shown in FIGS. 54A and 54B), wherein the rings 160 or the sleeve member device 1610 is used to mount the external connected fixing device 80, and the fixing device 80 is used to securely fix the pet droppings collection bag 86. The fixing device 80 being fixedly positioned with the rings 160 or the sleeve member device 1610, the left, right fixing belts 81, 82 (see FIGS. 50 and 51) or the left and right hook members 801, 802 (see FIGS. 40 to 42) are formed as an integral body, or the movable separable left, right fixing belts 81, 82 are used to pass through the left, right holes 851, 852 (see FIGS. 62 to 70), further joining together the left, right fixing belts 81, 82 and the rings 160, or the sleeve member device 1610 facilitates fixedly positioning the pet droppings collection bag 86 at the position of the pet's anus. Moreover, the fixing device 80, apart from enabling fixedly joining the rings 160 or the sleeve member device 1610 fitted on the rear harness 16B, the second traverse belt 16A2 of the front harness 16A of the present embodiment can also be fitted with the rings 160 or the sleeve member device 1610 to enable fixedly joining the fixing device 80. Because the pet's anus and tail are extremely close together (especially in small sized pets), thus, the first, second passages 834, 844 of the present embodiment are provided at positions close to the upper edges of the first, second main bodies 830, 840, hence, after clasping the two together, the upper edges form a small size (see FIG. 70) and are located at a position between the pet's anus and tail.

Figure 72:
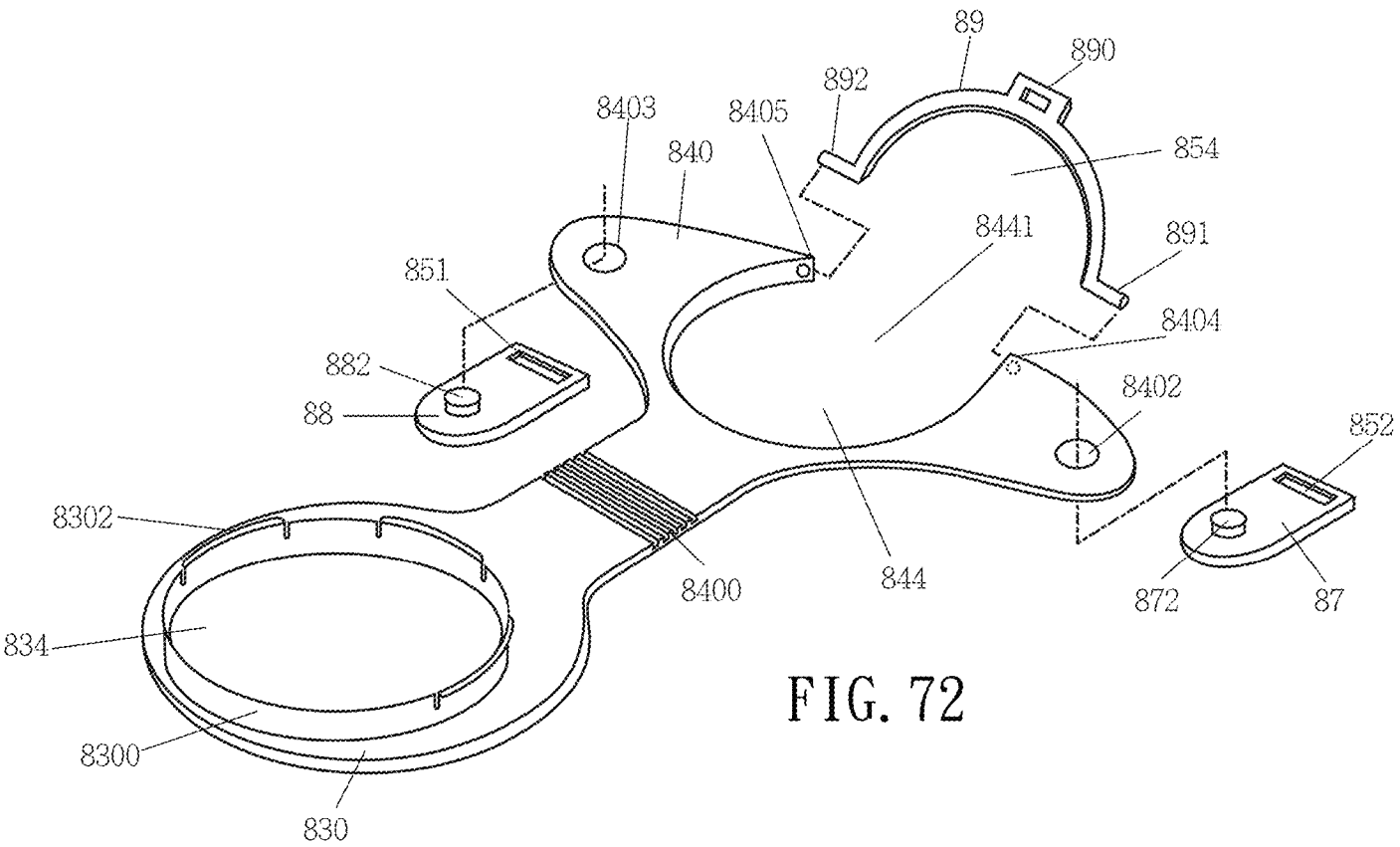
FIG. 72 is a partial exploded schematic view of a structure developmentally derived from the embodiment shown in FIG. 70 according to the present invention.
Figure 73:
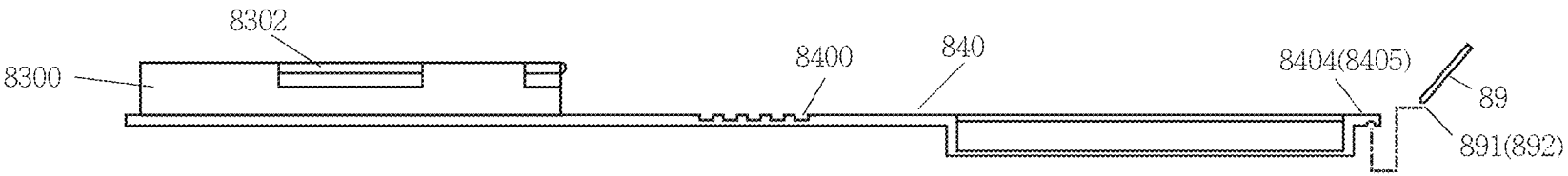
FIG. 73 is a side schematic view of FIG. 72 according to the present invention.
Figure 74:
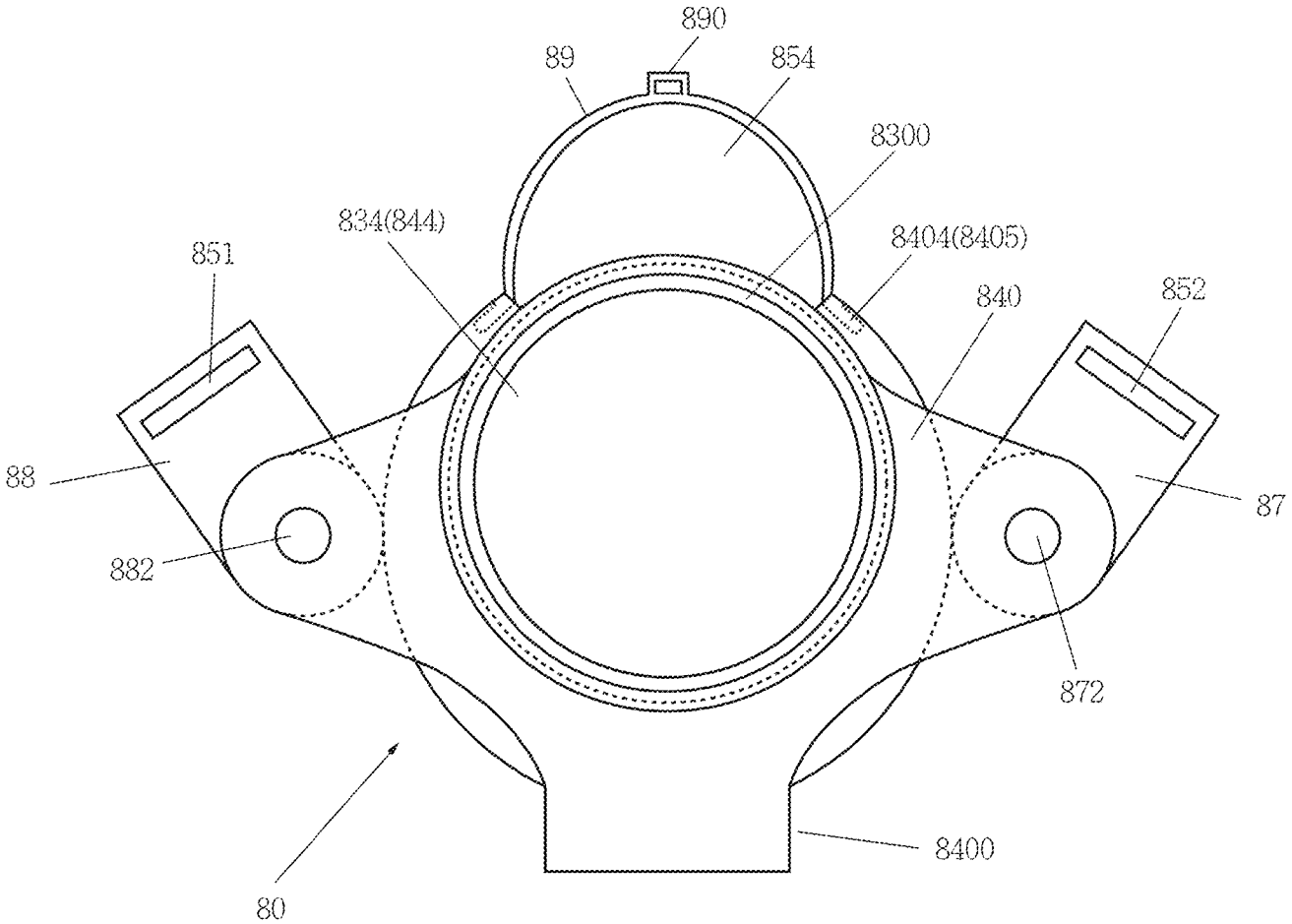
FIG. 74 is a closed state schematic view of FIG. 72 according to the present invention.

Referring to FIGS. 72 to 74, which show an embodiment developmentally derived from the fixing device 80 shown in FIGS. 68 to 71, wherein the present embodiment further provides the upper edge of the second main body 840 with an indentation 8441, the two sides of which are respectively provided with a left pin hole 8405 and a right pin hole 8404. The upper portion of the second main body 840 is further fitted with an arched body 89 provided with a recess 854, wherein the arched body 89 is an inverse U shape as shown in the diagrams; however, the arched body 89 can also be configured as an inverse V shape or other shapes (not shown in the drawings). The two ends of the arched body 89 are respectively fitted with a left pin member 891 and a right pin member 892, which are movable disposed within the left right pin holes 8405, 8404, respectively, thereby enabling rotational movement of the arched body 89 to the required angle. To operate, the angle of the arched body 89 is rotated until parallel with the angle of the second passage 844, whereupon the recess 854 provides space for a pet's tail to easily pass therethrough, after which the arched body 89 is rotated approximately 90 degrees and horizontally disposed on the pet's back. The upper side of the second main body 840 of the present embodiment uses the structure of the indentation 8441 to enable the arched body 89 provided with the recess 854 to connect therein. The fixing device 80 can also be changed and produced as an integral body provided with an appropriate bend angle (not shown in the drawings).

In addition, the upper portion of the arched body 89 is additionally provided with an upper hole 890, which is used to connect a movable separable upper fixing belt (not shown in the drawings, reference FIG. 63), with the other end of the upper fixing belt connected to the rings 160 or the sleeve member device 1610 provided on the support enclosure 16, thereby enabling more stable holding of the fixing device 80 at the position surrounding the pet's anus. In the present embodiment, because the upper edge of the second main body 840 is provided with the indentation 8441, hence, after clasping together the first and second main bodies 830, 840, only the upper edge of the first main body 830 is positioned between the pet's anus and tail. Because the area of contact surrounding the pet's anus is very small, thus the pet's defecation easily drops into the interior of the pet droppings collection bag 86.

Referring to FIGS. 75 to 81, which show an embodiment of the present invention applied in a covering body for a body protective device, such as a protective clothing or an airbag clothing. The body protective device comprises the front cover sheet 1, which is a jacket 15 formed from a front inner piece 1A and a rear inner piece 1B (see FIGS. 77 and 78), wherein the jacket is provided with openings 15A, 15B and an inner space to enable a user to put on the jacket 15.

Figure 76:
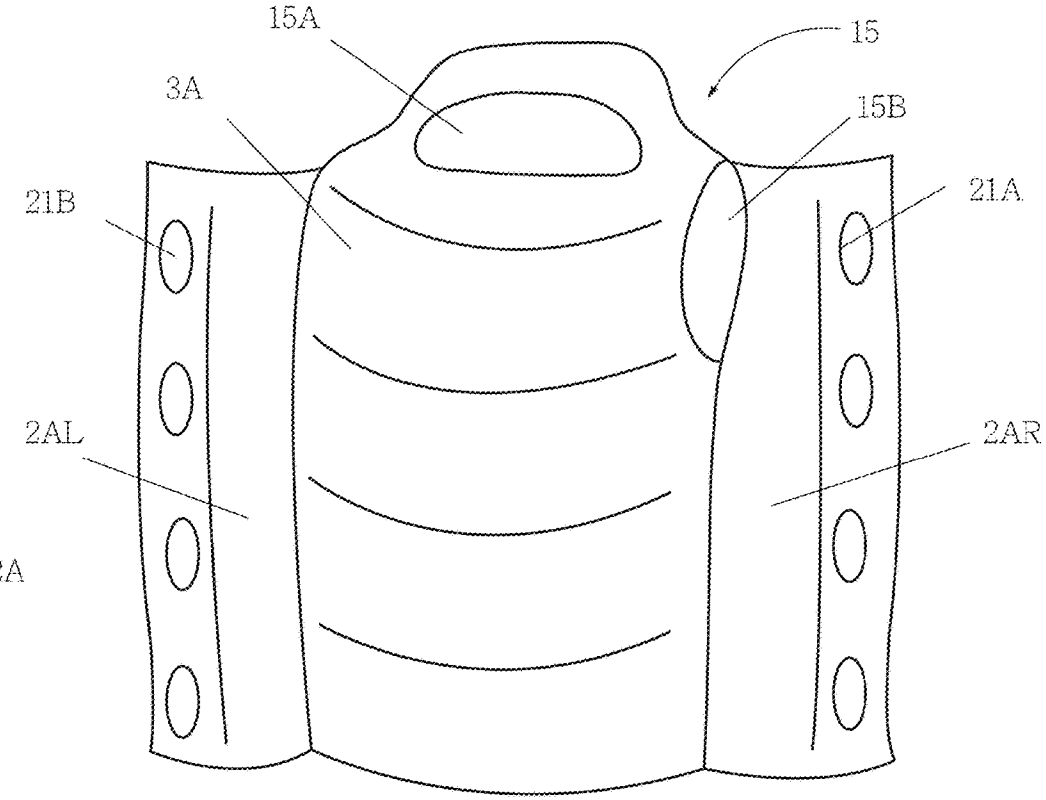
FIGS. 75 and 76 are three-dimensional structural schematic views of the covering body of the present invention applied in an embodiment of an airbag clothing of a body protective device.
Figure 75:
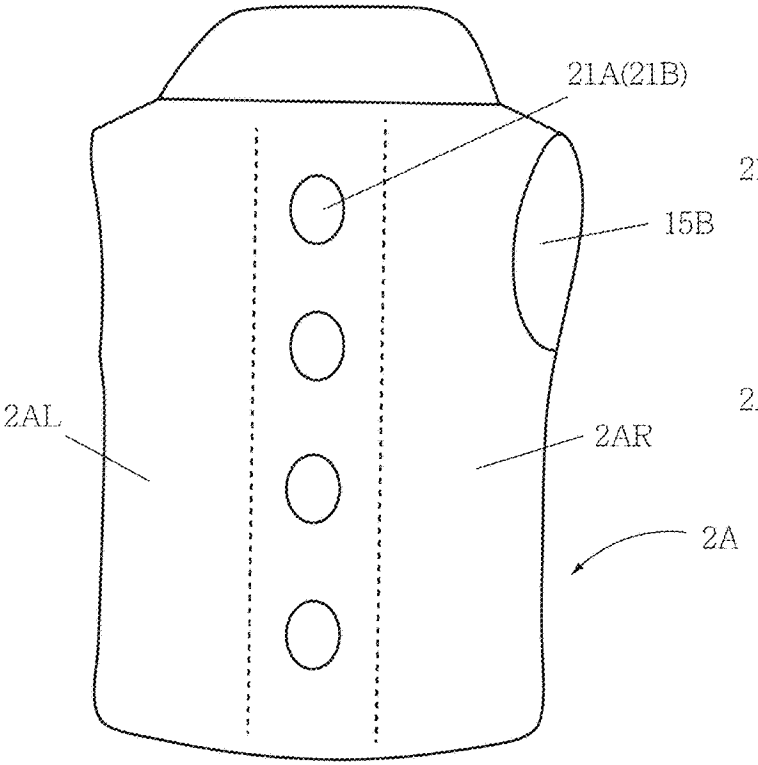

A rear cover sheet 2 is provided with at least one fixing member 21A and one corresponding fixing member 21B (see FIGS. 75 and 76). A first joining edge 131 is provided on the front cover sheet 1, a second joining edge 231 is provided on the rear cover sheet 2, and the flexible enclosure 3 is fitted on the outer side of the jacket 15. The flexible enclosure 3 of the present embodiment is a body protective device such as either a protective clothing or an airbag clothing, which is used as an outer clothing or a covering for the wearer. The covering body comprises a third joining edge 331, and either the first joining edge 131 or the second joining edge 231 is used to join together with the third joining edge 331 and securely fix either the front cover sheet 1 or the rear cover sheet 2 to the covering body. A retaining space formed between the front cover sheet 1 and the rear cover sheet 2 is used to retain the folded up covering body; moreover, the fixing members 21A and the corresponding fixing members 21B are further used to close up the front cover sheet 1 and the rear cover sheet 2 (see FIG. 75). When the body protective device is an airbag clothing, the airbag clothing comprises an inner air bag 3D and an outer air bag 3F, wherein the structures of the inner and outer air bags 3D, 3F can be either a single air bag or a plurality of independent air bags. Using a plurality of independent air bags as an example, each of the independent air bags is provided with an independent air chamber and a free end. When in a deflated state, a partial overlapping configuration is assumed between each of the airbags. When in an inflated state, the air bags are set upright and connected together.

Figure 84:
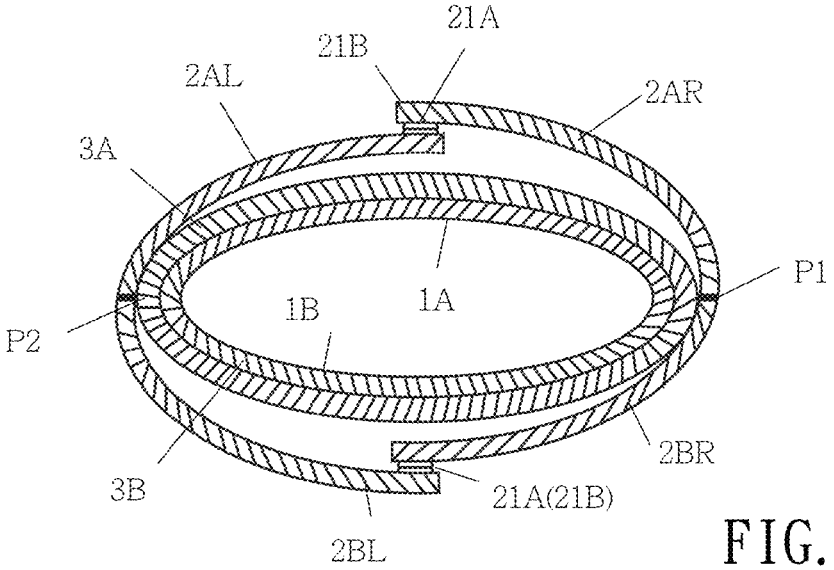
FIG. 84 is a cross-sectional structural schematic view of a first configurational embodiment of the airbag clothing covering piece of the present invention applied in the body protective device.

Concrete examples of the present embodiment primarily consist of three configurations. A first configuration is shown in FIGS. 75, 76, and 84 (a cross-sectional view), wherein the rear cover sheet 2 further comprises a first covering piece 2A, which is fitted to the periphery of the jacket 15. The first covering piece 2A is further fitted with a front left covering piece 2AL and a front right covering piece 2AR, wherein the front left covering piece 2AL and the front right covering piece 2AR respectively use the second joining edge 231 and the first joining edge 131 to connect to the front inner piece 1A. The front left, right covering pieces 2AL, 2AR are respectively provided with the at least one fixing member 21A and the corresponding fixing member 21B. The covering body further comprises a front covering body 3A, which comprises a third joining edge 331, wherein either the first joining edge 131 or the second joining edge 231 is used to join together with the third joining edge 331 and securely fix the front inner piece 1A and the front left, right covering pieces 2AL, 2AR to the front covering body 3A (see FIG. 87). The retaining space formed between the front inner piece 1A and the left, right covering pieces 2AL, 2AR is able to retain the folded up front covering body 3A; moreover, the fixing members 21A and the corresponding fixing members 21B are further used to close up the left, right covering pieces 2AL, 2AR. The rear cover sheet 2 further comprises a second covering piece 2B, which is fitted with a rear left covering piece 2BL and a rear right covering piece 2BR, wherein the rear left, right covering pieces 2BL, 2BR are respectively provided with the at least one fixing member 21A and the corresponding fixing member 21B. The covering body further comprises a rear covering body 3B, and the retaining space formed between the rear inner piece 1B and the left, right covering pieces 2BL, 2BR is used to retain the folded up rear covering body 3B, as well as further close up the rear left, right covering pieces 2BL, 2BR using the fixing members 21A and the corresponding fixing members 21B.

Figure 85:
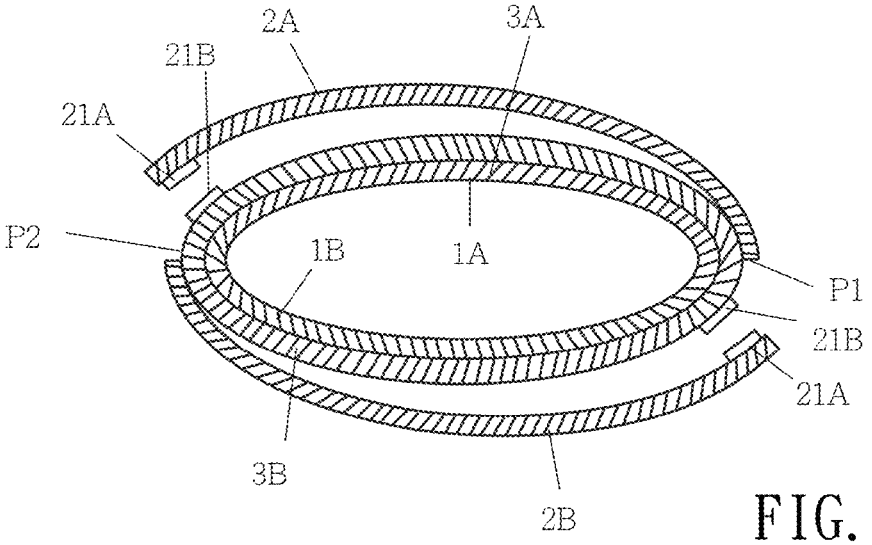
FIG. 85 is a cross-sectional structural schematic view of a second configurational embodiment of the airbag clothing covering piece of the present invention applied in the body protective device.

The second configuration of the present embodiment is shown in FIG. 85 (a cross-sectional view), wherein the first covering piece 2A corresponds to the inner piece 1A, and the first covering piece 2A is fitted to the periphery of the front side of the jacket 15; moreover, the starting point of the first covering piece 2A is P1. The fixing members 21A are fitted to the first covering piece 2A, and the corresponding fixing members 21B are fitted to the edge of the front inner piece 1A, wherein the edge of the front inner piece 1A is a terminal point P2. The retaining space formed between the front inner piece 1A and the first covering piece 2A is able to retain the folded up front covering body 3A; moreover, the fixing members 21A and the corresponding fixing members 21B are used to close up the first covering piece 2A. After closing up the first covering piece 2A, starting from point P1, the first covering piece 2A is made to cover the front covering body 3A within the range to the terminal point P2 (the first covering piece 2A can also set P2 as the starting point and P1 as the terminal point). The same structure as described above can also be applied in the second covering piece 2B contained in the rear cover sheet 2, wherein the second covering piece 2B is fitted to the periphery of the rear side of the jacket 15, and the starting point of the second covering piece 2B is P2. The fixing members 21A are fitted to the second covering piece 2B, and the corresponding fixing members 21B are fitted to the edge of the front inner piece 1B. The edge of the front inner piece 1B is the terminal point P1. The covering body further comprises the rear covering body 3B, and the retaining space formed between the rear inner piece 1B and the second covering piece 2B is used to retain the folded up rear covering body 3B, and also closes up the second right covering piece 2B using the fixing members 21A and the corresponding fixing members 21B. After closing up, starting from point P2, the second covering piece 2B is made to cover the rear covering body 3B within the range to the terminal point P1 (the second covering piece 2B can also set P1 as the starting point and P2 as the terminal point).

Figure 86:
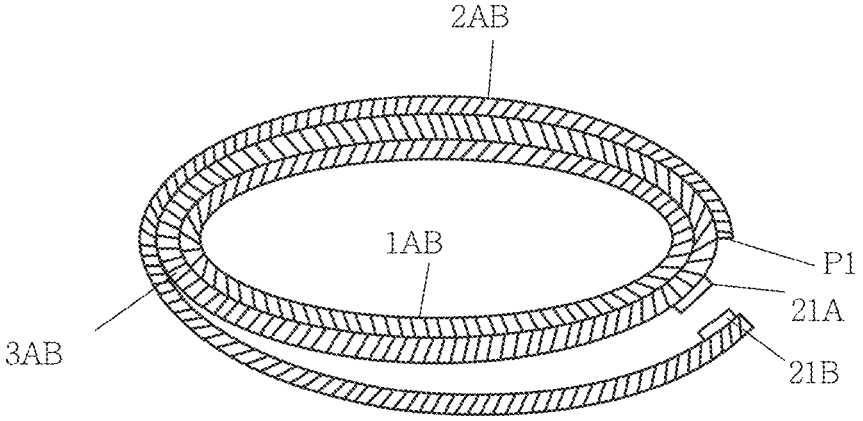
FIG. 86 is a cross-sectional structural schematic view of a third configurational embodiment of the airbag clothing covering piece of the present invention applied in the body protective device.

The third configuration of the present embodiment is shown in FIG. 86 (a cross-sectional view), wherein the configuration is realized with only the single covering piece 2AB fitted to the periphery of the front side of the jacket 15. The single covering piece 2AB corresponds to the single inner piece 1AB, and the starting point of the single covering piece 2AB is P1. Moreover, the fixing members 21A are fitted to the single covering piece 2AB, and the corresponding fixing members 21B are fitted to the edge of the single inner piece 1AB. The retaining space formed between the single inner piece 1AB and the single covering piece 2AB is able to retain the folded up single covering body 3AB, and also closes up the single covering piece 2AB using the fixing members 21A and the corresponding fixing members 21B. After closing up, the range covered by the single covering piece 2AB includes coiling round once starting from the starting point P1 and returning to the original starting point P1.

Referring to FIGS. 77 to 80, which show the covering body of the present embodiment further comprising an upper covering body 3C, which is fitted to the upper side of the jacket 15, and can be used to cover the head portion of a wearer. In addition, the upper covering body 3C is fitted with an upper inner piece 10 and an upper covering piece 2C, wherein the upper inner piece 10 is provided with a first upper joining edge 1311, and the upper covering piece 2C is provided with a second upper joining edge 1312. The first, second upper joining edges 1311, 1312 are joined together, and the retaining space formed between the upper inner piece 10 and the upper covering piece 2C is used to retain the folded up upper covering body 3C. The upper inner piece 10 and the upper covering piece 2C are respectively provided with the fixing members 21A and the corresponding fixing members 21B; moreover, the upper inner piece 10 and the upper covering piece 2C are also closed up using the fixing members 21A and the corresponding fixing members 21B. The upper covering body 3C further comprises a plurality of pleats 310, 320, 330, and in a folded state, the plurality of pleats 310, 320, 330 are used to collect together and fold up the upper covering body 3C.

Figure 78:
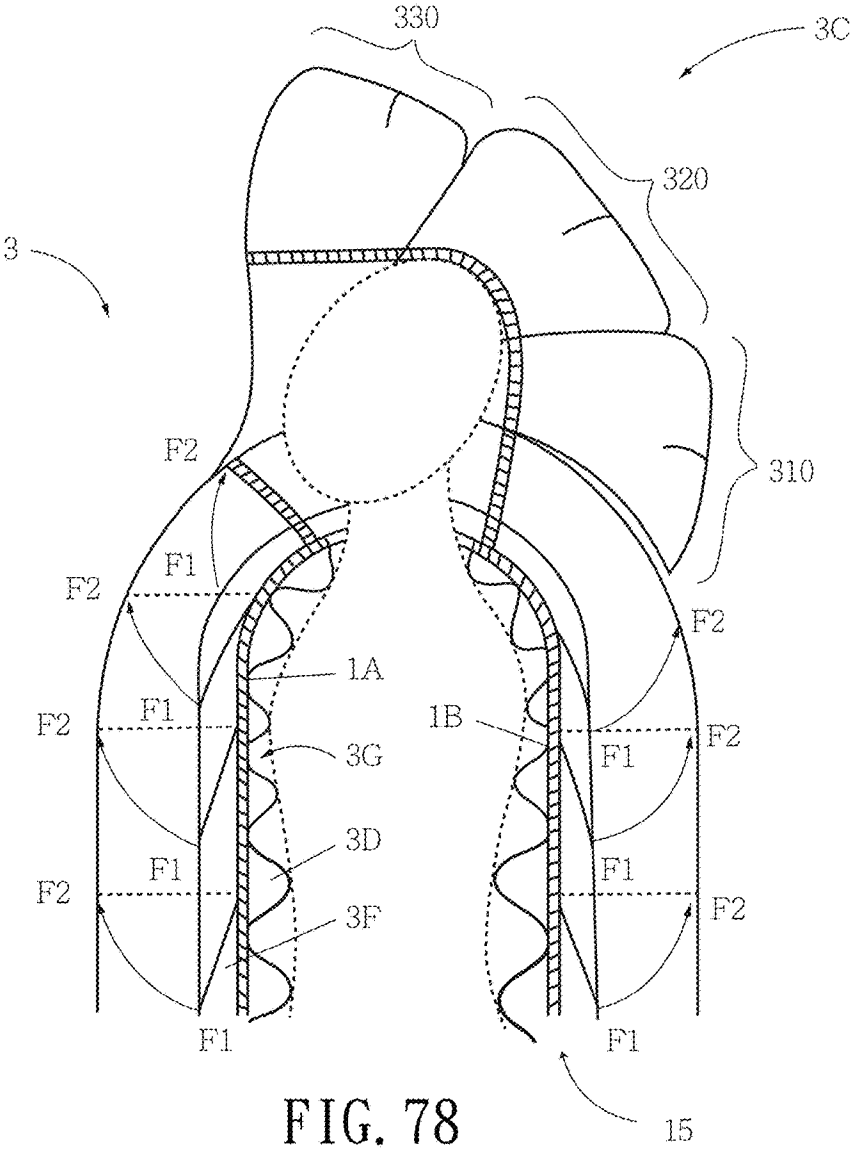
FIGS. 77 and 78 are lengthwise sectional schematic views of the covering body of the present invention applied in the embodiment of an airbag clothing covering piece of the body protective device.
Figure 77:
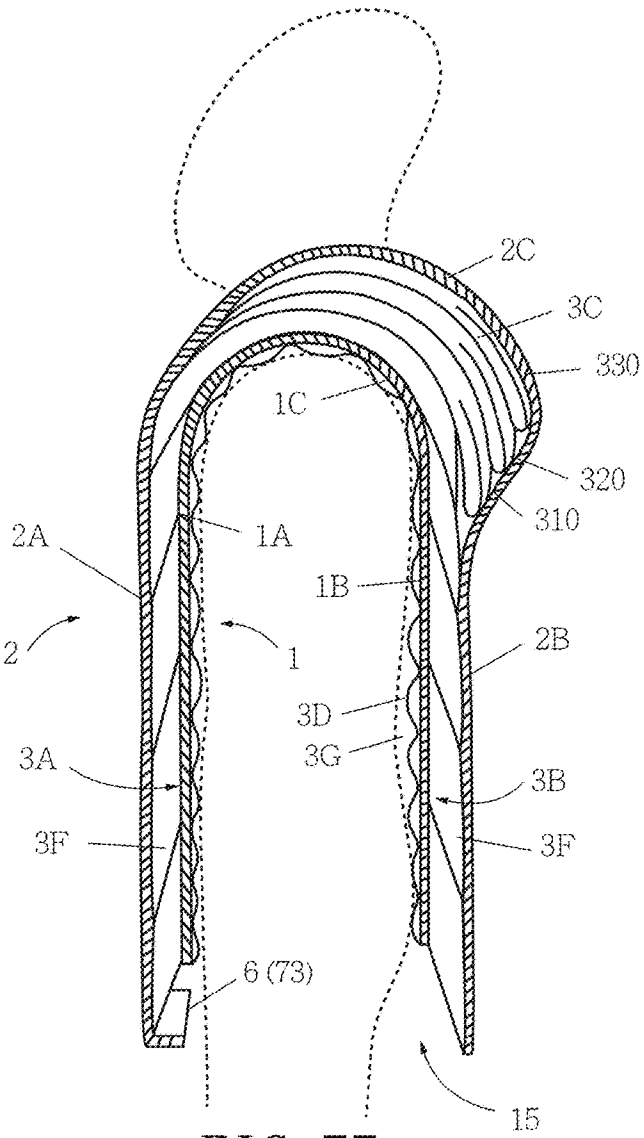
Figure 79:
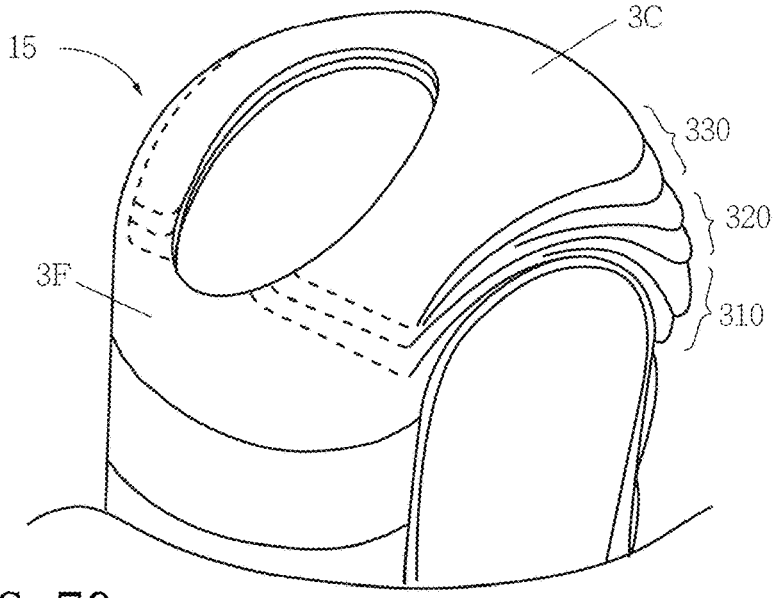
FIG. 79 is a three-dimensional structural schematic view of the present invention applied in the embodiment of the airbag clothing covering piece of the body protective device.
Figure 80:
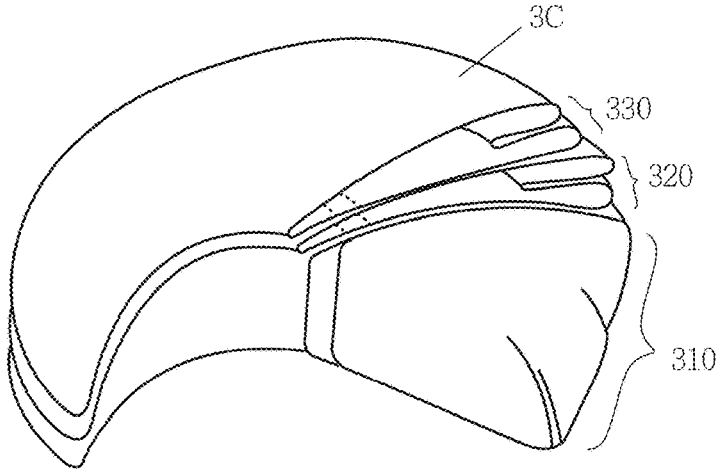
FIG. 80 is a partial structural lengthwise sectional view of FIG. 79 according to the present invention.
Figure 81:
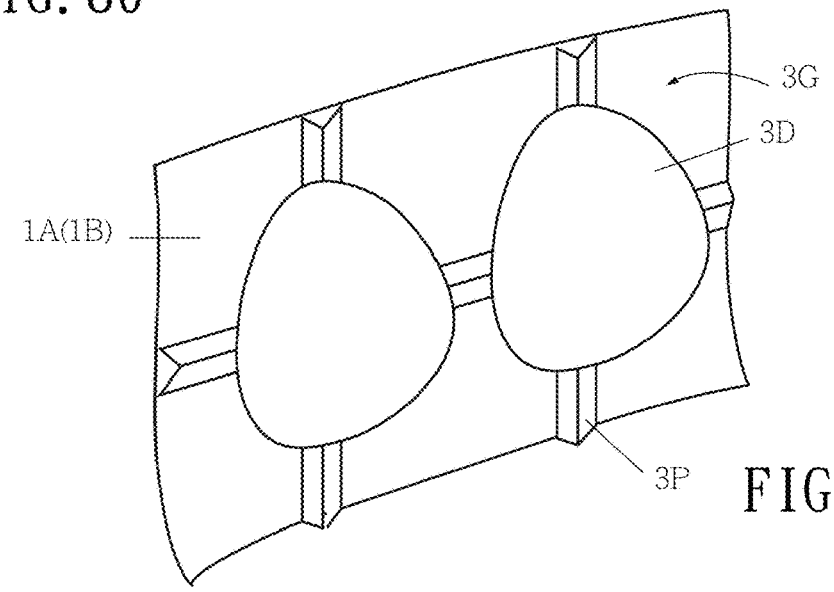
FIG. 81 is a partial structural schematic view of FIGS. 77 and 78 according to the present invention.

In addition, referring to FIGS. 77, 78, and 81, the front inner piece 1A, the rear inner piece 1B, and the upper inner piece 10 of the present embodiment positioned on one side of the inner space of the jacket 15 are provided with a plurality of supporting protrusions 3D. Connective channels 3P are provided between the plurality of supporting protrusions 3D, and the connective channels 3P are used to channel air to the interior of the supporting protrusions 3D, thereby causing the supporting protrusions 3D to form bulging structures provided with adequate supporting force. The inner space of the jacket 15 contacts one side of the wearer's body and is used to form a protective effect; moreover, because the plurality of supporting protrusions 3D assume a transverse, longitudinal, or diagonal arrangement, thus, long gaps 3G are also formed between the rows and columns of the supporting protrusions 3D. When the protective clothing or airbag clothing unfolds and inflates, the wearer's hands are free to carry out other operations using the long gaps 3G, for example: operating survival equipment or a mobile phone, eating and drinking, taking things out from their clothing pockets or carry bag, etc.

Figure 82:
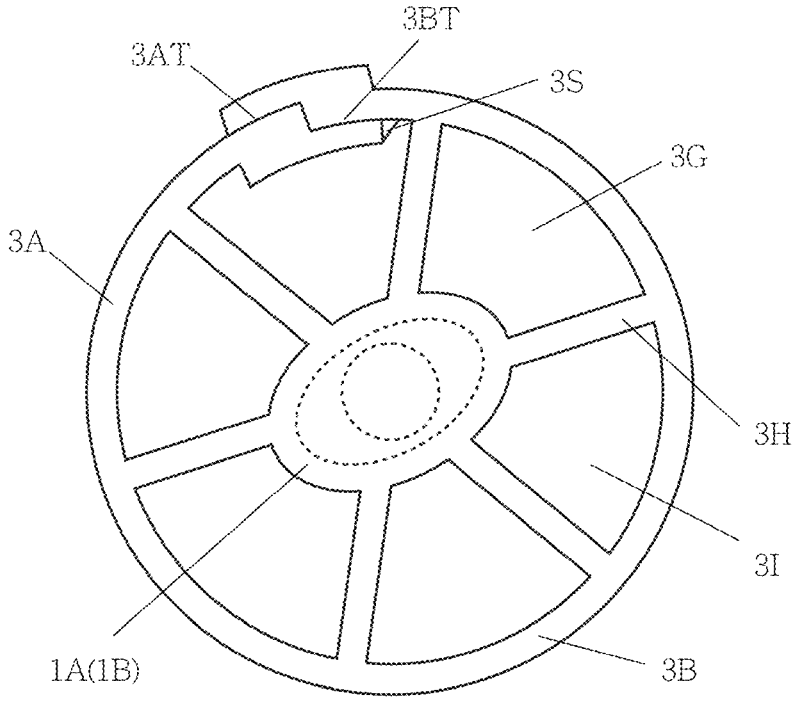
FIG. 82 is a cross-sectional structural schematic view of the covering body of the present invention applied in an embodiment of a hollow spherical body of a body protective device.
Figure 83:
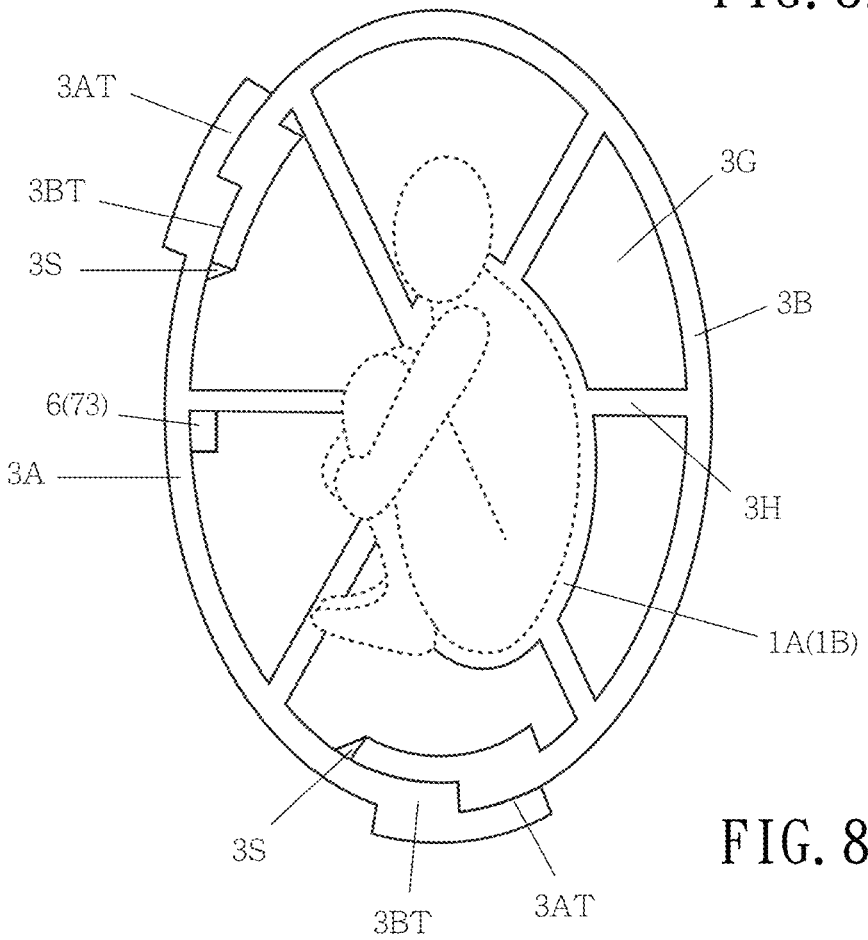
FIG. 83 is a lengthwise sectional structural schematic view of the covering body of the present invention applied in the embodiment of the hollow spherical body of the body protective device.
Figure 87:
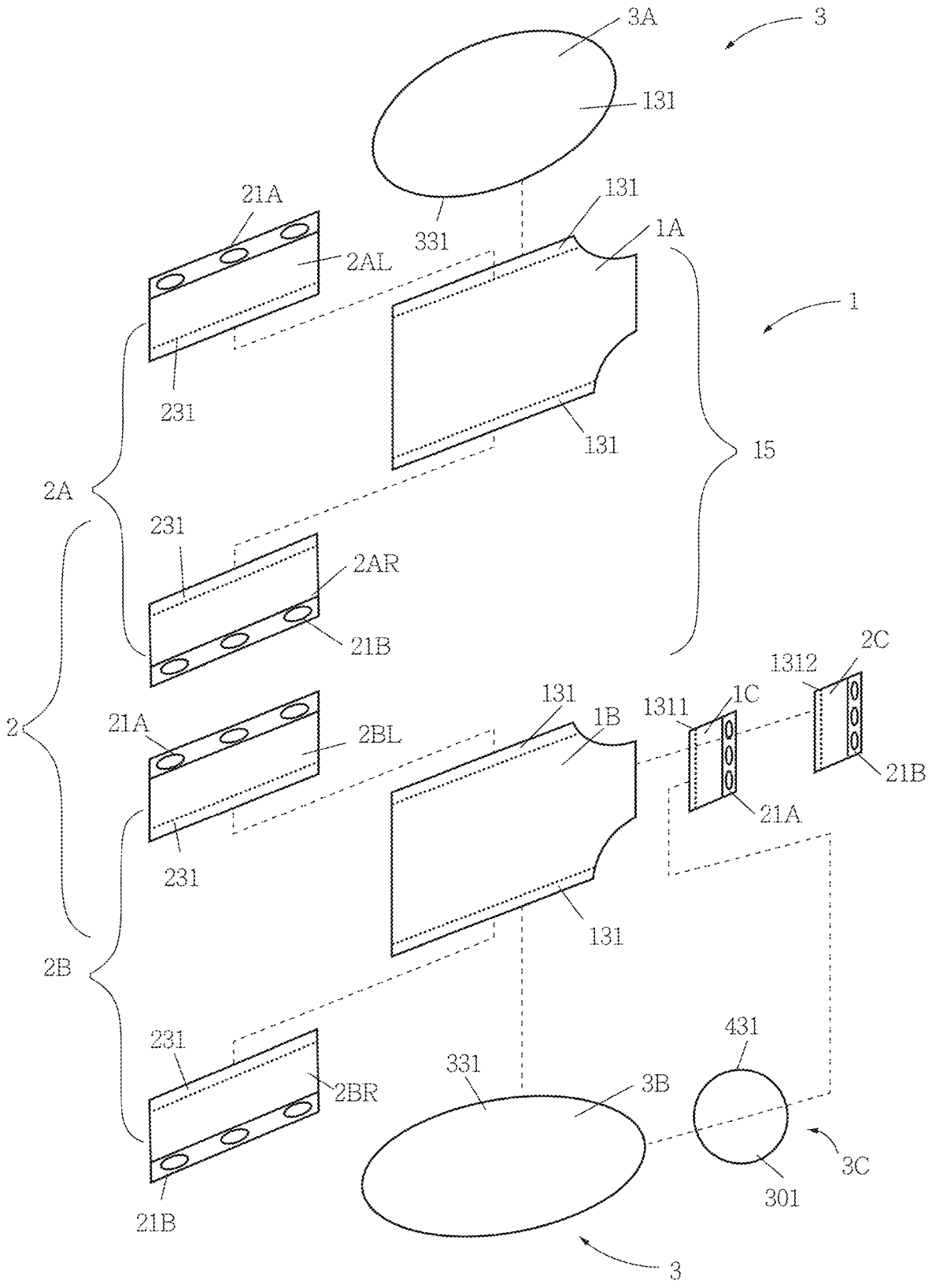
FIG. 87 is an exploded structural schematic view of the covering body of the present invention applied in the body protective device.

Referring to FIGS. 82, 83, and FIG. 87, which show an embodiment of the present invention applying the covering body in a body protective device, such as a hollow spherical body or a hollow airbag. The body protective device is provided with a plurality of supporting columns 3H, which are either inflatable air cylindrical body structures or foldable elastic cylindrical bodies. In addition, the plurality of supporting columns 3H are connected to either the front inner piece 1A or the rear inner piece 1B, with the plurality of supporting columns 3H used to support and fix the configurational shape of the exterior of the hollow spherical body or the hollow airbag by causing the exterior to assume an airbag cover body with a spherical body shape, circular shape, or an elliptical shape. When the supporting columns 3H are configured as air column structures, connective inflating channels are provided between the air column structures and the hollow spherical body or the surface of the hollow spherical body. The surface of the hollow spherical body or the hollow airbag can be configured as a single sheet flat surface or a plurality of airbag surfaces. A structure with a plurality of independent airbags structure can be adopted when configured as a plurality of airbags, such as the outer air bags 3F shown in FIGS. 77 and 78, with each of the independent airbags provided with an independent air chamber and a free end. When in an deflated state, the airbags assume a partial overlapping configuration, and when in an inflated state, the air bags are set upright and connected together. The hollow spherical body or the hollow airbags either comprise at least the front cover sheet 1 or the rear cover sheet 2, and further comprises at least one joining opening, which is formed from the joining of two joining ends 3AT, 3BT. In addition, each of the joining openings is provided with a sealing member 3S, which can be either a zipper, hook and loop fastener, magnetic fastener, or zipper adhesive tape.

Figure 88:
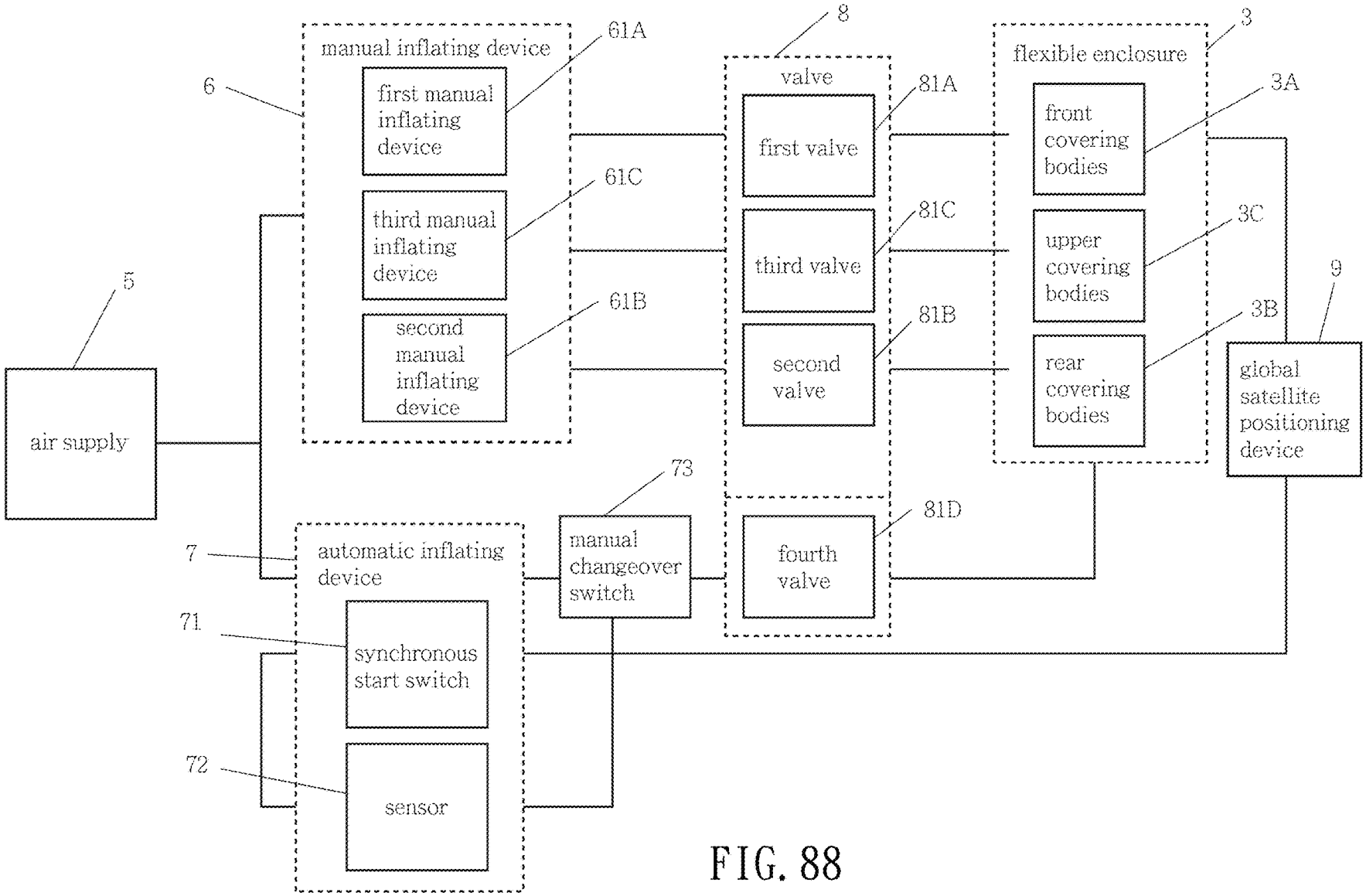
FIG. 88 is an operational flow diagram of the covering body of the present invention applied in the body protective device.

Referring to FIG. 88, wherein a body protective device comprises either an air supply 5, a manual inflating device 6, or an automatic inflating device 7, wherein the air supply 5 can be an inflation tube, a pump, or a pressure bottle. The manual inflating device 6 is fitted with a valve 8 for the purpose of respectively channeling air from the air supply 5 to inside the fitted airbags at the front, rear, and upper covering bodies 3A, 3B, and 3C, which respectively use a first, second, and third manual inflating device 61A, 61B, and 61C to control opening of a first, second, and third valve 81A, 81B, and 81C, thereby achieving the objective of inflating the airbags. in an emergency situation, the jacket wearer can carry out a manual inflating operation respectively on the front, rear, or upper covering bodies 3A, 3B, 3C according to circumstances (see FIG. 77 or 83). The automatic inflating device 7 is fitted with a synchronous start switch 71, a sensor 72, and a manual changeover switch 73. In an emergency situation, the sensor 72 transmits a signal to the synchronous start switch 71 to open a fourth valve 81D and channel in air from the air supply 5 to enable achieving the objective of inflating the airbags. Under certain conditions, when the sensor 72 malfunctions or is inappropriate to auto-start, the manual changeover switch 73 can be used to control the fourth valve 81D (see FIG. 77 or 83). In addition, the body protective device can further comprise a global satellite positioning device 9, which is connected to the synchronous start switch 71 and the sensor 72 (see FIG. 78). In an emergency situation, the sensor 72 can automatically transmit a satellite positioning signal to facilitate rescuing the accident victim. The front manual inflating device 6 comprises a device such as a conventional inflation tube, pump, or a one-way valve, and further comprises a device to open the valve, such as a pull cord or water soluble material using various types of physical or chemical principles.

Figure 89:
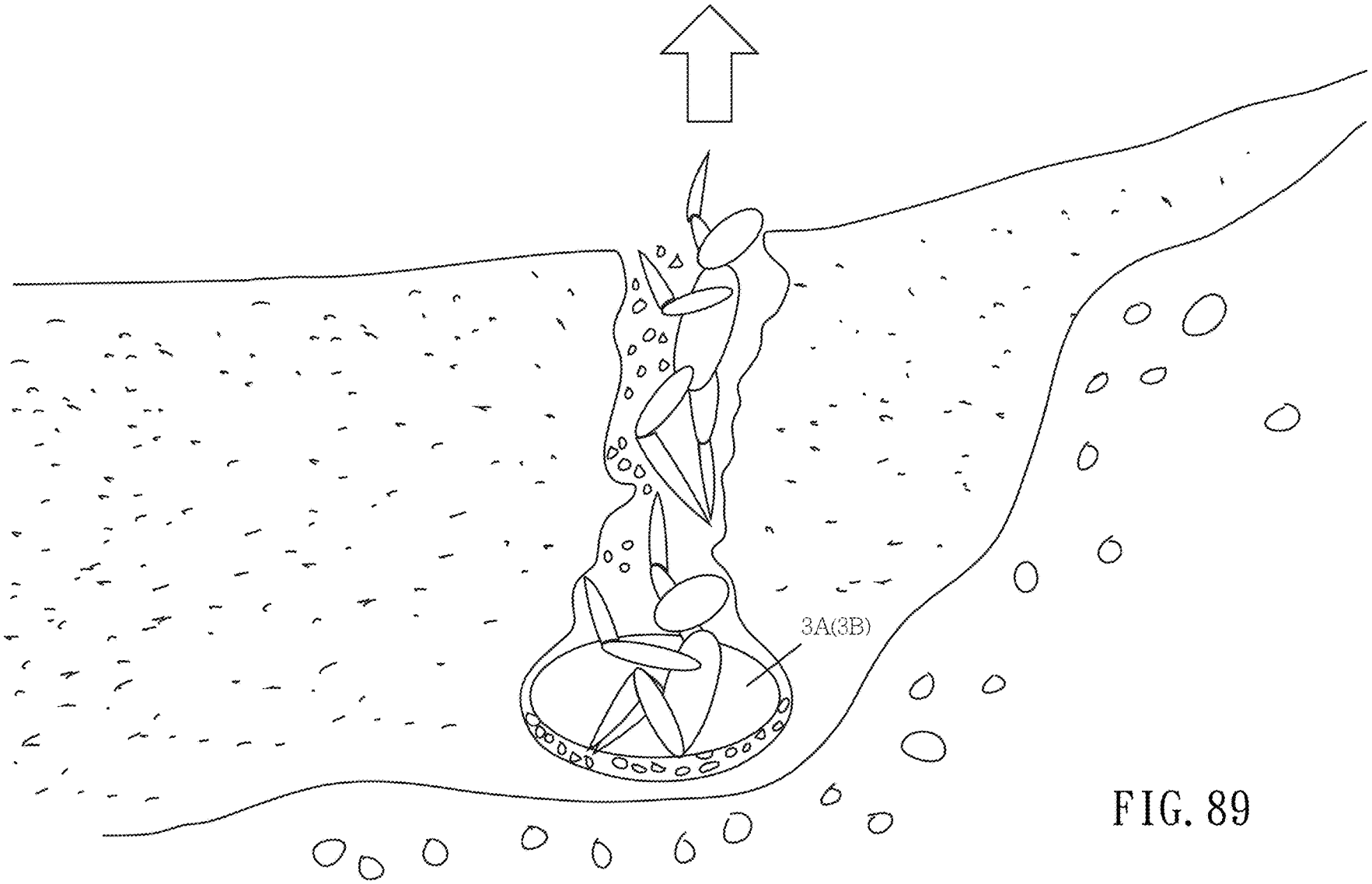
FIG. 89 is a schematic view of the covering body of the present invention applied in the body protective device during an outdoor emergency situation.

When the body protective device of the present invention is applied in mountain-climbing activities as an example, and a climber accidentally falls into a valley, the sensor 72 immediately transmits a signal to the synchronous start switch 71, causing the fourth valve 81D to open and channel air from the air supply 5 to achieve the effect of inflating the airbags of the covering body, forming an elliptical shaped or circular shaped body protective device that covers the wearer's body, thereby protecting the wearer from otherwise fatal injuries from falling into a valley. In particular, should an avalanche occur when climbing a high snow-capped mountain (see FIG. 89), and the wearer is buried under an accumulation of snow from the avalanche, because of the gaps 3G fitted inside the covering body (see FIG. 78 or 83), the wearer is able to manipulate or separate themself from the body protective device and use the space occupied by the body protective device after being buried by the accumulation of snow to slowly, upwardly dig themself out from the accumulation of snow, causing the accumulation of snow to fall into the occupied space as they dig upward, finally seeking help on the surface away from the snow dugout. Apart from having use in activities such as skiing, mountain-climbing, etc., the body protective device can also be used when riding a motorcycle, in water activities such as boating, aerial activities such as paragliding and hand gliding, etc., or after pairing with essential life support equipment, can also be further applied in safety equipment for passengers travelling by airplane. According to the criteria required for each of the activities described above (such as: temperature, speed, altitude, pressure, impact force, etc.,) the sensor 72 can be set to transmit the appropriate signal to the synchronous start switch 71 and when to transmit the signal.

It is of course to be understood that the embodiments described herein are merely illustrative of the principles of the invention and that a wide variety of modifications thereto may be effected by persons skilled in the art without departing from the spirit and scope of the invention as set forth in the following claims.

What is claimed is:

1. A body-worn structure, comprising:

a front cover sheet, an edge of which is provided with a cover piece;

a rear cover sheet, an edge of which is provided with a cover assembly corresponding to the cover piece;

a connecting portion provided on either the front cover sheet or the rear cover sheet, the front cover sheet and the rear cover sheet are mutually joined using the connecting portion;

a first joining edge provided on the front cover sheet;

a second joining edge provided on the rear cover sheet;

a support enclosure, having a first fastening portion and a first fastening assembly portion; the support enclosure is either undetachable or detachable to the front cover sheet or the rear cover sheet;

a left and right sides of either the front cover sheet or the rear cover sheet are respectively joined to the first fastening portion and the first fastening assembly portion, whereby the first fastening portion and a second fastening assembly portion are mutually joined and used to securely fix the front and rear cover sheets onto a wearer, the left and right sides of a front portion of either the front cover sheet or the rear cover sheet are respectively provided with an annular belt that is placed round the chest of a wearer;

a flexible enclosure having a third joining edge;

either the first joining edge or the second joining edge is used to join to the third joining edge to securely fix either the front cover sheet or the rear cover sheet to the flexible enclosure;

a retaining space formed between the front cover sheet and the rear cover sheet is used to retain the flexible enclosure, and the cover piece and the cover assembly are further used to close up the front cover sheet and the rear cover sheet, wherein the wearer is a pet, when the front cover sheet and the rear cover sheet are in a closed state, the connecting portion is horizontally positioned between the rear cover sheet and the front cover sheet; the flexible enclosure is a covering body, and when the front cover sheet and the rear cover sheet are in an opened state, the rear cover sheet and the front cover sheet, after being horizontally connected through the connecting portion, are aligned on the back of the pet, the covering body covers the juxtaposed front cover sheet and the rear cover sheet; the front cover sheet and the rear cover sheet are arranged side by side in parallel position connected with the connecting portion therebetween in an open state, the connecting portion being as a hinge element to enable the rear cover sheet being closed or opened to retain the folded up flexible enclosure.

2. The body-worn structure according to claim 1, wherein the support enclosure is provided with a drawstring, and an extremity of the drawstring is provided with a fixing ring.

3. The body-worn structure according to claim 1, wherein either the first fastening portion or the first fastening assembly portion is provided with at least one female buckle, which corresponds to a male buckle provided on the front end of the annular belt, a connection between the female and male buckles is used to further disperse a strain of a drawstring to the first fastening portion and the first fastening assembly portion; a Y-shaped or X-shaped buckle component structure is formed after joining the first fastening portion and the first fastening assembly portion; the annular belt is an annular belt with the left and right front ends separated, and a connection between the female and male buckles is used to further disperse the strain of the drawstring; the female buckle is able to be replaced alternatively by male buckle and vise versa.

4. The body-worn structure according to claim 1, wherein the front portion of the covering body is provided with a through hole corresponding to a position of a drawstring, and the through hole is provided with a first waterproof piece and a second waterproof piece; the first waterproof piece effects a structure on the upper portion of the second waterproof piece that overlaps and covers a partial area of the through hole to form an opening, which is used to achieve the function of preventing rain water from seeping in the through hole.

5. The body-worn structure according to claim 1, wherein the third joining edge and the first joining edge is partially joined, and an unjoined area forms a containing port; when the flexible enclosure is in an unfolded state, the rear cover sheet is disposed within a containing interlayer between the front cover sheet and the flexible enclosure through the containing port.

6. The body-worn structure according to claim 1, wherein the wearer of the body-worn structure is a pet, the support enclosure is fitted with either the at least one ring or a sleeve member device; the ring or the sleeve member device provides for external connecting a fixing device thereto, and the fixing device is used to fixedly position a pet droppings collection bag at an area surrounding the pet's anus.

7. A body-worn structure, comprising:

a front cover sheet, an edge of which is provided with a cover piece;

a rear cover sheet, an edge of which is provided with a cover assembly corresponding to the cover piece;

a connecting portion provided on either the front cover sheet or the rear cover sheet, the front cover sheet and the rear cover sheet are mutually joined using the connecting portion;

a first joining edge provided on the front cover sheet;

a second joining edge provided on the rear cover sheet;

a support enclosure, having a first fastening portion and a first fastening assembly portion; the support enclosure is either undetachable or detachable to the front cover sheet or the rear cover sheet;

a left and right sides of either the front cover sheet or the rear cover sheet are respectively joined to the first fastening portion and the first fastening assembly portion, whereby the first fastening portion and a second fastening assembly portion are mutually joined and used to securely fix the front and rear cover sheets onto a wearer, the left and right sides of a front portion of either the front cover sheet or the rear cover sheet are respectively provided with an annular belt that is placed round the chest of a wearer;

a flexible enclosure having a third joining edge;

either the first joining edge or the second joining edge is used to join to the third joining edge to securely fix either the front cover sheet or the rear cover sheet to the flexible enclosure;

a retaining space formed between the front cover sheet and the rear cover sheet is used to retain the flexible enclosure, and the cover piece and the cover assembly are further used to close up the front cover sheet and the rear cover sheet, wherein the wearer is a pet; the flexible enclosure is a pet carrier bag, which is provided with an opening, the pet carrier bag comprises a third joining edge; either the first joining edge or the second joining edge is used to join to the third joining edge, thereby securely fixing either the front cover sheet or the rear cover sheet to the pet carrier bag, when the front cover sheet and the rear cover sheet are opened up, the front cover sheet is positioned on the upper portion of the pet's back, and the connection portion is used to realize a longitudinal connection, the rear cover sheet has a function as an extended portion that hangs on one side of the pet's body, the connection portion is horizontally positioned between the rear cover sheet and the front cover sheet; moreover, the third joining edge is provided on one of the sides of the bag opening of the pet carrier bag, and the other side is a free side, the free side is used to manipulate opening and extending the bag opening downward to the pet's legs to facilitate placing the pet within the pet carrier bag through the bag opening in an upward direction.

8. The body-worn structure according to claim 7, wherein the wearer of the body-worn structure is a pet, the support enclosure is fitted with either at least one ring or a sleeve member device; the ring or the sleeve member device provides for external connecting a fixing device thereto, and the fixing device is used to fixedly position a pet droppings collection bag at an area surrounding the pet's anus.

* * * * *